US005290669A

United States Patent [19]

Hirabayashi et al.

[11] Patent Number: 5,290,669

[45] Date of Patent: Mar. 1, 1994

[54] SILVER HALIDE COLOR PHOTOGRAPHIC LIGHT-SENSITIVE MATERIAL

[75] Inventors: Shigeto Hirabayashi; Yasushi Usagawa, both of Tokyo; Nobuaki Kagawa; Yasuhiko Kawashima, both of Iruma, all of Japan

[73] Assignee: Konica Corporation, Tokyo, Japan

[21] Appl. No.: 907,135

[22] Filed: Jun. 29, 1992

[30] Foreign Application Priority Data

Jul. 4, 1991 [JP] Japan ..... 3-189488

[51] Int. Cl.[5] ..... G03C 1/46

[52] U.S. Cl. ..... 430/507; 430/517; 430/519; 430/522; 430/552; 430/557

[58] Field of Search ..... 430/507, 517, 519, 522, 430/552, 557

[56] References Cited

U.S. PATENT DOCUMENTS

| | | | |
|---|---|---|---|
| 2,611,696 | 9/1952 | Keyes et al. | 430/522 |
| 2,719,088 | 9/1955 | Herz et al. | 430/507 |
| 3,471,293 | 10/1969 | Ohlschlager et al. | 430/522 |
| 3,480,436 | 11/1969 | Wilson | 430/522 |
| 5,019,490 | 5/1991 | Kobayashi et al. | 430/557 |

FOREIGN PATENT DOCUMENTS

| | | | |
|---|---|---|---|
| 663801 | 9/1965 | Belgium . | |
| 1077049 | 7/1967 | United Kingdom | 430/522 |

OTHER PUBLICATIONS

Derwent Abstract AN 90-316701, abstract of JP-A-2,225,476, Sep. 7, 1990.

*Primary Examiner*—Charles L. Bowers, Jr.
*Assistant Examiner*—Thomas R. Neville
*Attorney, Agent, or Firm*—Finnegan, Henderson Farabow, Garrett & Dunner

[57] ABSTRACT

A silver halide color photographic light-sensitive material having photographic component layers on a support and at least one layer of which contains a silver salt of dye, is disclosed. The material has properties of high sharpness, high speed, less fogging and excellent raw stock stability.

13 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, more particularly, to a silver halide color photographic light-sensitive material having high sharpness, high speed, less fogging and excellent raw stock stability.

BACKGROUND OF THE INVENTION

In general, a silver halide color photographic light-sensitive material (hereinafter, it may be called simply "light-sensitive material".) comprises a support having thereon a red sensitive silver halide emulsion layer containing cyan couplers, a green sensitive silver halide emulsion layer containing magenta couplers and a blue sensitive silver halide emulsion layer containing yellow couplers. In addition, anti-halation layers, intermediate layers, filter layers and protective layers are provided, if necessary. Normally, between a blue sensitive silver halide emulsion layer and a green sensitive silver halide emulsion layer, a yellow filter layer capable of being bleached is provided in order to absorb blue light being transmitted through a blue sensitive silver halide emulsion layer.

In addition, between emulsion layers, an intermediate layer may be provided, and as an outermost layer, a protective layer may be provided. It is known that the above-mentioned light-sensitive silver halide emulsion layer may be provided in a different order from the above-mentioned order. In addition, it is also known that, as each of silver halide emulsion layer, light-sensitive silver halide emulsion layer comprising 2 or more layers having light-sensitivity in substantially the same wavelength on each color light and having different sensitivity may be provided.

In general, it is important for a light-sensitive material to have high speed and less fogging. In recent light-sensitive materials, demand for image quality in users side has been urged and progress in changing to small format has been seen. Therefore, images having high sharpness and high image quality are desired still more, and much endeavors have been continued so far.

For the improvement in sharpness, various investigation have been performed from the viewpoint of optical and development effect.

From optical point of view, it is known to control the grain size of silver halide emulsions scattering light by making them to mono-dispersed silver halide emulsion and to reduce the sum of light-sensitive silver halide emulsion to 10 g/m$^2$ or less (in terms of Ag).

In the same manner as mentioned above, making thin of photographic component layer has been investigated from the viewpoint of shortening the path of light scattering. Especially, in the case of silver halide emulsion layer nearer to a support, to make them thin has been known to be an effective means for the improvement in sharpness because the path of light scattering from the surface of light-sensitive material is long. (For example, Journal of the Optical Society of America) 58(9), 1245–1256 (1968), Photographic Science and Engineering) 16 (3), pp. 181–191 (1972).

In addition, as practical means, it has been known to remove nonsensitive intermediate layers mainly composed of gelatin, to reduce coating amount of gelatin merely, to reduce coating amount of coupler, to reduce the amount of high boiling solvent for coupler dispersion and to use so-called polymer couplers.

In general, for a silver halide color photographic light-sensitive material for photographing use, a layer structure of a red sensitive layer, a green sensitive layer and a blue sensitive layer in this order from a support for the improvement in color reproducibility is often adopted, wherein a yellow filter layer is provided on the support side of blue sensitive layer in order to cut blue sensitive portion of the green sensitive layer and the red sensitive layer. Normally, in order to improve color separation property (cutting property) by means of aforesaid yellow filter layer, a method of enhancing the concentration of yellow filter layer is utilized. However, when a yellow filter layer is thickened, it is not preferable because the sharpness of a green light-sensitive layer and a red light-sensitive layer are degraded while color reproducibility is improved.

On the other hand, a technology to add hydrophilic yellow dye, especially in a blue sensitive layer, is known for the improvement in sharpness. This method is not preferable because desensitization of blue sensitive layer due to dye is considerable, while sharpness is improved.

In addition, a method to make a yellow filter layer thin and to increase adding amount of yellow colloidal silver. In this case, however, there are defects to make fog of a light-sensitive layer adjoining to the yellow filter layer and to deteriorate processing stability remarkably.

Normally, at the upper side or the lower side of aforesaid yellow filter layer, an intermediate layer mainly composed of gelatin is provided. However, when this intermediate layer was removed as means for making the layer thin, it turned out that fogging on the adjoining blue sensitive silver halide emulsion layer and green sensitive silver halide emulsion layer were increased and the sensitivity was decreased.

With regard to the increase of fogging and the decrease of sensitivity, the detail of the mechanism is unknown. However, it is considered that contact of colloidal silver contained in the yellow filter layer and the anti-halation layer to the silver halide emulsion is one of the causes.

SUMMARY OF THE INVENTION

The object of the present invention is to provide a silver halide color photographic light-sensitive material having high sharpness, high speed, less fogging and excellent raw stock stability.

The above-mentioned object of the present invention is attained by the following silver halide color photographic light-sensitive material:

(1) A silver halide color photographic light-sensitive material comprising a support having thereon a blue sensitive silver halide emulsion layer, a green sensitive silver halide emulsion layer, a red sensitive silver halide emulsion layer and a yellow filter layer wherein at least one kind of silver salt of dye is contained in at least one of said yellow filter layer.

(2) A silver halide color photographic light-sensitive material comprising a support having thereon a blue sensitive silver halide emulsion layer, a green sensitive silver halide emulsion layer, a red sensitive silver halide emulsion layer and an anti-halation layer wherein at least one kind of silver salt of dye is contained in at least one of said anti-halation layer.

(3) A silver halide color photographic light-sensitive material comprising a support having thereon a blue sensitive silver halide emulsion layer, a green sensitive silver halide emulsion layer and a red sensitive silver halide emulsion layer wherein at least one of benzoylacetoanilido type yellow coupler is contained in at least one of said blue sensitive silver halide emulsion layers and at least one kind of silver salt dye is contained in any of photographic component layers.

(4) A silver halide color photographic light-sensitive material comprising a support having thereon a blue sensitive silver halide emulsion layer, a green sensitive silver halide emulsion layer and a red sensitive silver halide emulsion layer wherein at least one of cyan couplers represented by the following formulas C-1 or C-2 is contained in at least one of said red sensitive silver halide emulsion layer and at least one kind of silver salt dye is contained in any of photographic structure layers.

Formula C-1:

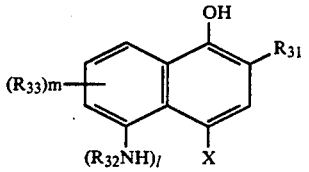

(wherein $R_{31}$ represents —CON($R_{34}$)($R_{35}$), —NH-$COR_{34}$, —NHCOO$R_{36}$, —NHSO$_2$$R_{36}$, —NH-CON($R_{34}$)($R_{35}$), —SO$_2$N($R_{34}$)($R_{35}$) or —NH-SO$_2$N($R_{34}$)($R_{35}$); $R_{32}$ represents a hydrogen atom or a substituent; $R_{33}$ represents a substituent; X represents a hydrogen atom or a group splitting off by the reaction with an aromatic primary amine developer oxidation product; l represents 0 or 1; m represents 0 to 3 integers; $R_{34}$ and $R_{35}$ respectively represent a hydrogen atom, an aromatic group, an aliphatic group or a heterocyclic group; $R_{36}$ represents an aromatic group, an aliphatic group or a heterocyclic group. When m is 2 or 3, each of $R_{33}$ may be the same or different, and may be linked together to form a ring. In addition, $R_{34}$ and $R_{35}$, $R_{32}$ and $R_{33}$ and $R_{32}$ and X may form rings. However, when l represents 0, $R_{31}$ represents —CONH$R_{37}$ and $R_{37}$ represents an aromatic group.)

Formula C-II

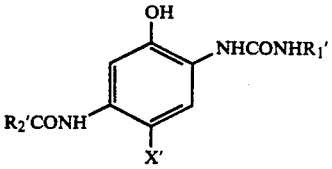

(wherein X' represents a hydrogen atom or a group capable of being split off by coupling with an aromatic primary amine color developer; $R_1$' represents an aryl group or a heterocyclic group; $R_2$' represents an aliphatic group or an aryl group.)

(5) A silver halide color photographic light-sensitive material comprising a support having thereon a blue sensitive silver halide emulsion layer, a green sensitive silver halide emulsion layer and a red sensitive silver halide emulsion layer wherein at least one heterocyclic type anti-foggant is contained in at least one of aforesaid light-sensitive silver halide emulsion layers and at least one kind of silver salt dye is contained in any of photographic component layers.

DETAILED DESCRIPTION OF THE INVENTION

Hereunder, we will explain the present invention in detail.

At first, we will explain silver salt of dye in the present invention.

In the present invention, a silver salt of dye represents a silver salt and a silver complex formed by the reaction between a dye and a silver ion. A dye represents an organic compound having absorption in a visible spectral (380–700 nm).

Hereunder, we will explain preferable dyes capable of forming silver salt of dyes used in the present invention. However, the present invention is not limited thereto.

As the above-mentioned dyes, dyes represented by the following formulas I to V can be cited.

Formula I

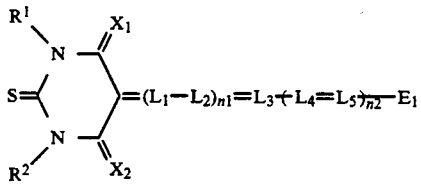

wherein $R^1$ and $R^2$ each represents a hydrogen atom, an alkyl group, an alkenyl group, an aryl group or a heterocyclic group; $X_1$ and $X_2$ each represents an oxygen atom or a sulfur atom; $L_1$ to $L_5$ represent methine groups; $n_1$ and $n_2$ each represents 0 to 2 integers; $E_1$ represents a group having an acid nucleus.)

Formula II

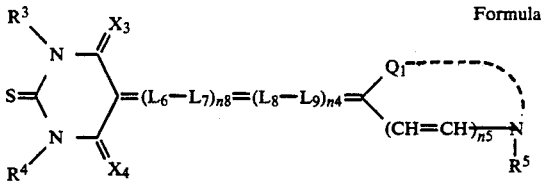

wherein $R^3$ and $R^4$ are the same as $R_1$ and $R^2$ in Formula I; $X_3$ and $X_4$ are the same as $X_1$and $X_2$ in Formula I; $L_6$ to $L_9$ represent methine group; $n_3$ to $n_5$ represent 0 to 2 integers; $R^5$ represents an alkyl group or an alkenyl group; $Q_1$ represents a non-metallic atom group necessary for forming 5- membered or 6-membered heterocyclic group.)

Chemical III

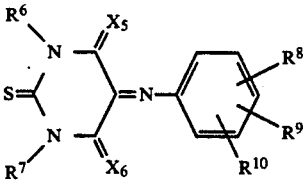

(wherein $R^6$ and $R^7$ represent $R^1$ and $R^2$ in Formula I; $X_5$ and $X_6$ represent $X_1$ and $X_2$ in Formula I; $R^8$ to $R^{10}$ represent a hydrogen atom, an alkyl group, an alkenyl group, an aryl group, a heterocyclic group, a halogen atom, a cyano group, a sulfo group, —COR$^{11}$, —CON(R$^{11'}$)(R$^{12}$), —N(R$^{11}$)(R$^{12}$), —OR$^{11}$, —SOR$^{11}$, $-SO_2R^{11}$, $-SO_2N(R^{11})(R^{12})$, $-N(R^{11})COR^{12}$, $-N(R^{11})SO_2R^{12}$, $-N(R^{11})CON(R^{12})(R^{13})$, $-SR^{11}$ or $-COOR^{11}$; $R^{11}$ to $R^{13}$ represent a hydrogen atom, an alkyl group, an alkenyl group, an aryl group or a heterocyclic group.

Chemical IV

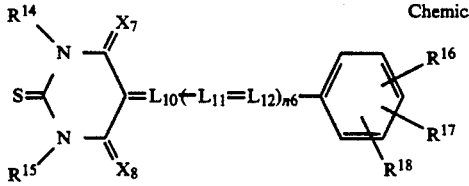

(wherein $R^{14}$ and $R^{15}$ are the same as $R^1$ and $R^2$ in Formula I; $X_7$ and $X_8$ are the same as $X_1$ and $X_2$ in Formula I. $L_{10}$ to $L_{12}$ represent methine groups; $n_6$ represents 0 to 2 integers; $R^{16}$ to $R^{18}$ are the same as $R^8$ to $R^{10}$ in Formula III.

Chemical V

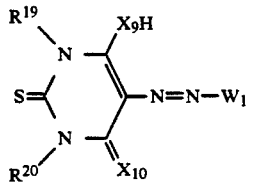

(wherein $R^{19}$ and $R^{20}$ are the same as $R^1$ and $R^2$ in Formula I; $X_9$ and $X_{10}$ are the same as $X_1$ and $X_2$; $W_1$ represents an aryl group or a heterocyclic group.)

In the above-mentioned formulas, as alkyl groups represented by $R^1$ and $R^2$, for example, a methyl group, an ethyl group, a propyl group, an isopropyl group, an n-butyl group, a tert-butyl group, a cyclopentyl group and a cyclohexyl group are cited. The above-mentioned alkyl group may be substituted by a hydroxy group, a cyano group, a sulfo group, a carboxyl group, a halogen atom (for example, a fluorine atom, a chlorine atom and a bromine atom), an alkoxy group (for example, a methoxy group and an ethoxy group), an aryloxy group (for example, a phenoxy group, a 4-sulfophenoxy group, a 2,4-disulfophenoxy group), an aryl group (for example, a phenoxy group, a 4-sulfophenyl group and a 2,5-disulfophenyl group), an alkoxycarbonyl group (for example, a methoxycarbonyl group and an ethoxycarbonyl group) and an aryloxycarbonyl group (for example, a phenoxycarbonyl group).

As aryl groups represented by $R^1$, $R^2$ and $W_1$, for example, a phenyl group and a naphthyl group are cited. These groups can be substituted by an alkyl group represented by $R^1$ and $R^2$ and the same group as a substituent represented by the substituent for an alkyl group.

As heterocyclic group represented by $R^1$, $R^2$ and $W_1$, for example, a pyridyl group, a thiazolyl group, an oxazolyl group, an imidazolyl group, a furyl group, a pyrrolyl group, a pyrazinyl group, a pyrimidinyl group, a pyridazinyl group, a purinyl group, a selenazolyl group, a sulforanyl group, a piperidinyl group, a pyrazolyl group and a tetrazolyl group are cited. These groups can be substituted by an alkyl group represented by $R^1$ and $R^2$ and the same group as a substituent represented by the substituent for an alkyl group.

As alkenyl groups represented by $R^1$ and $R^2$, for example, a vinyl group and an aryl group are cited. These groups can be substituted by an alkyl group represented by $R^1$ and $R^2$ and the same group as a substituent represented by the substituent for an alkyl group.

As groups having an acid nucleus represented by $E_1$ in Formula I, for example, a group having a skeleton described in the 20th line of page 11 to 15th line of page 14 of Japanese Patent O.P.I. Publication and groups illustrated by the following formulas 1 to 4:

Formula 1

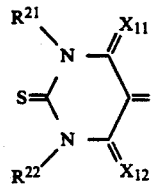

(wherein $R^{21}$ and $R^{22}$ are the same as $R^1$ and $R^2$ in the above-mentioned formula I. In addition, $X_{11}$ and $X_{12}$ are the same as $X_1$ and $X_2$ in Formula I.)

Formula 2

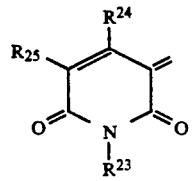

(wherein $R^{23}$ is the same as $R^1$ and $R^2$ in the above-mentioned formula I; $R^{24}$ and $R^{25}$ are the same as $R^8$ to $R^{10}$ in the abovementioned formula III.)

Formula 3

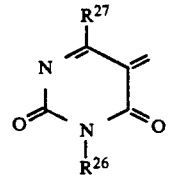

(wherein $R^{26}$ is the same as $R^1$ and $R^2$ in the above-mentioned formula I; $R^{27}$ is the same as $R^8$ to $R^1$ O in the above-mentioned formula III.)

Formula 4

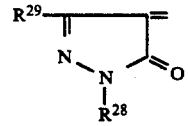

(wherein $R^{28}$ is the same as $R^1$ and $R^2$ in the above-mentioned formula I; $R^{29}$ represents an alkyl group, an aryl group, an alkenyl group, a heterocyclic group, a cyano group, $-COR^{30}$, $-CON(R^{30})(R^{31})$, $-OR^{30}$, $-SOR^{30}$, $-SO_2R^{30}$, $-SO_2N(R^{30})(R^{31})$, $-N(R^{30})COR^{31}$, $-N(R^{30})SO_2R^{31}$—$N(R^{30})CON(R^{31})(R^{32})$, $-SR^{30}$ and $-COOR^{30}$; $R^{30}$ to $R^{32}$ are the same as $R^{11}$ to $R^{13}$ in the abovementioned formula III.)

As above-mentioned alkyl group, alkenyl group, aryl group and heterocyclic group, the same group as those illustrated in $R^1$ and $R^2$ are cited.

In the above-mentioned explanation, the groups having an acid nucleus represented by $E_1$ was illustrated in the form of keto type. However, it is chemically apparent that they can take form of enol by means of tautomerism.

As 5-membered or 6-membered heterocycles formed in $Q_1$ in Formula II, heterocycles described in pp.23 to 26 in Japanese Patent O.P.I. Publication No. 282832/1986 and heterocycles represented by Formula 5

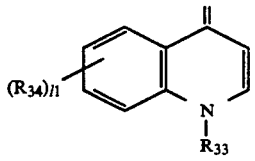

(wherein $R^{33}$ represents the same as $R^1$ and $R^2$ in the above-mentioned Formula I; $R^{34}$ are the same as $R^8$ to $R^{10}$ in the above-mentioned Formula III; $l_1$ represents 0 to 3 integers.)

The following are practical examples of compounds illustrated by Formulas I to V.

I-1

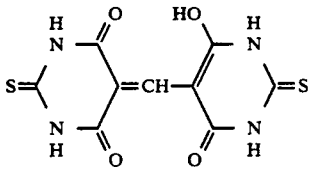

I-2

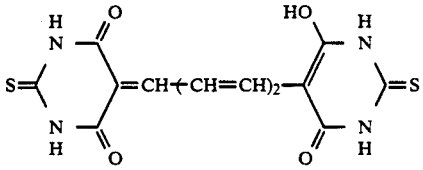

I-3

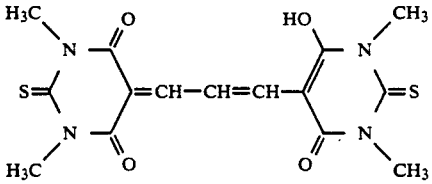

I-4

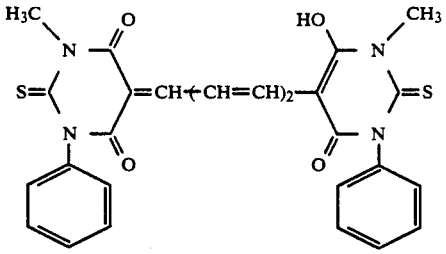

I-5

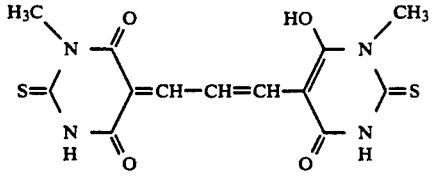

I-6

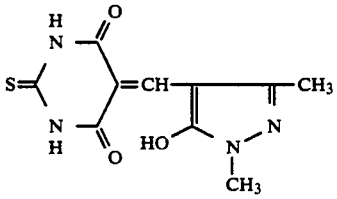

-continued

I-7

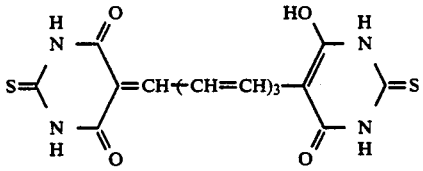

I-8

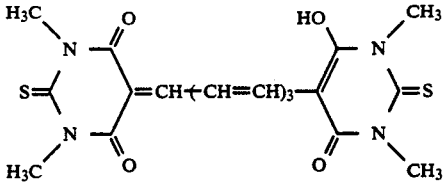

I-9

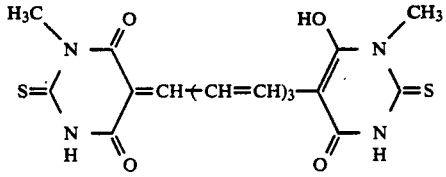

I-10

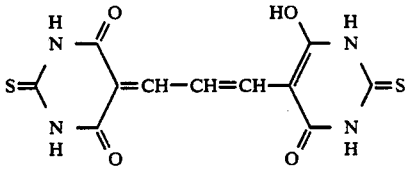

I-11

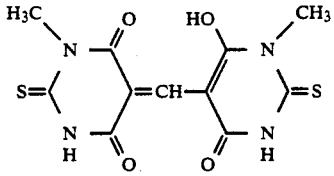

I-12

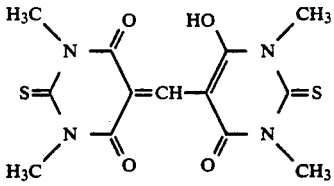

I-13

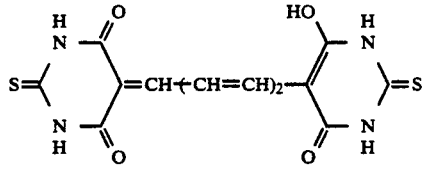

I-14

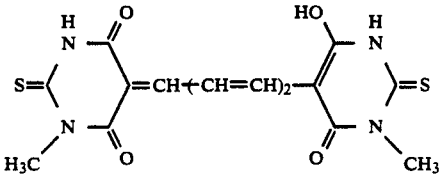

-continued
I-15
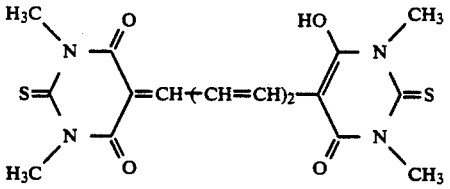
I-16
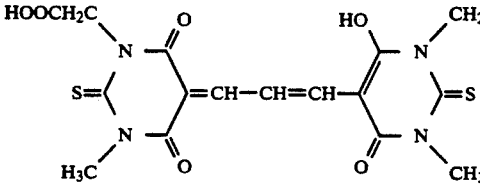
I-17
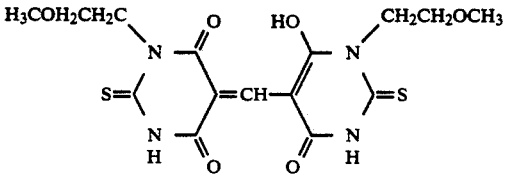
II-1
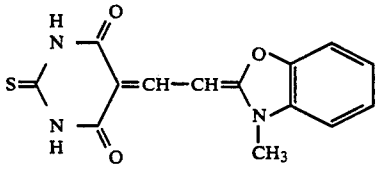
II-2
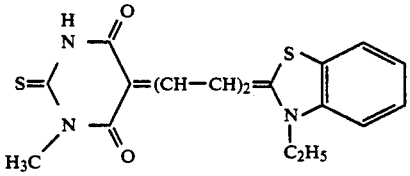
II-3
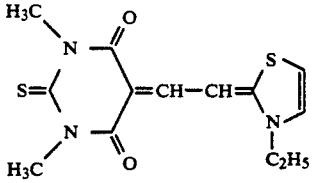
II-4
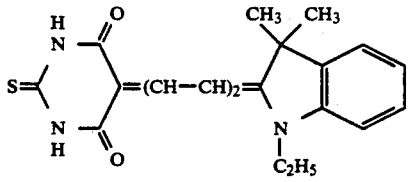
II-5
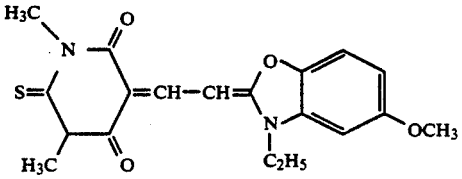
-continued
III-1
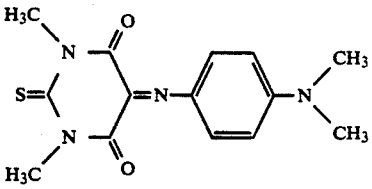
III-2
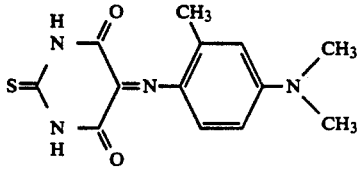
III-3
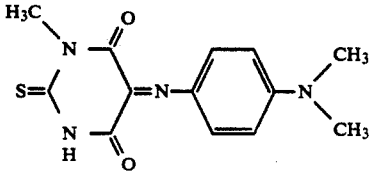
III-4
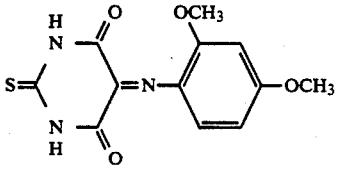
III-5
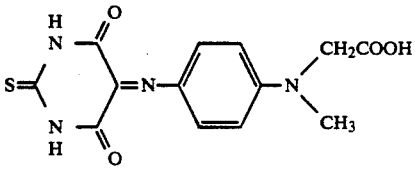
III-6
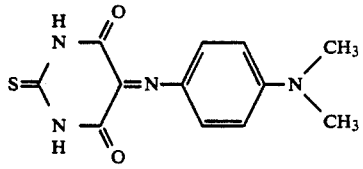
III-7
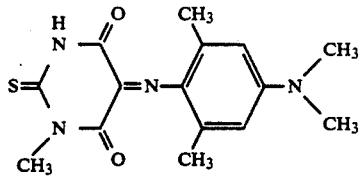
IV-1
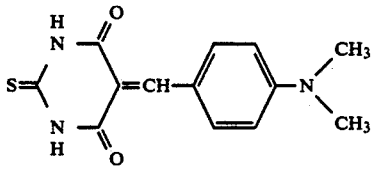
IV-2
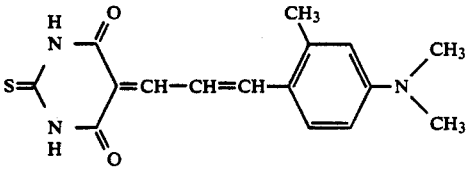

-continued

IV-3

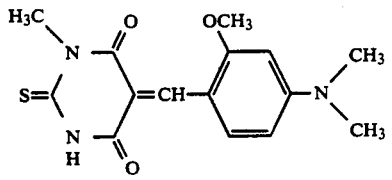

IV-4

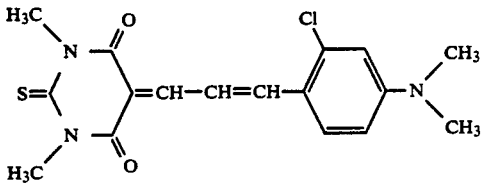

IV-5

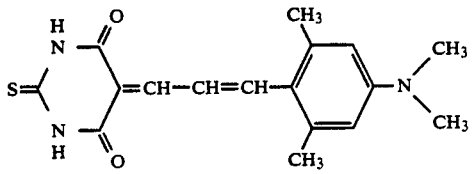

IV-6

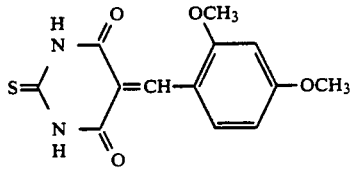

V-1

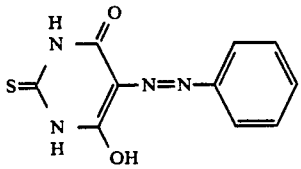

V-2

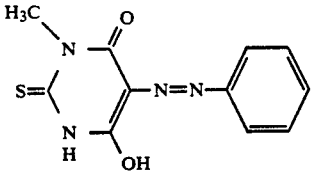

V-3

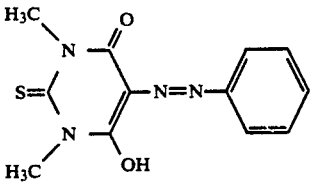

V-4

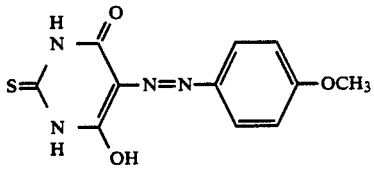

-continued

V-5

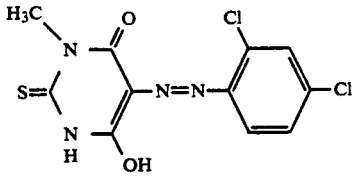

In addition, as dyes used in the present invention, dyes illustrated in the following formulas I' to V' may be cited.

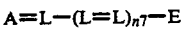

Formula I'

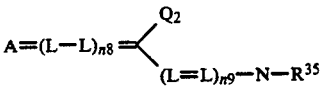

Formula II'

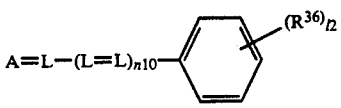

Formula III'

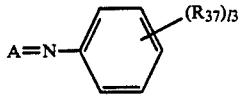

Formula IV'

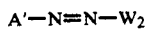

Formula V'

(In formulas I' to V', $R^{35}$ represents an alkyl group and an alkenyl group; $R^{36}$ and $R^{37}$ represent an alkyl group, an alkenyl group, an aryl group, a heterocyclic group, a halogen atom, a cyano group, a sulfo group, $—COR^{38}$, $—CON(R^{38})(R^{39})$, $—N(R^{38})(R^{39})$, $—OR^{38}$, $—SOR^{38}$, $—SO_2R^{38}$, $SO_2N(R^{38})(R^{39})$, $—N(R^{38})COR^{39}$, $—N(R^{38})SO_2R^{39}$, $—N(R^{38})CON(R^{39})(R^{40})$, $—SR^{38}$ and $—COOR^{38}$; $R^{38}$ to $R^{40}$ represent a hydrogen atom, an alkyl group, an alkenyl group, an aryl group and a heterocyclic group.

A represents a group represented by the following formulas $A_1$ to $A_4$; A' represents a group represented by the following formulas $A'_1$ to $A'_4$.

Formula $A_1$

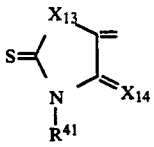

Formula $A_2$

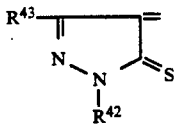

Formula $A_3$

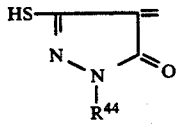

-continued

Formula $A_4$

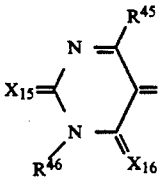

Formula $A'_1$

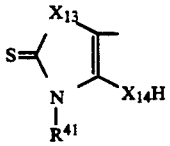

Formula $A'_2$

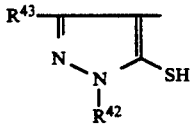

Formula $A'_3$

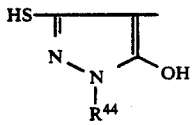

Formula $A'_4$

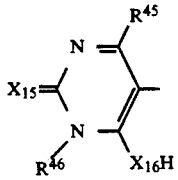

(In Formulas $A_1$ to $A_4$ and $A'_1$ to $A'_4$, $R^{41}$, $R^{42}$, $R^{44}$ and $R^{46}$ represent a hydrogen atom, an alkyl group, an alkenyl group, an aryl group and a heterocyclic group; $R^{43}$ represents an alkyl group, an alkenyl group, an aryl group, a heterocyclic group, a cyano group, $—COR^{47}$, $—CON(R^{47})(R^{48})$, $—N(R^{47})(R^{48})$, $—OR^{47}$, $—SOR^{47}$, $—SO_2R^{47}$, $—SO_2N(R^{47})(R^{48})$, $—N(R^{47})COR^{48}$, $—N(R^{47})SO_2R^{48}$, $—N(R^{47})CON(R^{48})(R^{49})$, $—SR^{47}$ and $—COOR^{47}$; $R^{47}$ to $R^{49}$ represent a hydrogen atom, an alkyl group, an alkenyl group, an aryl group and a heterocyclic group; $R^{45}$ is the same as $R^{36}$ and $R^{37}$; $X_{13}$ represents an oxygen atom, a sulfur atom, a selenium atom and $=N—R^{50}$. $R^{50}$ is the Same as $R^{41}$. $X_{14}$, $X_{15}$ and $X_{16}$ represents an oxygen atom and a sulfur atom.)

L represents a methine group, and E represents a group having an acid nucleus. Q represents an non-metallic atoms necessary for forming a heterocycle. $W_2$ represents an aryl group and a heterocyclic group. $n_7$ and $n_8$ represent 0 to 3 integers. $n_9$ and $n_{10}$ represent 0 to 2 integers. $l_2$ and $l_3$ represents 0 to 3 integers.

We will explain compounds illustrated by Formulas I' to V'.

As alkyl groups represented by the above-mentioned $R^{35}$ to $R^{50}$, for example, a methyl group, an ethyl group, a propyl group, an isopropyl group, an n-butyl group, a tert-butyl group, a cyclopentyl group and a cyclohexyl group are cited. The above-mentioned alkyl group may be substituted by a hydroxy group, a cyano group, a sulfo group, a carboxy group, a halogen atom (for example, a fluorine atom, a chlorine atom and a bromine atom), an alkoxy group (for example, a methoxy group and an ethoxy group), an aryloxy group (for example, a phenoxy group, a 4-sulfophenoxy group, a 2,4-disulfophenoxy group), an aryl group (for example, a phenyl group, a 4-sulfophenyl group, a 2,5-disulfophenyl group) and an alkoxycarbonyl group (for example, a methoxycarbonyl group).

As aryl group represented by $R^{36}$ to $R^{50}$ and $W_2$, for example, a phenyl group and a naphthyl group are cited. These groups can be can be substituted by alkyl groups represented by $R^{35}$ to $R^{50}$ and the same group as substituents represented by the substituents of alkyl groups.

As heterocyclic group represented by $R^{36}$ to $R^{50}$ and $W_2$, for example, a pyridyl group, a thiazolyl group, an oxazolyl group, an imidazolyl group, a furyl group, a pyrrolyl group, a pyrazinyl group, a pyrimidyl group, a pyridazinyl group, a purynyl group, a selenazolyl group, a sulforanyl group, a piperidinyl group, a pyrazolyl group and a tetrazolyl group are cited. These groups can be substituted by alkyl groups represented by $R^{35}$ to $R^{50}$ and the same groups as substituents represented by substituents of alkyl groups.

As alkenyl group represented by $R^{35}$ to $R^{50}$, for example, a vinyl group and an aryl group can be cited. These groups can be substituted by alkyl groups represented by $R^{35}$ to $R^{50}$ and the same groups as substituents represented by substituents of alkyl groups.

As groups having an acid nucleus illustrated by E in Formula I', for example, groups having skeleton described in 20th line on page 11 to 15th line on page 14 of Japanese Patent O.P.I. Publication No. 281235/1986, groups having nucleus illustrated in Formulas $A'_1$ to A'4 and groups represented by the following formulas Nos. 6 to 8.

Formula 6

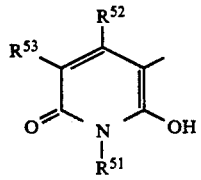

(wherein $R^{51}$ and $R^{41}$ are the same; $R^{52}$ and $R^{53}$ represent a hydrogen atom and a group illustrated by $R^{36}$ precedingly.)

Formula 7

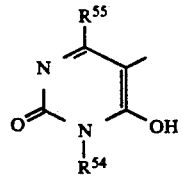

(wherein $R^{54}$ is the same as $R^{41}$; $R^{55}$ represents a hydrogen atom and a group illustrated by $R^{36}$.)

Formula 8

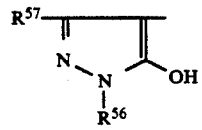

(wherein $R^{56}$ is the same as $R^{42}$; $R^{57}$ is the same as $R^{43}$.)

As heterocycles formed by $Q_2$ in Formula II', for example, heterocycles described in pp. 23 to 26 of Japanese Patent O.P.I. Publication No. 282832/1986 and a heterocycle represented by Formula 9
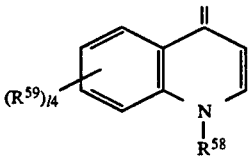
(wherein $R^{58}$ is the same as $R^{41}$; $R^{59}$ is the same as $R^{36}$; $l_4$ is an integer of 0 to 3.).
Hereunder, we will show practical examples of compounds represented by Formulas I' to V'.
I'-1
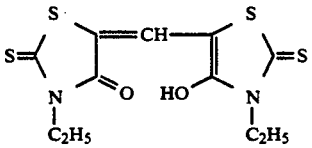
I'-2
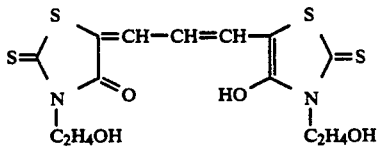
I'-3
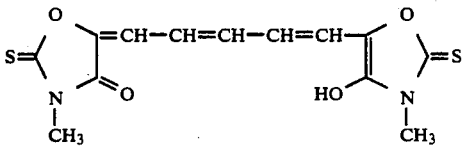
I'-4
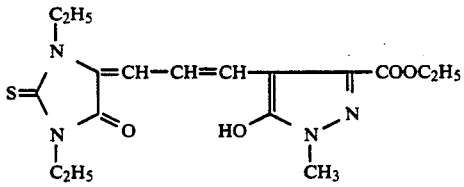
I'-5
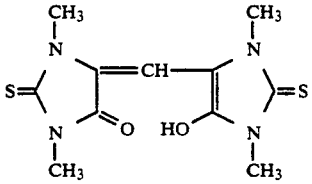
I'-6
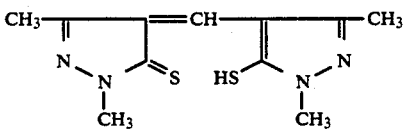
I'-7
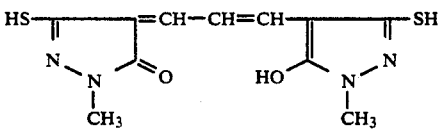
I'-8
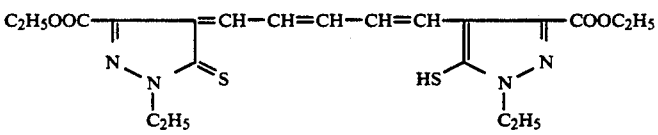
I'-9
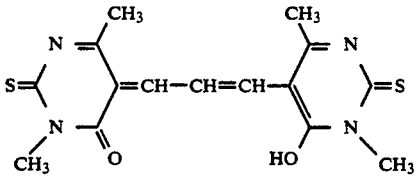
I'-10
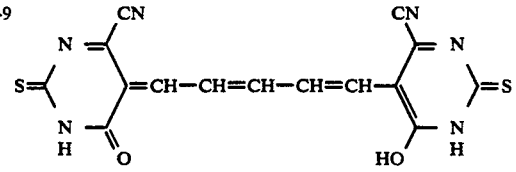
I'-11
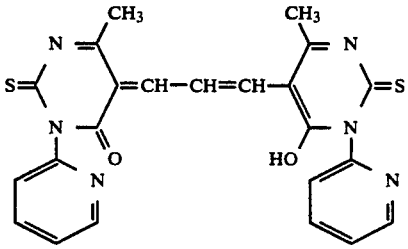
I'-12
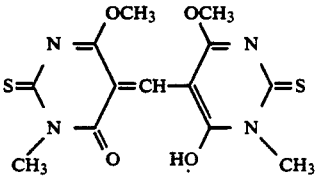

-continued
II'-1
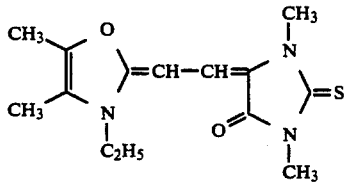
II'-2
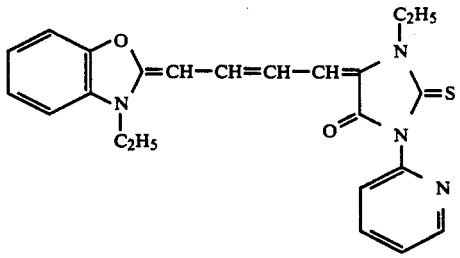
II'-3
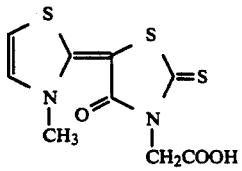
II'-4
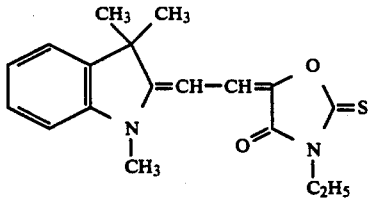
II'-5
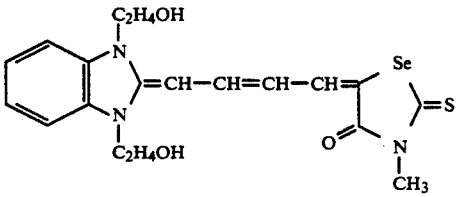
II'-6
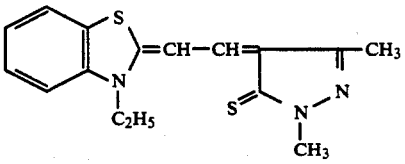
II'-7
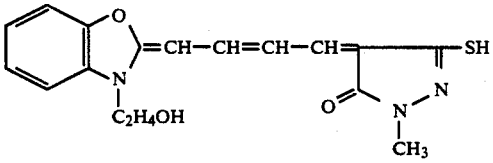
II'-8
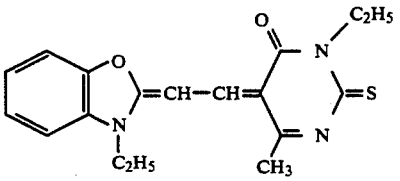
II'-9
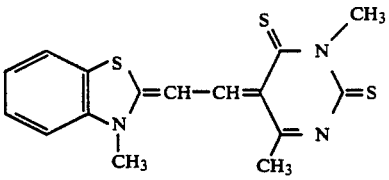
III'-1
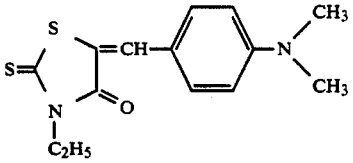
III'-2
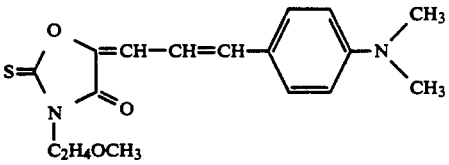
III'-3
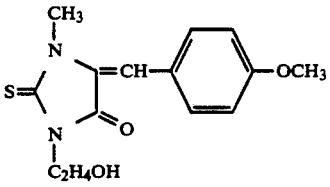
III'-4
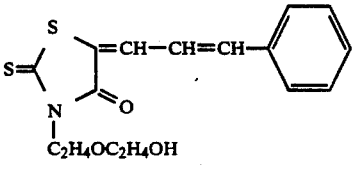
III'-5
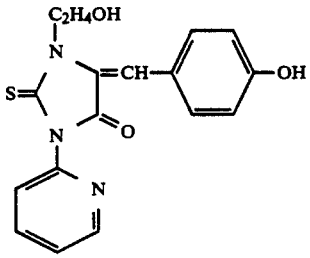

-continued
III'-6
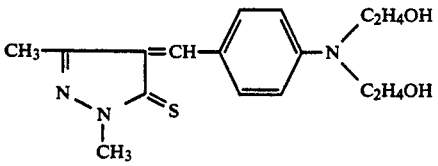
III'-7
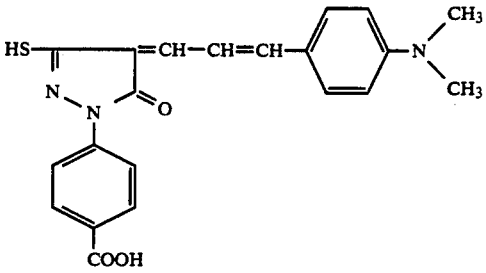
III'-8
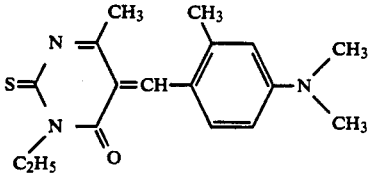
III'-9
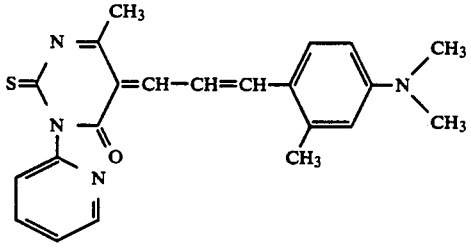
IV'-1
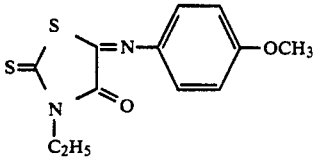
IV'-2
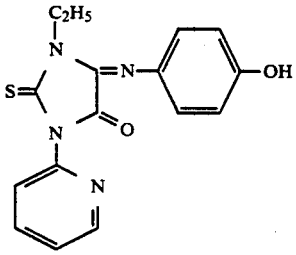
IV'-3
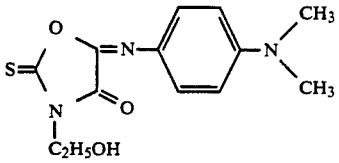
IV'-4
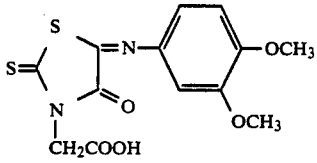
IV'-5
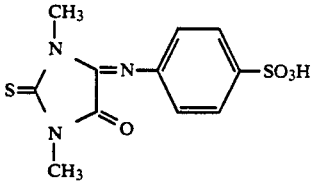
IV'-6
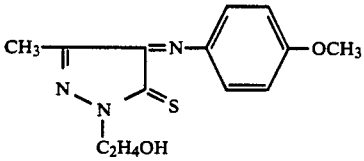
IV'-7
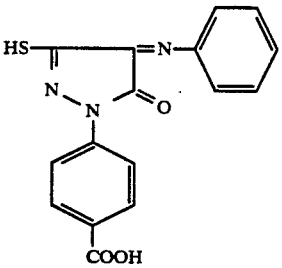
IV'-8
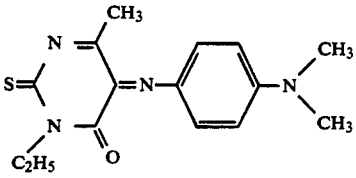
IV'-9
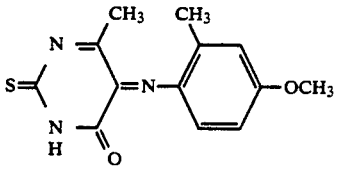
V'-1
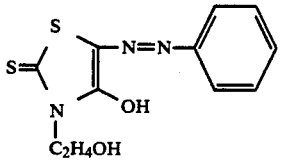

-continued

V'-2

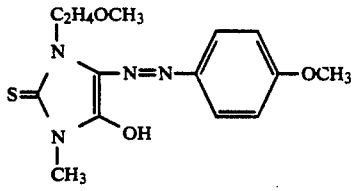

V'-3

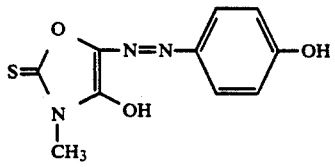

V'-4

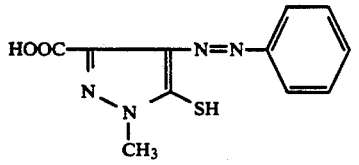

V'-5

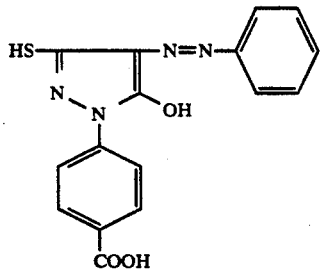

V'-6

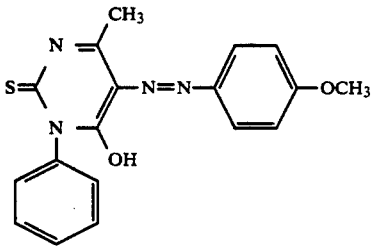

In addition, as dyes used in the present invention, dyes represented by the following formula VI (hereunder, referred to as methine compound) are cited;

$$(\text{Dye})_{l5}[-[(\text{J})_{ml-Sal}]_{n11} \qquad \text{Formula VI}$$

(wherein Dye represents atom group having a methine dye structure; J represents a divalent combination group with an atom or atoms selected from a carbon atom, a nitrogen atom, an oxygen atom and a sulfur atom as a structure; Sal represents a group forming a sparingly soluble salt with a silver ion; l5 represents 1 or 2; $m_l$ represents 0 or 1; $n_{11}$ represents 1, 2, 3 or 4.)

In Formula VI, groups illustrated by Dye represents atom group having a methine dye structure. They are, for example, group having a dye structure wherein a methine chain such as a cyanine chain, a merocyanine chain, a merostyryl chain, a stylyl chain, an oxonol chain and a triarylmethane chain are subjected to conjugate double bond. As practical examples of the above-mentioned dyes, cyanine dyes described in Japanese Patent O.P.I. Publication No. 202665/1988 and Russian Patent No. 653,257, merocyanine dyes described in Japanese Patent O.P.I. Publication Nos. 29727/1977, 60825/1977, 135335/1977, 27146/1981, 29226/1981, 10944/1984, 15934/1984, 111847/1984 and 34539/1988 and U.S. Pat. Nos. 2,944,896 and 3,148,187, merostyl dyes described in Japanese Patent O.P.I. Publication Nos. 211041/1984, 211042/1984, 135936/1985, 135937/1985, 204630/1986, 205934/1986, 569/1987, 70830/1987, 92949/1987 and 185758/1987, oxonol dyes described in Japanese Patent O.P.I Publication Nos. 145125/1975, 33103/1980, 120660/1980, 161233/1980, 185755/1987, 139949/1988, 231445/1988 and 264745/1988, U.S. Pat. No. 4,187,275, British Patent No. 1,521,083 and Belgium Patent No. 859,677 and triarylmethane dyes described in Japanese Patent O.P.I. Publication Nos. 55437/1984 and 228250/1984, U.S. Pat. Nos. 4,115,126 and 4,359,574 are cited. In addition, dyes are selected from publications such as *Theory of Photographic Process* published by MaCmillan Co., Ltd. in 1977 edited by T. H. James, *Heterocyclic compounds Cyanine dyes and Related compounds* published by John Wiley & Sons (New York London) in 1964 written by F. M. Harmer, *The Chemistry of Heterocyclic Compounds* published in 1977 written by D. M. Sturmer and edited by A. Weissberger and E. C. Taylor and *The Chemistry of Synthetic Dyes* Vol. II published in 1952 and Vol. IV published in 1971 by Academic Press (New York London).

J represents a divalent combination group with an atom or atoms selected from a carbon atom, a nitrogen atom, an oxygen atom and a sulfur atom as a skeleton. The preferable groups are divalent combination groups having 20 or less carbons composed of one of or in combination of an alkylene group (for example, a methylene group, an ethylene group, a propyrene group and a pentylene group), an allylene group (for example, a phenylene group), an alkenylene group (for example, an ethylene group and a propenylene group), a sulfonyl group, a sulfinyl group, an ether group, a thioether group, a carbonyl group and —N($R^{60}$)— group ($R^{60}$ represents a hydrogen atom, a substituted or unsubstituted alkyl group and a substituted or unsubstituted aryl group). They may have a substituent. As substituents, conventional ones are cited including a halogen atom (for example, a fluorine atom, a chlorine atom and a bromine atom), an alkyl group (for example, a methyl group, an ethyl group, an isopropyl group and a butyl group), an aralkyl group (for example, a benzyl group and a phenethyl group), an alkoxy group (for example, a methoxy group and an ethoxy group), an alkoxycarbonyl group (for example, an ethoxycarbonyl group), an alkylthio group, a hydroxy group, a carboxy group, a sulfo group, a sulfonyl group (for example, a methanesulfonyl group and p-toluenesulfonyl group), a carbamoyl group (for example, N-methylcarbamoyl group and a monopholynocarbonylamino group), an acyl group (for example, an acetyl group and a benzoyl group), an acylamide group (for example, an acetoamide group), a sulfonamido group (for example, a methanesulfonamide group and a butanesulfonamide group), a cyano group, an amino group (for example, an ethylamino group and adimethylamino group) and an ureido group.

$l_5$ represents 1 or 2; mrepresents 0 or 1; $n_{11}$ represents 1, 2, 3 or 4. Sal represents a group forming sparingly soluble salt with a silver ion including a mercapto group, an acetylene group, a thiocarbonyl group, a thioamide group, a thiourethane group, a thioureido group (for example, a 3-ethylthioureido group and a 3-phenylthioureido group) and saturated or unsaturated 5-membered to 7-membered heterocyclic residues containing at least 1 nitrogen atom inside the ring. As preferable group, groups illustrated by Formulas VIII and IX described in Japanese Patent O.P.I. Publication No. 97937/1990 and groups illustrated by Formulas II to VI described in Japanese Patent O.P.I Publication No. 225476/1990 are cited.

Next, practical examples of methine compounds in the present invention are shown.

VI-1
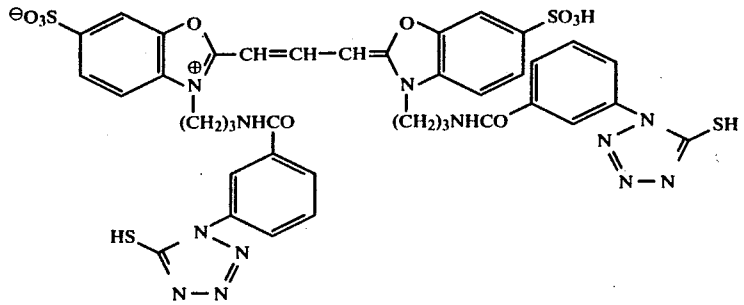
VI-2
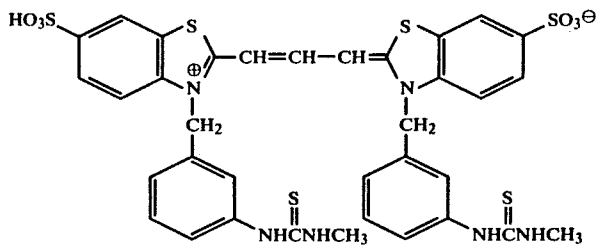
VI-3
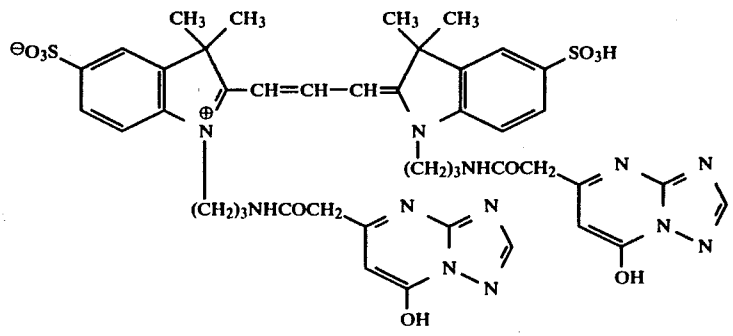

-continued
VI-4
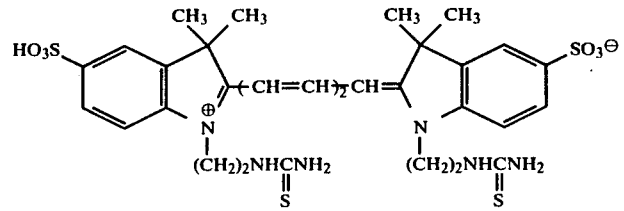
VI-5
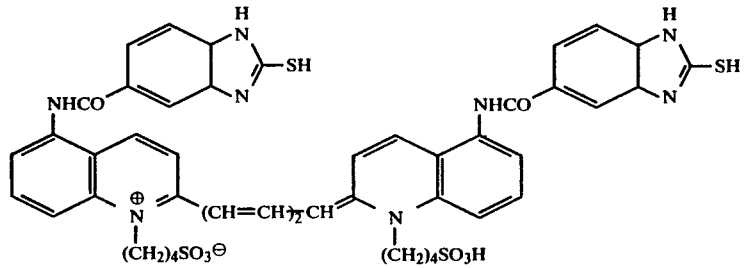
VI-6
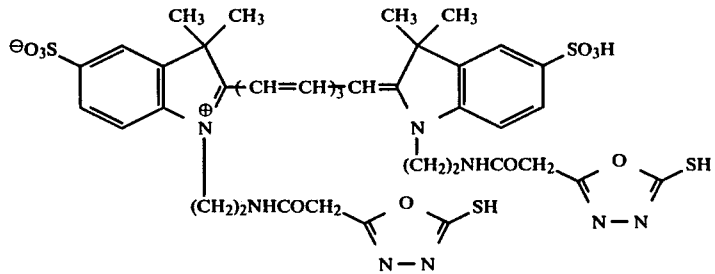
VI-7
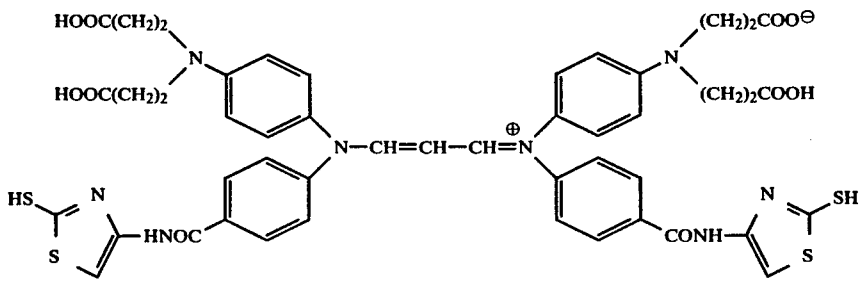

-continued
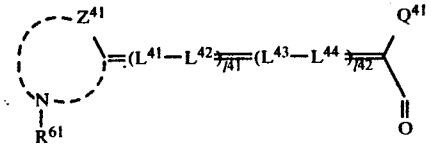
| No. | 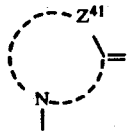 | $R^{61}$ | $(L^{41}-L^{42})_{l41}$ | $(L^{43}-L^{44})_{l42}$ | 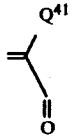 |
|---|---|---|---|---|---|
| VI-8 | 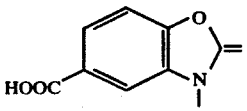 | 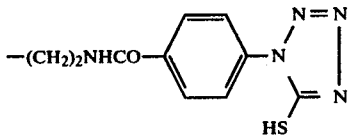 | =CH—CH= | — | 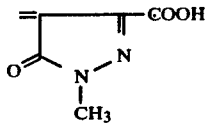 |
| VI-9 | 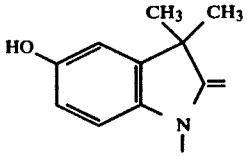 | 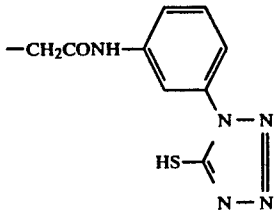 | =CH—CH= | — | 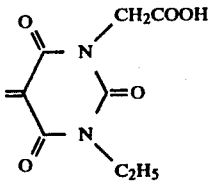 |
| VI-10 | 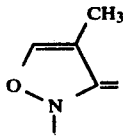 | 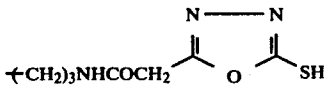 | =CH—CH= | — | 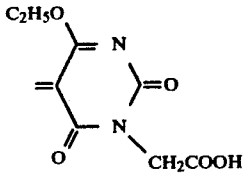 |
| VI-11 | 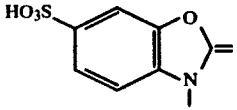 | 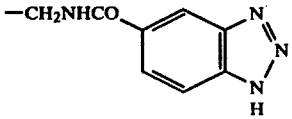 | =CH—CH= | =CH—CH= | 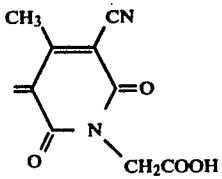 |

-continued
| | | | | | |
|---|---|---|---|---|---|
| VI-12 | 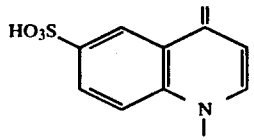 | $-(CH_2)_2NHCSNHCH_3$ | $=CH-CH=$ | $=CH-CH=$ | 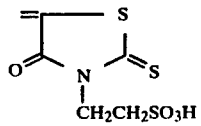 |
| VI-13 | 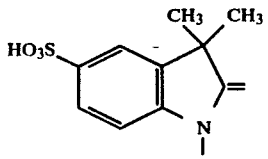 | 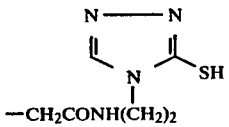 | $=CH-CH=$ | $=CH-CH=$ | 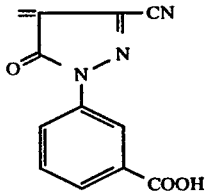 |
| VI-14 | 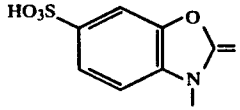 | $-C_2H_5$ | $=C(CH_3)-CH=$ | — | 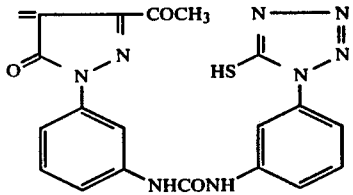 |
| VI-15 | 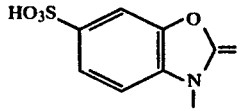 | $-C_2H_5$ | $=CH-C(CH_3)=$ | — | 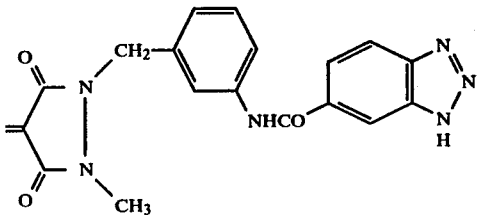 |
| VI-16 | 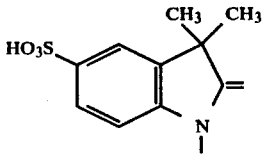 | $\leftarrow CH_2)_4SO_3H$ | $=CH-CH=$ | $=CH-C(CH_3)=$ | 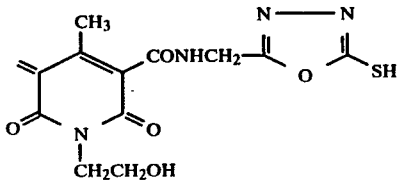 |

-continued
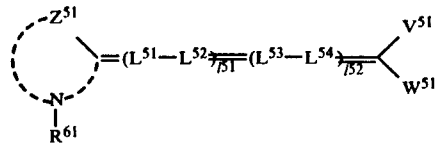
| No. | 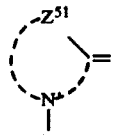 | $R^{61}$ | $V^{51}$ | $W^{51}$ | $(L^{51}-L^{52})_{l51}$ | $(L^{53}-L^{54})_{l52}$ |
|---|---|---|---|---|---|---|
| VI-17 | 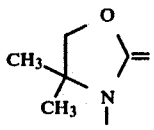 | $-C_2H_4COOH$ | $-CN$ | 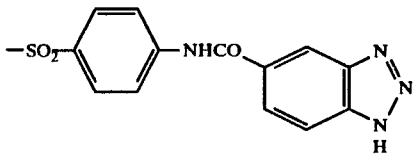 | $=CH-CH=$ | — |
| VI-18 | 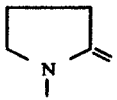 | $-C_2H_5$ | $-CN$ | 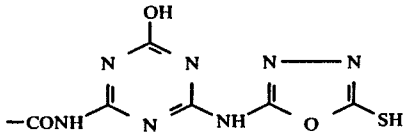 | $=CH-CH=$ | — |
| VI-19 | 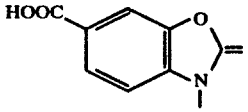 | 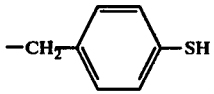 | $-CN$ | $-COO(CH_2CH_2O)_3CH_3$ | $=CH-CH=$ | $=CH-CH=$ |
| VI-20 | 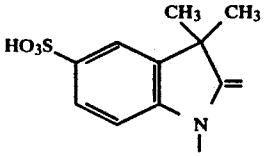 | 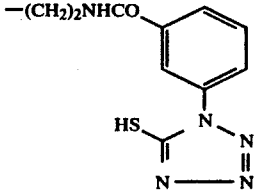 | $-COCH_3$ | $-CONH(CH_2CH_2O)_3CH_3$ | $=CH-CH=$ | $=CH-CH=$ |

-continued
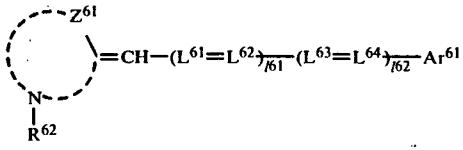
| No. | 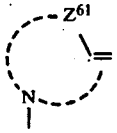 | $R^{62}$ | $Ar^{61}$ | $(L^{61}=L^{62})_{l61}$ | $(L^{63}=L^{64})_{l62}$ |
|---|---|---|---|---|---|
| VI-21 | 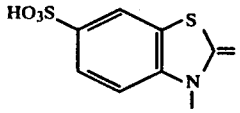 | 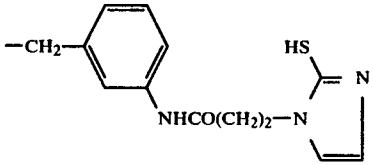 | 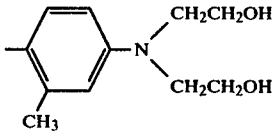 | —CH=CH— | — |
| VI-22 | 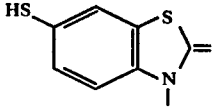 | $-CH_2COOH$ | 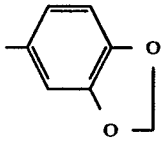 | —CH=CH— | — |
| VI-23 | 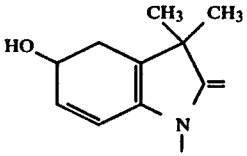 | 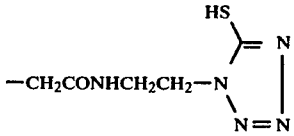 | 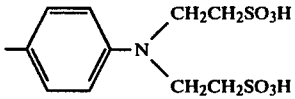 | —CH=CH— | — |
| VI-24 | 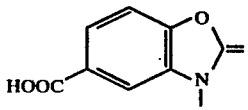 | 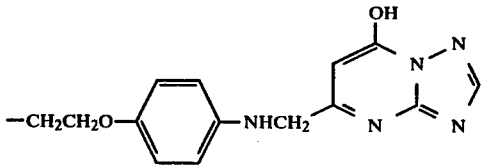 | 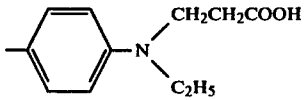 | —CH=CH— | —CH=CH— |

-continued
| No. | $E^{71}$ | $E^{71}{=}L^{71}{-}(L^{72}{=}L^{73})_{m1}{-}Ar^{71}$ | $={L^{71}}{-}(L^{72}{=}L^{73})_{m1}{-}$ |
|---|---|---|---|
| VI-25 | 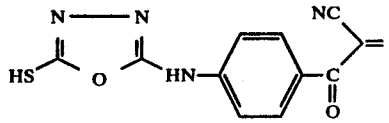 | 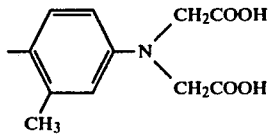 | =CH— |
| VI-26 | 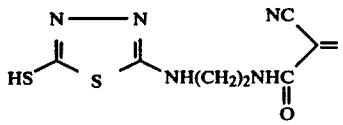 | 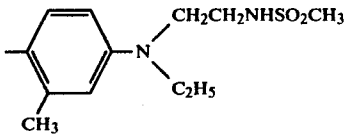 | =CH— |
| VI-27 | 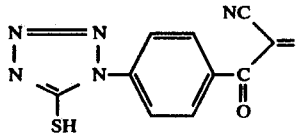 | 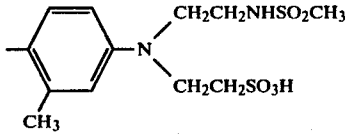 | =CH— |
| VI-28 | 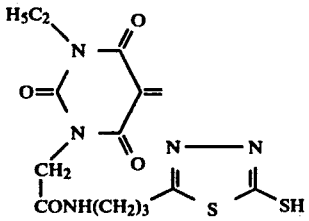 | 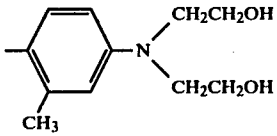 | =CH— |
| VI-29 | 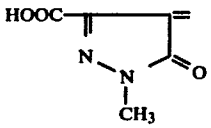 | 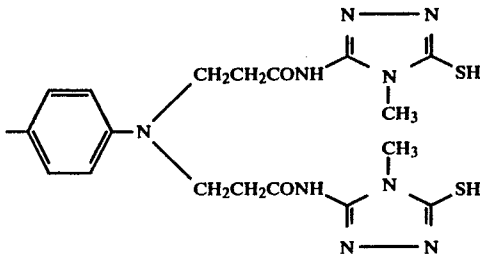 | =CH—CH=CH— |

-continued
| No. | $Q^{81}$ | $Q^{82}$ | $L^{81}-L^{82}\underset{/81}{=}(L^{83}-L^{84})\underset{/82}{L^{85}}-$ |
|---|---|---|---|
| VI-30 | 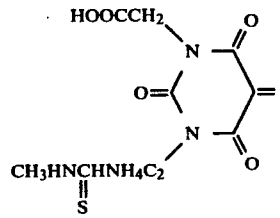 | 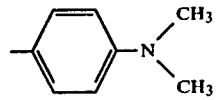 | =CH—CH=CH— |
| VI-31 | 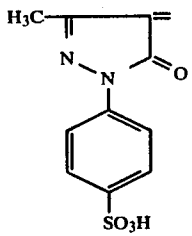 | 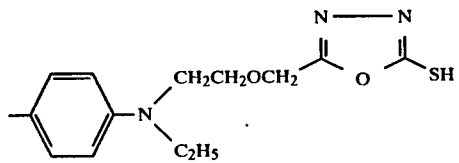 | =CH— |
| VI-32 | 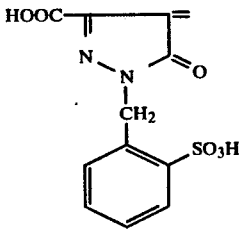 | 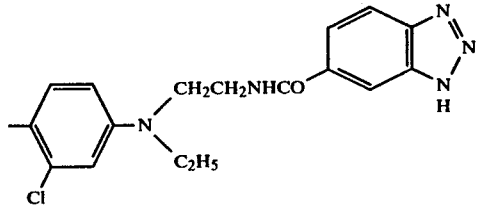 | =CH— |
| VI-33 | 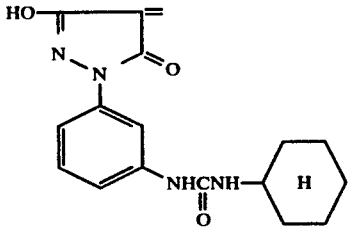 | 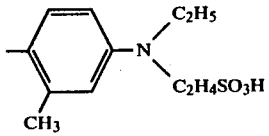 | =CH— |

-continued
| | | | |
|---|---|---|---|
| VI-34 | 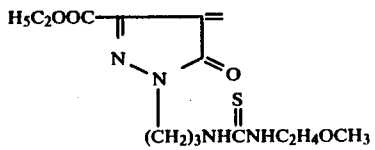 | 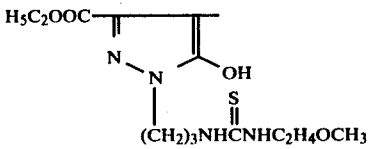 | =CH—CH=CH— |
| VI-35 | 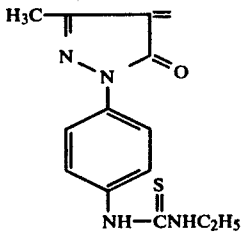 | 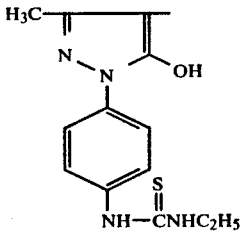 | =CH— |
| VI-36 | 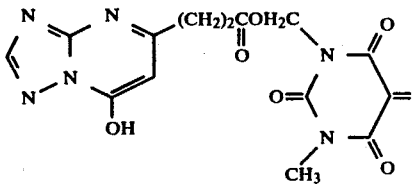 | 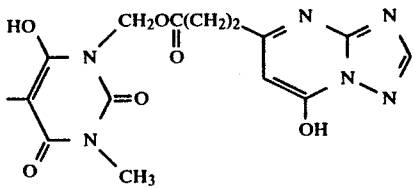 | =CH—CH=CH—CH=CH— |
| VI-37 | 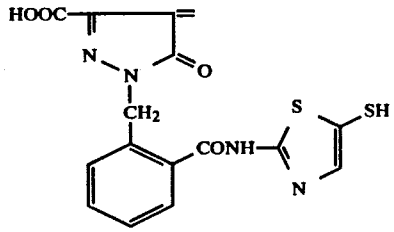 | 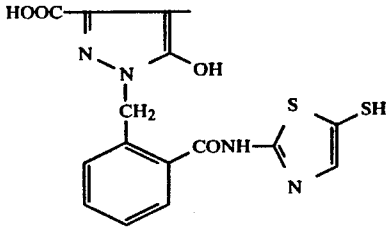 | =CH—CH=CH—CH=CH— |
| VI-38 | 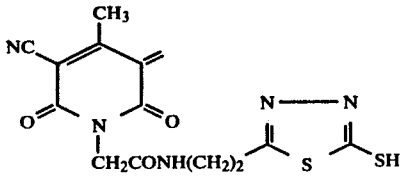 | 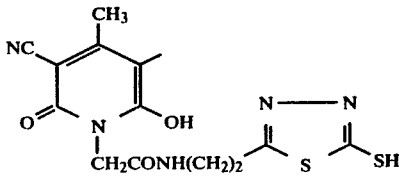 | =CH—CH=CH— |

-continued
| | | | |
|---|---|---|---|
| VI-39 | 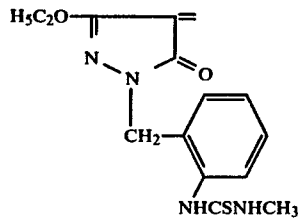 | 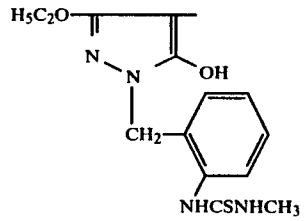 | =CH—CH=CH—CH=CH— |
| VI-40 | 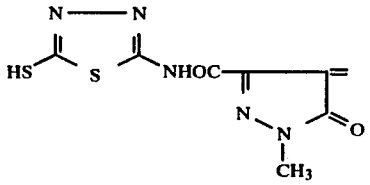 | 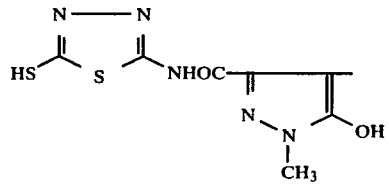 | =CH—CH=CH— |
| VI-41 | 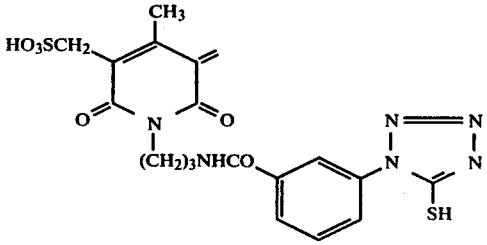 | 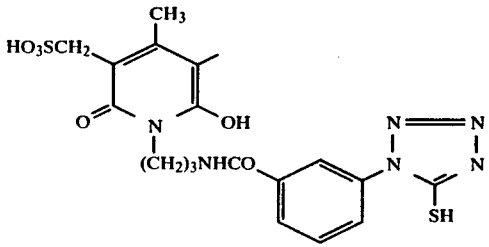 | =CH—CH=CH—CH=CH— |
| VI-42 | 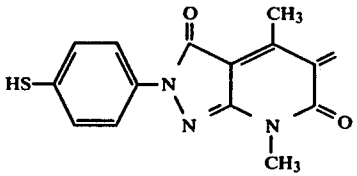 | 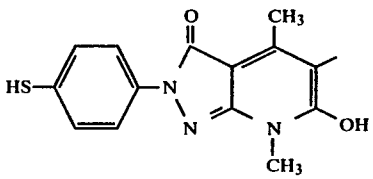 | =CH—CH=CH— |

-continued
| | | | |
|---|---|---|---|
| VI-43 | 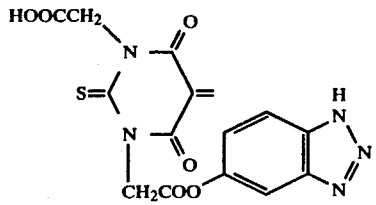 | 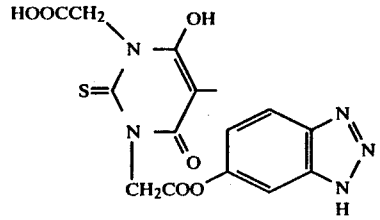 | =CH—CH=CH— |
| VI-44 | 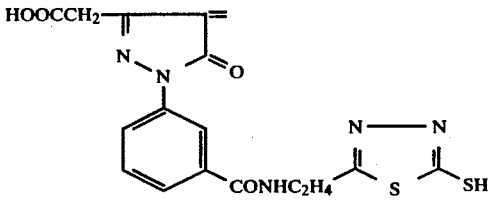 | 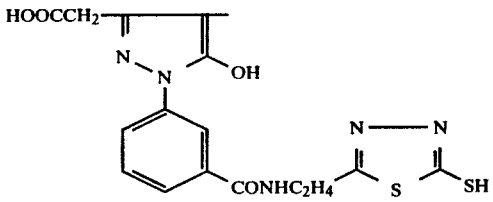 | =CH— |
| VI-45 | 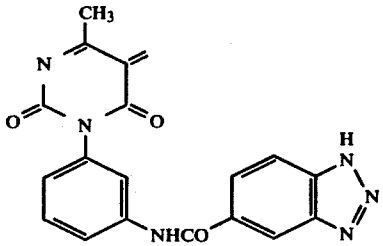 | 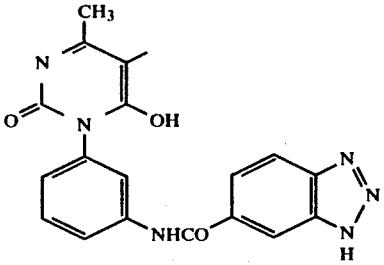 | =CH—CH=CH— |
| VI-46 | 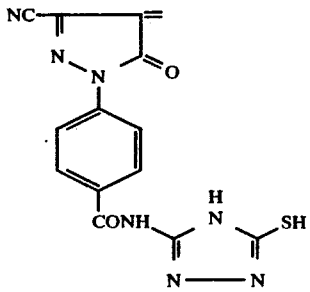 | 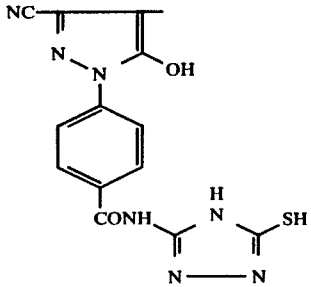 | =CH—CH=CH— |

-continued
VI-47
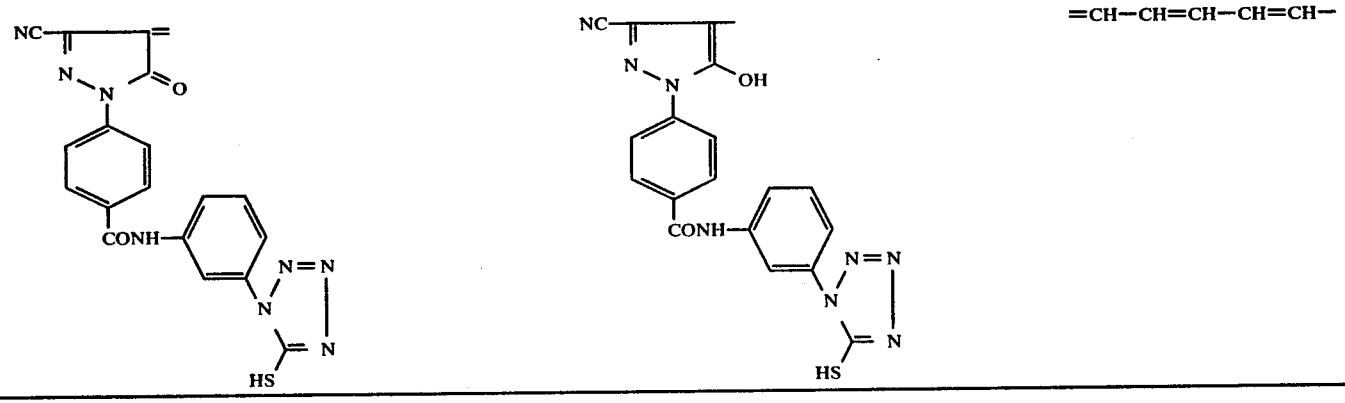
=CH—CH=CH—CH=CH—
VI-48
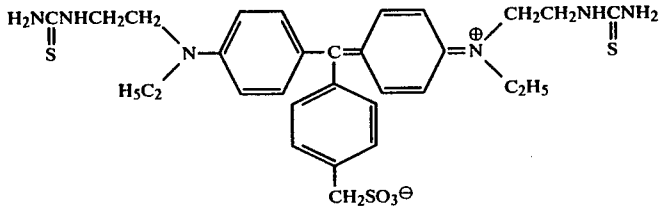
VI-49
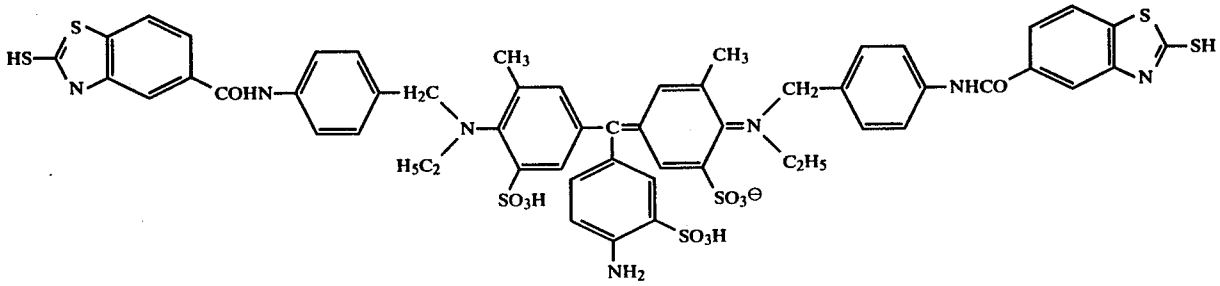

-continued
VI-50
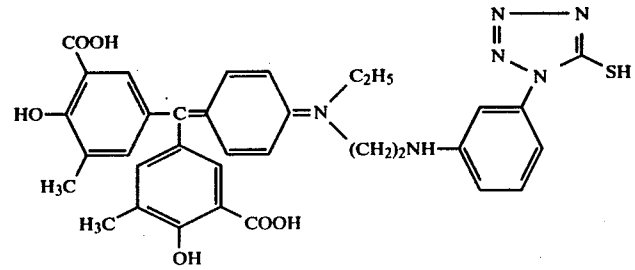
VI-51
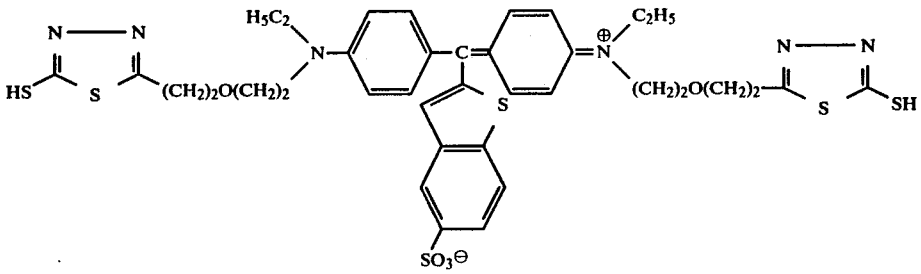
VI-52
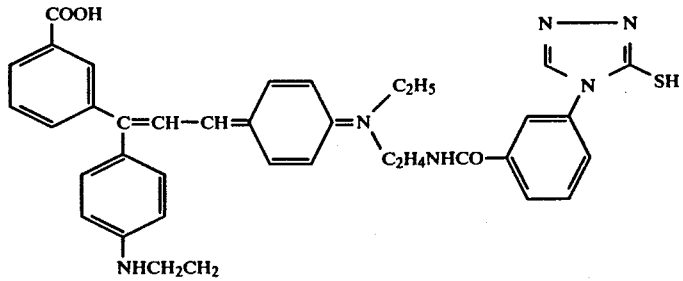

Methine compounds in the present invention can be synthesized by either a method to make a dye from intermediate raw materials wherein refractory silver salt forming group illustrated by Sal has been substituted in advance or a method to combine a methine dye structure portion illustrated by Dye and Sal portion. The above-mentioned methods can be selected optionally to synthesize. Various conventional binding reaction can be utilized for the introduction of Sal group. For example, addition reaction to unsaturated groups such as a vinyl group and a carbonyl group and substituted reaction between active hydrogen substituent such as an amino group and a hydroxy group and acid derivatives and halogen derivatives are employed. In conducting the above-mentioned reactions, many documents including *New Experimental Chemical* 14 "*Syntheses and Reactions of Organic Chemistry*" Volumes I to V edited by Japan Chemical Academy published by Maruzen (in 1962), *Organic Reactions* Volumes 1, 3 and 12 published by John Wiley & Sons (New York London), *The Chemistry of Functional Groups* published by John Wiley & Sons (New York London) and *Advanced Organic Chemistry* written by L. F. Fieser and M. Fieser published by Maruzen (in 1962).

The methine dyes in the present invention are reacted with soluble silver salt aqueous water to be sparingly soluble silver salts, which are dispersed and added into the silver halide photographic light-sensitive material.

Next, we will explain the yellow filter layer in the present invention.

When a silver salt of dye is contained in the yellow filter layer in the present invention, the adding amount of silver salt of dye is preferably 0.05 to 2.0 g/m$^2$ and more preferably 0.1 to 1.0 g/m$^2$. The adding amount of gelatin to the yellow filter layer is preferably 0.3 to 1.5 g/m$^2$ and more preferably 0.5 to 1.0 g/m$^2$.

In the present invention, the ratio between the adding amount of silver salt of dye contained in the yellow filter layer and the adding amount of gelatin (adding amount of silver salt of dye and adding amount of gelatin) is 0.1 or more, preferably 0.1 to 2.0 and more preferably 0.2 to 1.0.

In addition to silver salt of dyes, the yellow filter layer in the present invention may contain yellow colloidal silver, conventional yellow dyes and color mixture preventing agents may contain.

Next, we will explain the anti-halation in the present invention.

For the purpose of preventing the blurred image, namely halation, caused by re-entrance into the photographic emulsion layer of light which is scattered when it passes through or after it passes through the photographic emulsion layer and then is reflected on the interface between the emulsion layer and the support or on the surface of light-sensitive material of the rear side thereof, colored layers can be provided between the photographic emulsion layer and the support or on the surface of the support opposite to the photographic emulsion layer. These colored layers are called anti-halation layer. In the case of multi-layer color light-sensitive material, anti-halation layers may sometimes be provided between layers.

When silver salt of dyes are contained in the anti-halation layers in the present invention, the adding amount of silver salt of dye is preferably 0.05 to 2.0 g/m$^2$ and more preferably 0.1 to 1.0 g/m$^2$ The adding amount of gelatin in the anti-halation layer is preferably 0.3 to 1.5 g/m$^2$ and more preferably 0.5 to 1.0 g/m$^2$.

In the present invention, the ratio between the adding amount of silver salt of dye and the adding amount of gelatin both contained in the anti-halation layer is 0.1 or more, preferably 0.1 to 2.0 and more preferably 0.2 to 1.0.

In addition to silver salt of dye, the anti-halation layer in the present invention may contain black colloidal silver, conventional dyes, colored couplers and UV absorbers.

Next, we will explain benzoylacetoanilido type yellow couplers used in the present invention.

As benzoylacetoanilido type couplers used in the present invention, any benzoylacetoanilido derivatives can be used. However, the preferable ones are compounds represented by the following Formula YB-I.

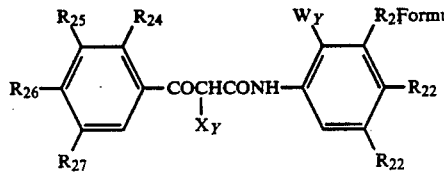

Formula YB-1 wherein $R_{21}$ to $R_{27}$ and $W_Y$ represent a hydrogen atom or a substituent; $R_{21}$, $R_{22}$ and $R_{23}$ may be the same or different and each of them preferably represents a hydrogen atom, a halogen atom, an alkyl group, an aryl group, an alkoxy group, an acylamino group, a carbamoyl group, an alkoxycarbonyl group, a sulfonamide group or a sulfamoyl group;

$R_{24}$, $R_{25}$, $R_{26}$ and $R_{27}$ contain the same and different. Each of them preferably represents a hydrogen atom, an alkyl group, an alkoxy group, an aryloxy group, an acylamino group or a sulfonamide group;

$W_Y$ preferably represents a halogen atom, an alkyl group, an alkoxy group, an aryloxy group or a dialkylamino group.

$X_Y$ represents a hydrogen atom or a group capable of being split off; as groups capable of being split off, for example, a halogen atom, an alkoxy group, an aryloxy group, an acyloxy group, an alkylthio group, an arylthio group, a heterocyclicthio group and saturated or unsaturated 5-membered or 6-membered nitrogen-containing heterocyclic group; particularly preferable groups are represented by Formula YB-II and YB-III;

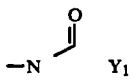

Formula YB-II $Y_1$ represents non-metallic atoms necessary for forming 5- to 6-membered ring; said non-metallic atoms contain those having a substituent;

—O—Ar

Formula YB-III

Ar represents an aryl group and said aryl groups containing a substituent.

Hereunder, we will cite practical examples of benzoylacetoanilido type yellow coupler. However, the present invention is not limited thereto.

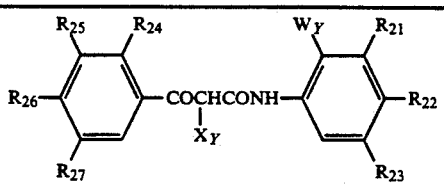

| Illustrated compound No. | $R_{21}$ | $R_{22}$ | $R_{23}$ | $R_{24}$ | $R_{25}$ | $R_{26}$ | $R_{27}$ | $W_Y$ | $X_Y$ |
|---|---|---|---|---|---|---|---|---|---|
| YB-1 | —H | —H | (7) | —H | —H | (4) | —H | (1) | (16) |
| YB-2 | —H | —H | (7) | —H | —H | (4) | —H | (1) | (17) |
| YB-3 | —H | —H | (8) | —H | —H | —H | —H | (1) | (18) |
| YB-4 | —H | —H | (8) | —H | —H | —H | —H | (4) | (19) |
| YB-5 | —H | —H | (6) | (2) | —H | —H | —H | (4) | (20) |
| YB-6 | —H | —H | (9) | —H | —H | (4) | —H | (1) | (21) |
| YB-7 | —H | —H | (11) | —H | (10) | (4) | —H | (4) | (22) |
| YB-8 | —H | —H | —H | —H | —H | —H | (7) | (4) | (23) |
| YB-9 | —H | —H | (12) | —H | —H | (4) | —H | (1) | (24) |
| YB-10 | —H | —H | (13) | —H | —H | —H | —H | (1) | (25) |
| YB-11 | —H | —H | (14) | —H | —H | (4) | —H | (1) | (26) |
| YB-12 | —H | —H | (15) | —H | —H | (4) | —H | (4) | (27) |
| YB-13 | —H | —H | —H | —H | —H | (4) | —H | (4) | —H |
| YB-14 | —H | —H | —H | —H | —H | (5) | —H | (1) | (28) |
| YB-15 | —H | —H | (6) | —H | —H | (4) | —H | (1) | (17) |
| YB-16 | —H | —H | (6) | —H | —H | (4) | —H | (1) | (29) |
| YB-17 | —H | —H | (7) | —H | —H | (4) | —H | (1) | (29) |
| YB-18 | —H | —H | —H | —H | —H | —H | (7) | (4) | —H |
| YB-19 | —H | —H | (30) | (31) | —H | —H | —H | (1) | —H |
| YB-20 | —H | —H | (11) | —H | —H | (32) | —H | (1) | (33) |
| YB-21 | —H | —H | (34) | —H | —H | (4) | —H | (1) | (35) |
| YB-22 | —H | (4) | (4) | —H | —H | (34) | —H | (1) | (36) |
| YB-23 | —H | —H | (37) | —H | —H | (4) | —H | (1) | (45) |
| YB-24 | —H | —H | (38 | —H | —H | (4) | —H | (1) | (45) |
| YB-25 | —H | —H | (6) | —H | —H | (39) | —H | (1) | (45) |
| YB-26 | —H | —H | (40) | —H | —H | (4) | —H | (1) | (45) |
| YB-27 | —H | —H | (37) | —H | —H | (4) | —H | (1) | (46) |
| YB-28 | —H | —H | (41) | —H | —H | (4) | —H | (1) | (47) |
| YB-29 | —H | —H | (6) | —H | —H | (4) | —H | (1) | (48) |
| YB-30 | —H | —H | (42) | —H | —H | (4) | —H | (1) | (49) |
| YB-31 | —H | —H | (37) | —H | —H | (4) | —H | (1) | (50) |
| YB-32 | —H | —H | (37) | —H | —H | (4) | —H | (1) | (51) |
| YB-33 | —H | —H | (6) | —H | —H | (4) | —H | (1) | (52) |
| YB-34 | (7) | —H | (43) | (1) | —H | —H | (1) | —H | (53) |
| YB-35 | (44) | —H | (6) | —H | —H | (4) | —H | (1) | (54) |
| YB-36 | —H | —H | (14) | —H | —H | (4) | —H | (1) | (55) |
| YB-37 | —H | —H | (57) | —H | —H | (4) | —H | (1) | (56) |
| YB-38 | —H | —H | (6) | —H | —H | (4) | —H | (1) | (58) |
| YB-39 | —H | —H | (37) | —H | —H | (4) | —H | (1) | (59) |

(1)
—Cl
(2)
$-CH_3$
(3)
$-C_{18}H_{37}$
(4)
$-OCH_3$
(5)
$-NHCOC_{17}H_{35}$
(6)
$-COOC_{12}H_{35}$
(7)

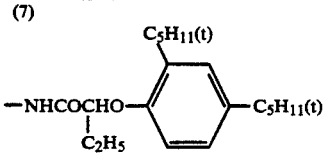

(8)
$-COOCHCOOC_{12}H_{25}$
$CH_3$ (9)

-continued $-NHCOCHCH_2SO_2C_{12}H_{25}$
$CH_3$ (10)

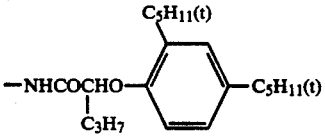

(11)

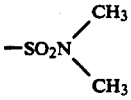

(12)

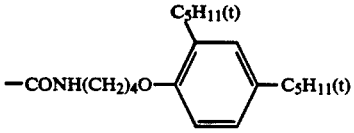

(13)
$-COOCHCH_2SO_2C_{12}H_{25}$
$CH_3$ (14)

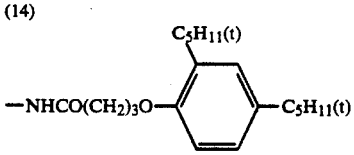

(15)

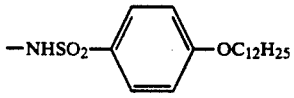

(16)

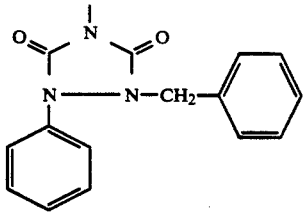

(17)

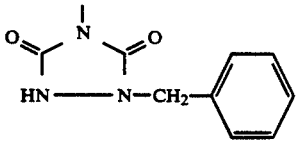

(18)

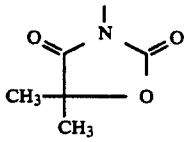

(19)

-continued
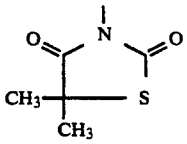
(20)
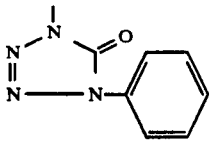
(21)
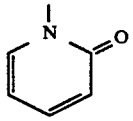
(22)
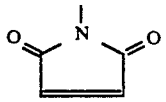
(23)
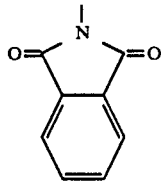
(24)
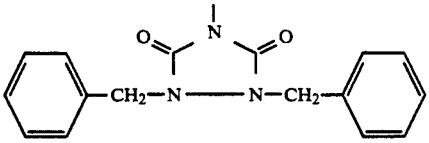
(25)
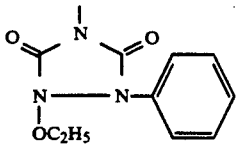
(26)
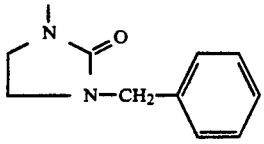
(27)
-continued
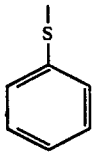
(28)
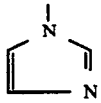
(29)
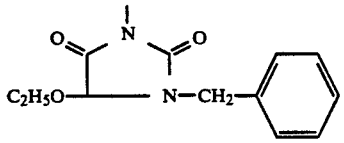
(30)
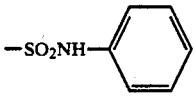
(31)
$-OC_{18}H_{37}$
(32)
$-OC_{16}H_{33}$
(33)
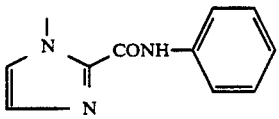
(34)
$-COOC_8H_{17}$
(35)
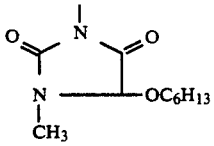
(36)
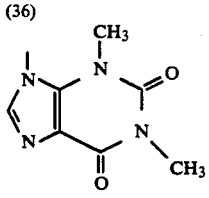
(37)
$-NHSO_2C_{16}H_{33}$
(38)
$-OSO_2C_{15}H_{33}$
(39)
$-OCHC_6H_{13}$
$CH_3$
(40)
$-OCH_2CHC_8H_{17}$
$C_6H_{13}$
(41)

-continued
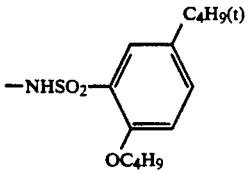
(42)
$-SO_2NHC_{16}H_{33}$
(43)
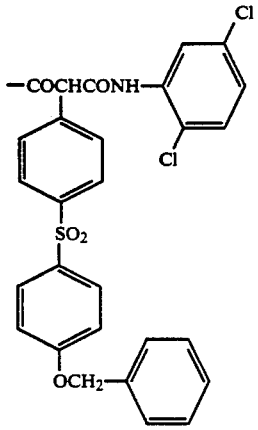
(44)
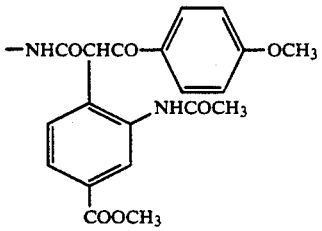
(45)
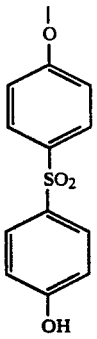
(46)
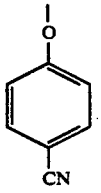
(47)
-continued
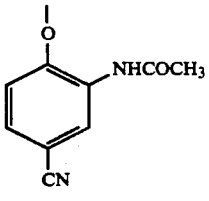
(48)
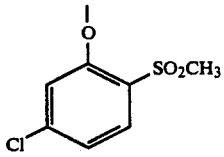
(49)
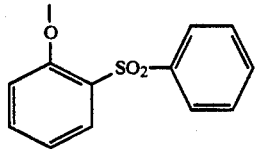
(50)
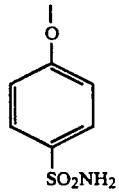
(51)
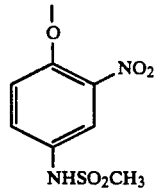
(52)
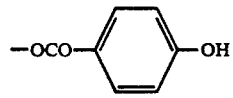
(53)
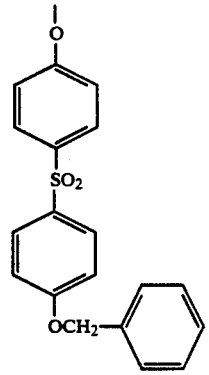

-continued (54)

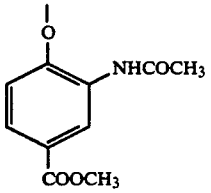

(55)

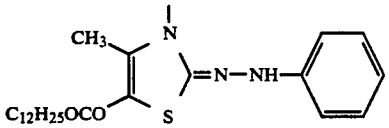

(56)

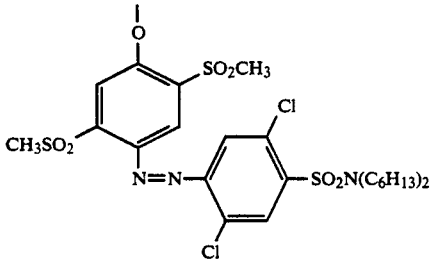

(57)
$-COOC_2H_5$
(58)

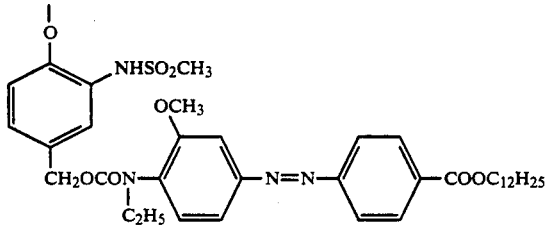

(59)

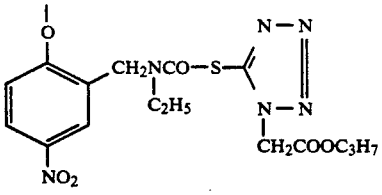

The above-mentioned benzoylacetoanilido type yellow couplers in the present invention contain those described in U.S. Pat. Nos. 2,875,057, 3,725,072 and 3,891,445 and Japanese Patent Publication No. 10783/1976 and Japanese Patent O.P.I. Publication Nos. 73147/1983, 6341/1975, 102636/1976, 115219/1977, 21448/1979, 95237/1981, 159163/1984, 174838/1984, 206835/1984, 187560/1989, 207748/1989, 207749/1989, 214848/1989, 227152/1989, 231050/1989, 295256/1989, 309057/1989, 314240/1989, 316744/1989 and 316745/1989. They are synthesized according to the methods described therein.

In the present invention, 2 or more benzoylacetoanilido type yellow couplers may be used in combination. In addition, they may be used in combination with other yellow couplers.

When a yellow coupler is added in a light-sensitive material, various methods such as an oil-in-water emulsification dispersion method employing water-unsoluble high boiling organic solvent, an alkali dispersion method wherein said yellow coupler is added as an alkali solution, a latex dispersion method and a solid dispersion method wherein said yellow coupler is finely solidified to be added directly may be used according to the physical property (for example, solubility) of said yellow coupler.

The adding amount of yellow coupler is $1.0\times10^{-3}$ mol to 1.0 mol, preferably $5.0\times10^{-3}$ mol to $8.0\times10^{-1}$ mol per mol of silver halide in total.

A benzoylacetoanilido type yellow coupler in the present invention is normally contained in the blue sensitive silver halide emulsion layer. However, if necessary, it may be contained in the green sensitive silver halide emulsion layer and the red sensitive silver halide emulsion layer other than the blue sensitive silver halide emulsion layer.

Next, we will explain cyan couplers represented by Formulas C-I or C-II.

Formula C-I

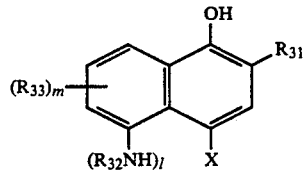

wherein $R_{31}$ represents $-CON(R_{34})(R_{35})$, $-NHCOR_{34}$, $-NHCOOR_{36}$, $-NHSO_2R_{36}$, $-NHCON(R_{34})(R_{35})$, $-SO_2N(R_{34})(R_{35})$ or $-NHSO_2N(R_{34})(R_{35})$; $R_{32}$ represents a hydrogen atom or a substituent; $R_{33}$ represents a substituent; X represents a hydrogen atom or a group split off by the reaction with an aromatic primary amine developer oxidation product; l represents 0 or 1; m represents 0 to 3 integers; $R_{34}$ and $R_{35}$ represent a hydrogen atom, an aromatic group, an aliphatic group or a heterocyclic group respectively; $R_{36}$ represents an aromatic group, an aliphatic group or a heterocyclic group; When m is 2 or 3, each of $R_{33}$ may be the same or different and they may be combined together to form a ring; In addition, $R_{34}$ and $R_{35}$, $R_{32}$ and $R_{33}$ and $R_{32}$ and X may bind each other to form rings; However, l is 0, m is 0 and $R_{31}$ is $-CONHR_{37}$; $R_{37}$ represents an aromatic group; Each group represented by the above-mentioned $R_{32}$ to $R_{37}$ contain those having a substituent.

Hereunder, we will explain the compounds represented by Formula C-I.

As $R_{36}$, aliphatic groups having 1 to 30 carbons, aromatic groups having 6 to 30 carbons and heterocyclic groups having 1 to 30 carbons. As $R_{34}$ and $R_{35}$, a hydrogen atom and those cited as $R_{36}$ preferably are preferable.

As $R_{32}$, a hydrogen atom combining with NH directly or through CO or $SO_2$, aliphatic groups having 1 to 30 carbons, aromatic groups having 6 to 30 carbons, heterocyclic group having 1 to 30 carbons, $-OR_{38}$, $-COR_{38}$,

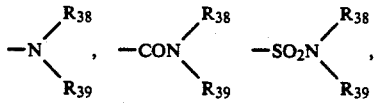

$-CO_2R_{40}$, $-SO_2R_{40}$, $-PO(OR_{40})_2$, $-PO(R_{40})_2$ or $-SO_2OR_{40}$ ($R_{38}$, $R_{39}$ and $R_{40}$ are the same as those defined in the above-mentioned $R_{34}$, $R_{35}$ and $R_{36}$, and $R_{38}$ and $R_{39}$ may bind each other to form a heterocycle.) are preferable. Substituents represented by $R_{32}$ contain those having a substituent additionally.

$R_{37}$ is preferably an aromatic group having 6 to 30 carbons. $R_{37}$ includes those having a substituent. As typical examples of substituents, a halogen atom, a hydroxy group, an amino group, a carboxyl group, a sulfo group, a cyano group, an aromatic group, a heterocyclic group, a carbonamide group, a sulfonamide group, a carbamoyl group, a sulfamoyl group, an ureido group, an acyl group, an acyloxy group, an aliphatic oxy group, an aromatic oxy group, an aliphatic thio group, an aromatic thio group, an aliphatic sulfonyl group, an aromatic sulfonyl group, a sulfamoylamino group, a nitro group, an imide group, an aliphatic group and an aliphatic oxycarbonyl group are cited. When it is substituted with plural substituents, plural substituents may bind each other to form a ring. For example, a dioxymethylene group is cited.

As typical examples of $R_{33}$, a halogen atom, a hydroxy group, an amino group, a carboxyl group, a sulfo group, a cyano group, an aromatic group, a heterocyclic group, a carbonamide group, a sulfonamide group, a carbamoyl group, a sulfamoyl group, an ureido group, an acyl group, an acyloxy group, an aliphatic oxy group, an aromatic oxy group, an aliphatic thio group, an aromatic thio group, an aliphatic sulfonyl group, an aromatic sulfonyl group, a sulfamoylamino group, a nitro group and an imide group are cited. The carbon number contained in the above-mentioned $R_{33}$ is preferably 0 to 33. As an example of ring $R_{33}$ when m=2, a dioxymethylene group is cited.

When l is 1, $R_{31}$ is particularly preferable to be $-CONR_{34}R_{35}$. m is preferably 0. $R_{32}$ is particularly preferable to be $-COR_{38}$ which directly combine with NH, $-COOR_{40}$, $-SO_2R_{40}$, $-CONR_{38}R_{39}$ and $-SO_2NR_{38}R_{39}$ and furthermore preferable to be $-COOR_{40}$ which directly combine with NH, $-COR_{38}$ and $-SO_2R_{40}$. The most preferable is $-COOR_{40}$.

In addition, those forming a polymer not less than a dimer through $R_{31}$ to $R_{33}$ and X are contained in Formula C-I.

When l=m=0, it is preferable that X does not contain development-inhibitating portion.

Practical examples of cyan couplers represented by Formula C-I are described in Japanese Patent O.P.I. Publication Nos. 237448/1985, 153640/1986, 145557/1986, 85242/1987, 15529/1983, 117422/1975, 18315/1977, 90932/1977, 52423/1978, 48237/1979, 66129/1979, 32071/1980, 65957/1980, 105226/1980, 1938/1981, 12643/1981, 27147/1981, 126832/1981, 95346/1983, 123157/1987, 123158/1987, 93754/1988 and 208042/1988, RD-29,015 and U.S. Pat. No. 3,488,193. They can be synthesized by means of methods described therein.

Next, we will show typical examples of couplers represented by Formula C-I. However, the present invention is not limited thereto.

C-I-1

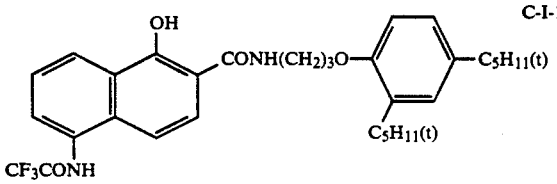

C-I-2

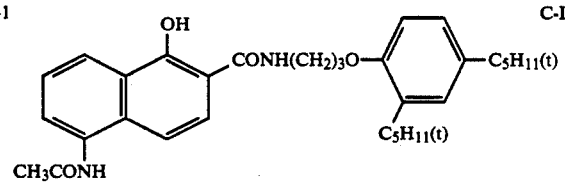

C-I-3

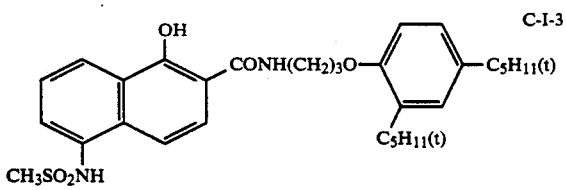

C-I-4

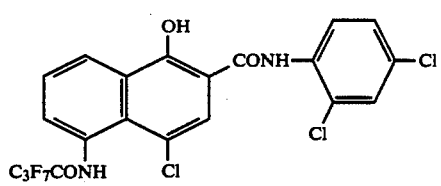

C-I-5

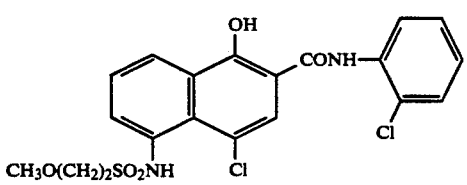

C-I-6

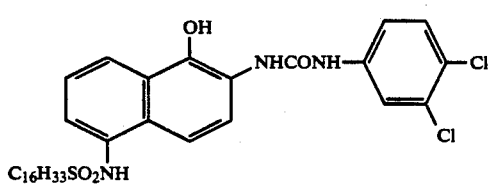

C-I-7

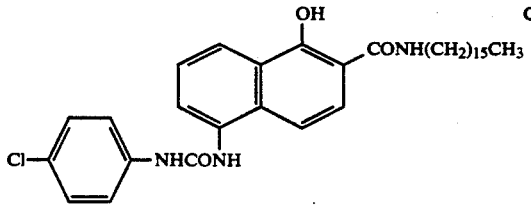

C-I-8

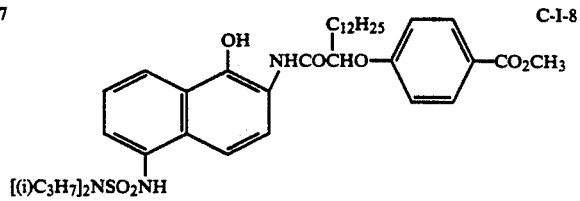

-continued
C-I-9
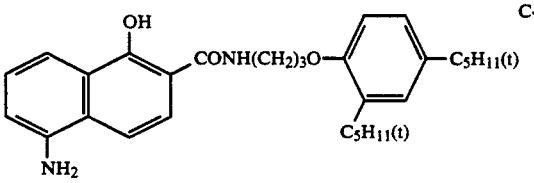
C-I-10
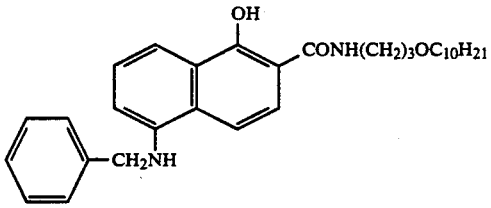
C-I-11
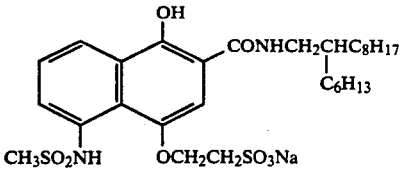
C-I-12
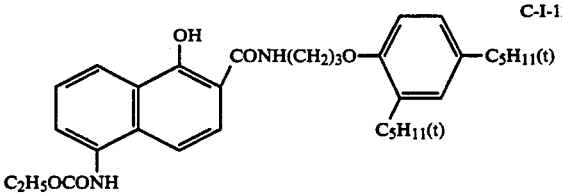
C-I-13
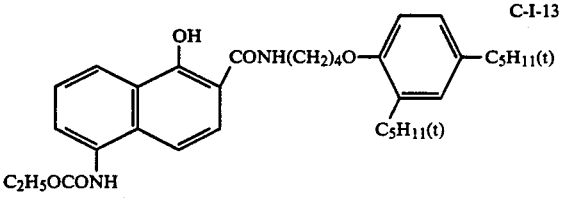
C-I-14
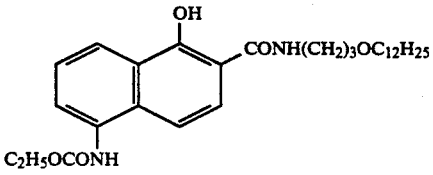
C-I-15
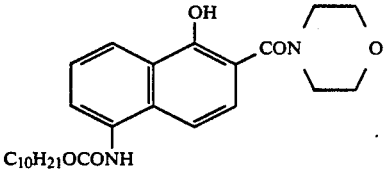
C-I-16
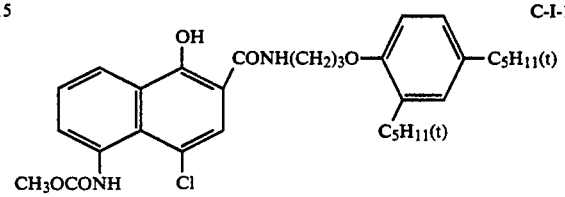
C-I-17
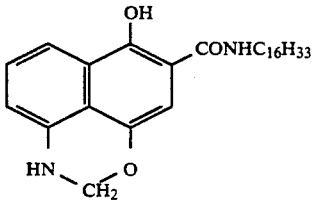
C-I-18
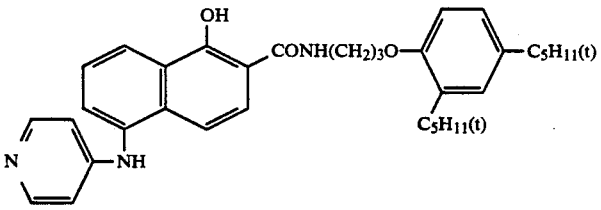
C-I-19
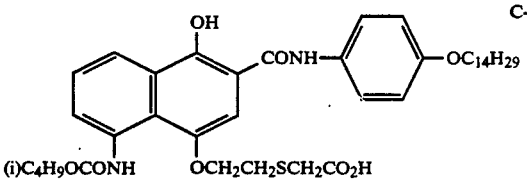
C-I-20
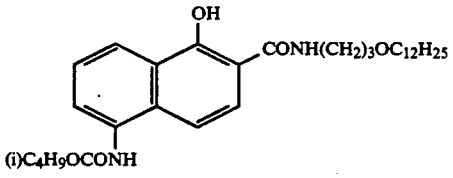
C-I-21
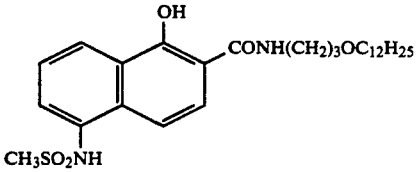
C-I-22
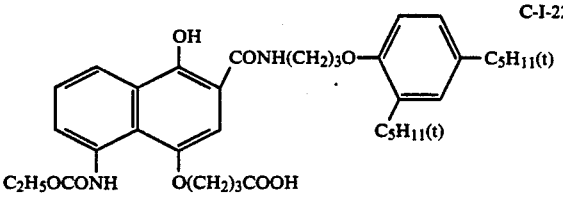

-continued
C-I-23
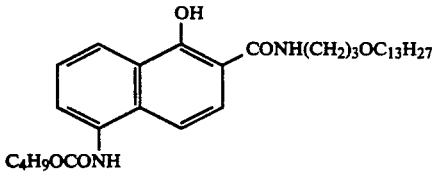
C-I-24
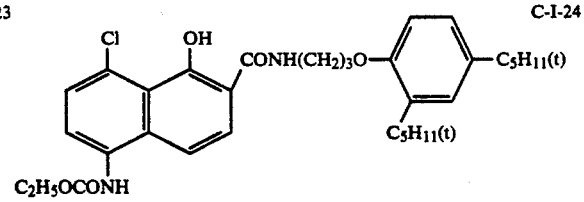
C-I-25
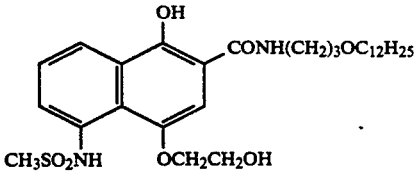
C-I-26
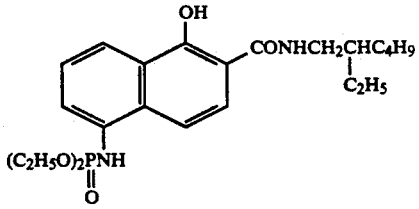
C-I-27
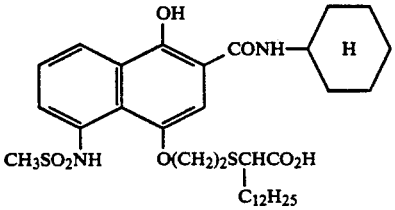
C-I-28
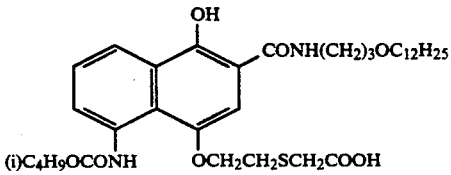
C-I-29
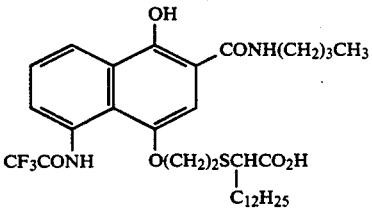
C-I-30
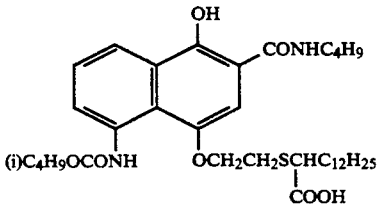
C-I-31
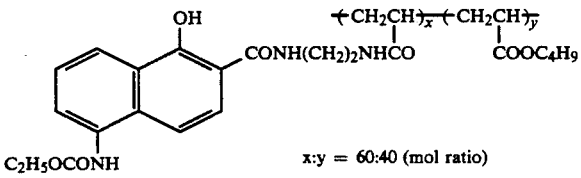
x:y = 60:40 (mol ratio)
C-I-32
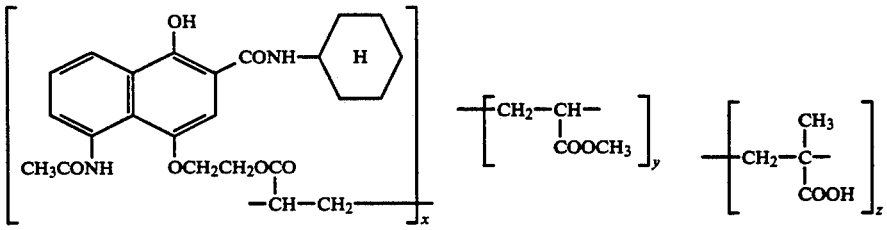
x:y:z = 5:4:1 (weight ratio)
C-I-33
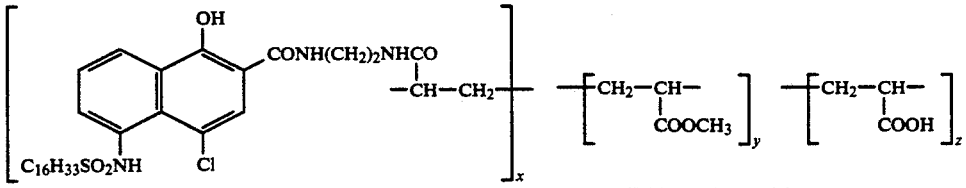
x:y:z = 67:26:7 (weight ratio)

-continued
C-I-34
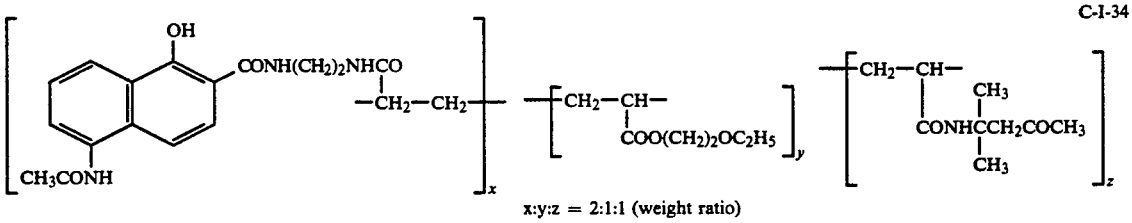
x:y:z = 2:1:1 (weight ratio)
C-I-35
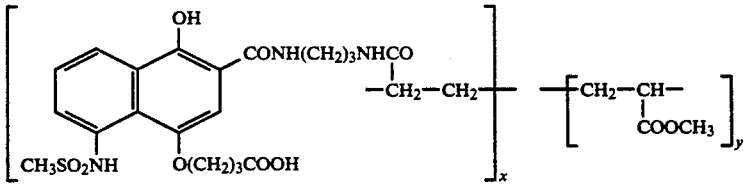
x:y = 1:4 (weight ratio)
C-I-36
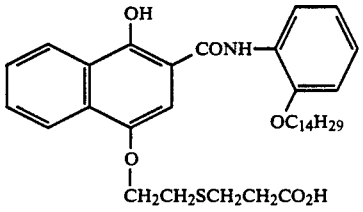
C-I-37
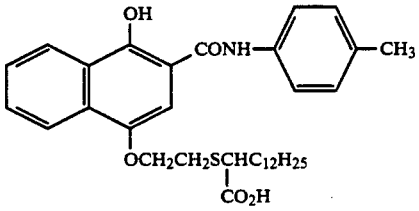
C-I-38
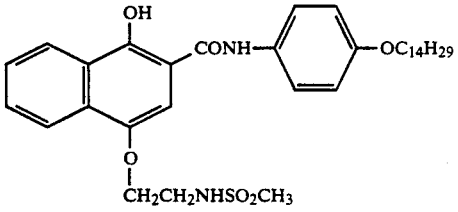
C-I-39
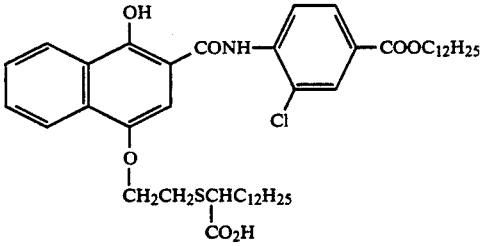
C-I-40
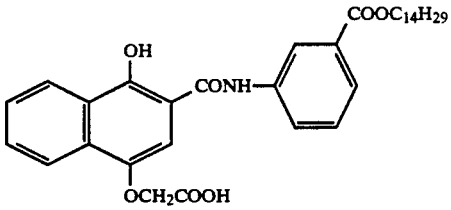
C-I-41
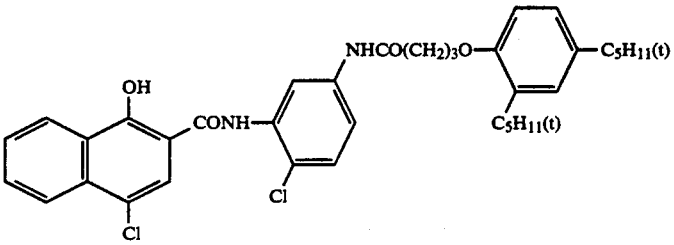

-continued
C-I-42
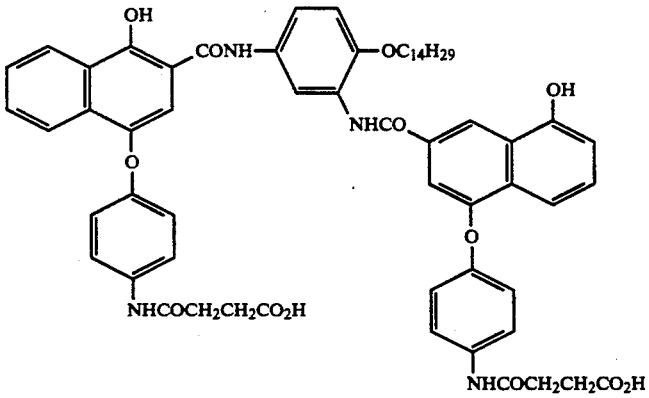
C-I-43
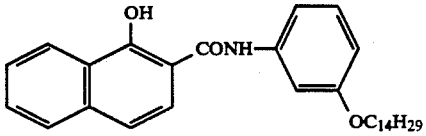
C-I-44
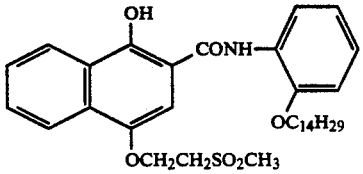
C-I-45
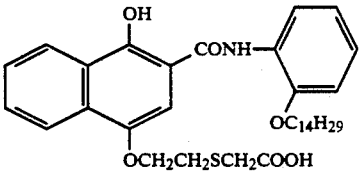
C-I-46
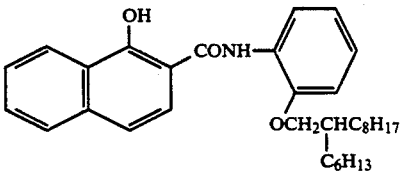
C-I-47
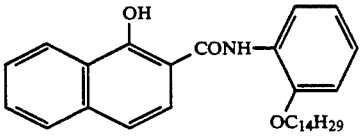
C-I-48
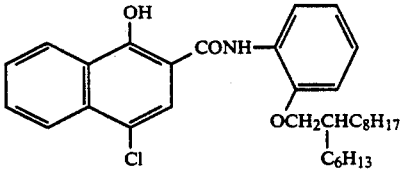
C-I-49
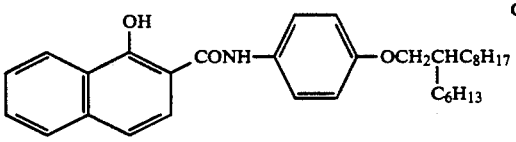
C-I-50
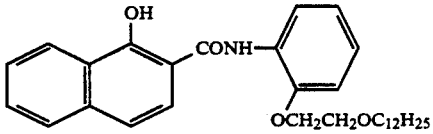
C-I-51
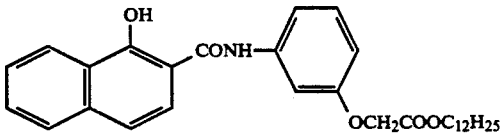
C-I-52
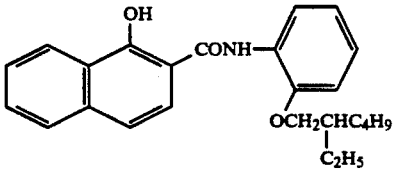
C-I-53
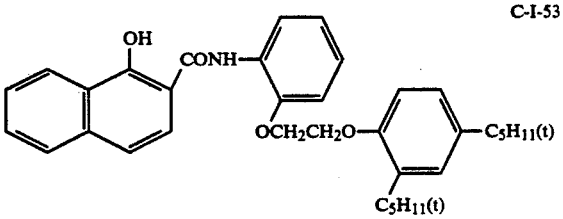
C-I-54
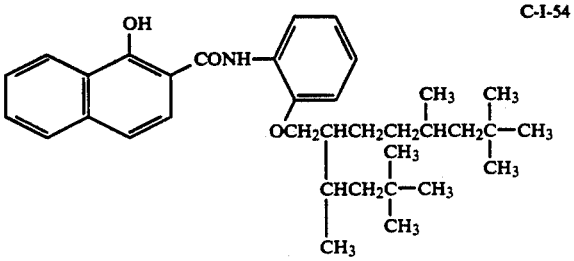

-continued
C-I-55
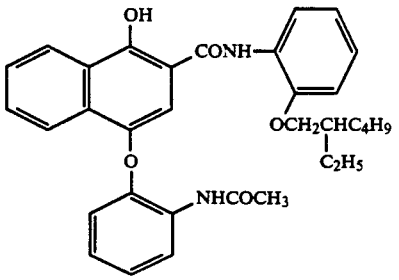
C-I-56
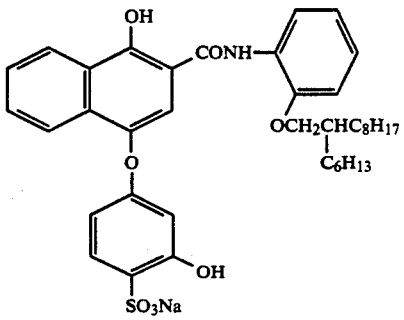
C-I-57
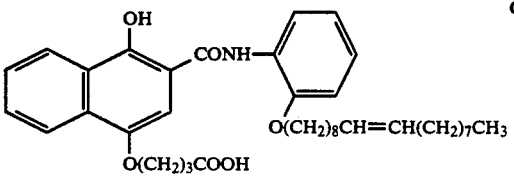
C-I-58
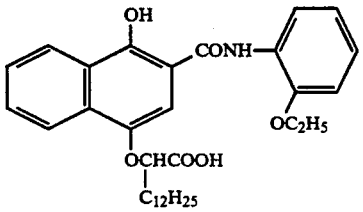
C-I-59
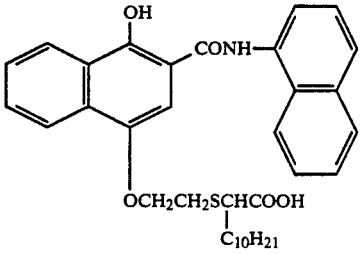
C-I-60
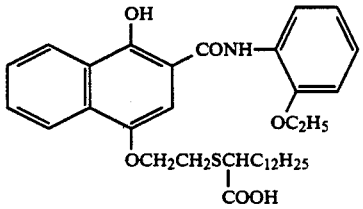
C-I-61
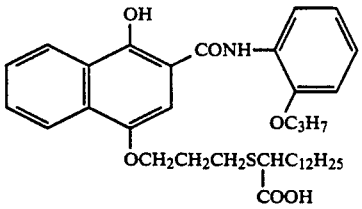
C-I-62
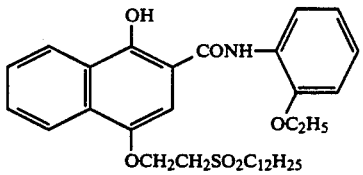
C-I-63
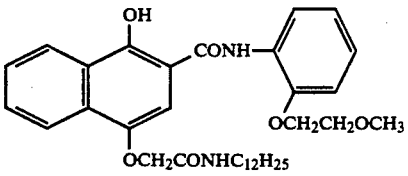
C-I-64
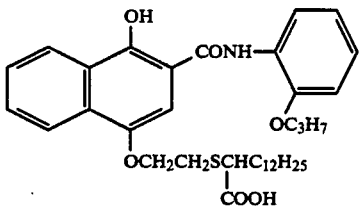
C-I-65
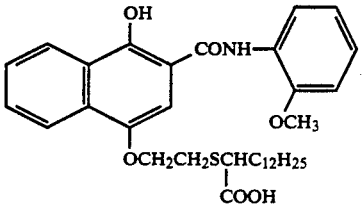
C-I-66
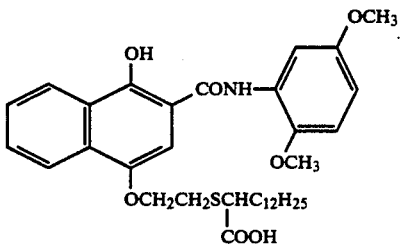

-continued

C-I-67

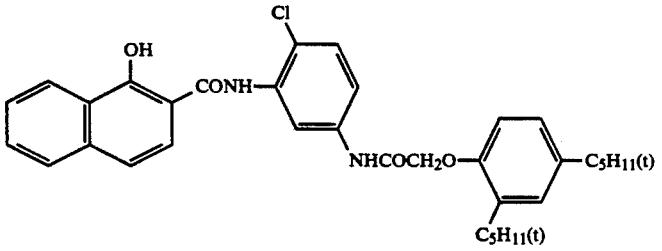

C-I-68

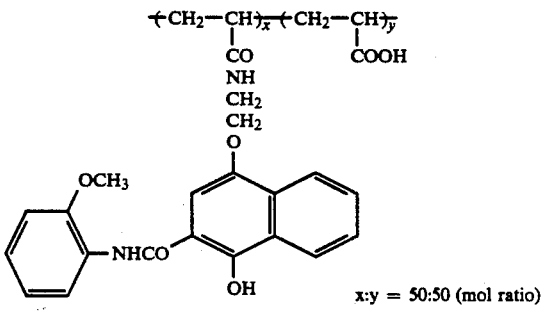

x:y = 50:50 (mol ratio)

C-I-69

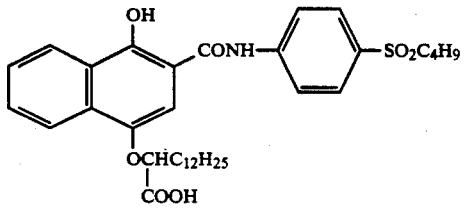

C-I-70

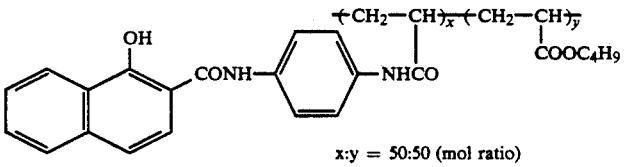

x:y = 50:50 (mol ratio)

C-I-71

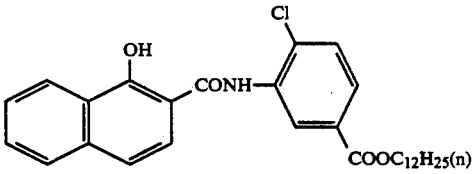

Formula C-II

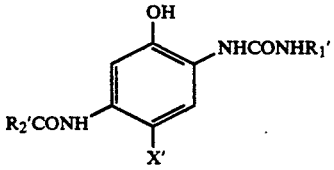

wherein X' represents a hydrogen atom or a group capable of being split off by coupling with an aromatic primary amine color developing agent; $R_1'$ represents an aryl group or a heterocyclic group; $R_2'$ represents an aliphatic group or an aryl group; each group represented by $R_1'$ or $R_2'$ includes those having a substituent, and also includes those forming a polymer not less than a dimer by means of $R_1'$ or $R_2'$. sizes necessary for providing diffusion-proof property to couplers represented by Formula C-II and to dyes formed by and said couplers.

As aryl groups represented by $R_1'$ or $R_2'$, for example, a phenyl group and a naphtyl group are cited.

As substituents for groups represented by $R_1'$ or $R_2'$, for example, a nitro group, a cyano group, a halogen group, an alkyl group, an aryl group, an amino group, a hydroxy group, an acyl group, an alkoxycarbonyl group, an aryloxycarbonyl group, an alkylsulfonyl group, an arylsulfonyl group, an alkoxysulfonyl group, an aryloxysulfonyl group, a carbamoyl group, a sulfamoyl group, an acyloxy group, a carbonamide group and a sulfonamide group are cited. The number of said substituent is preferably 1 to 5. When it is 2 or more, each substituent may be the same or different.

The preferable substituents to $R_1'$ are an alkylsulfonyl group, a cyano group and a halogen group.

As $R_2'$, the preferable is one illustrated by the following Formula CU-II.

Formula CU-II

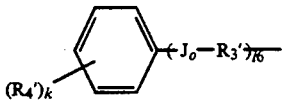

wherein $J_0$ represents a hydrogen atom or a sulfur atom; k represents 0 to 4 integers; $l_6$ represents 0 or 1; when k is 2 or more, $R_4'$ existing in quantity of 2 or more may be the same or different; $R_3'$ represents an alkylene group; $R_4'$ represents a substituent; as substituents represented by $R_4'$, for example, an alkyl group, an aryl group, an alkoxy group, an aryloxy group, a hydroxy group, an acyloxy group, an alkylcarbonyloxy group, an arylcarbonyloxy group, a carboxy group, an alkoxycarbonyl group, an aryloxycarbonyl group, an alkylthio group, an acyl group, an acylamino group, a sulfonamide group, a carbamoyl group and a sulfamoyl group are cited;

As a leaving group represented by X', for example, an aryloxy group, an alkoxy group, an acyloxy group, an arylthio group, an alkylthio group, a sulfonamide group and acid imide group wherein a halogen atom, an oxygen atom, a sulfur atom or a nitrogen atom is combined directly at the coupling position, are cited; as practical examples thereof, those described in U.S. Pat. Nos. 3,476,563 and 3,749,735, Japanese Patent O.P.I. Publication No. 37425/1972, Japanese Patent Publication No. 36894/1983 and Japanese Patent O.P.I. Publication Nos. 10135/1975, 117422/1975, 130441/1975, 108841/1976, 120334/1975, 18315/1977 and 105226/1978 are cited.

Next, we will show practical examples of cyan couplers represented by Formula C-II. However, they are not limited.

CU-1

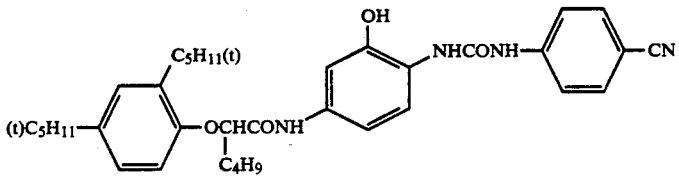

CU-2

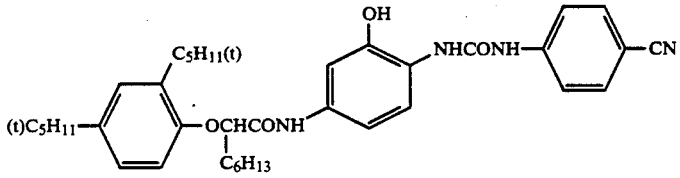

CU-3

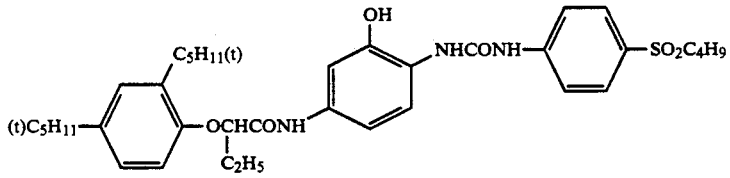

CU-4

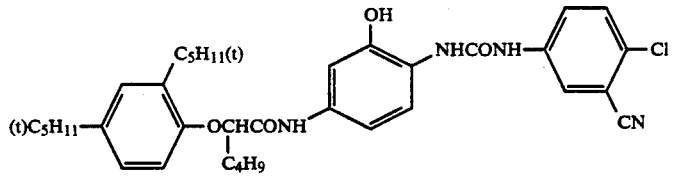

CU-5

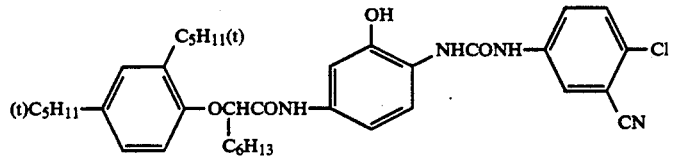

CU-6

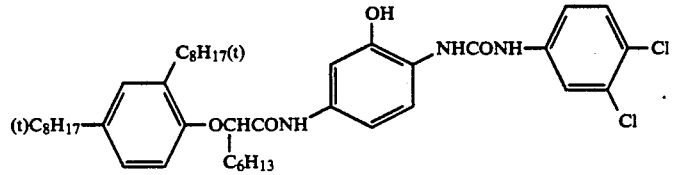

-continued
CU-7
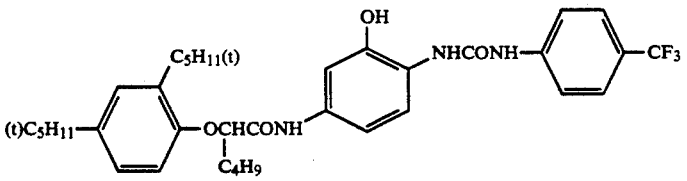
CU-8
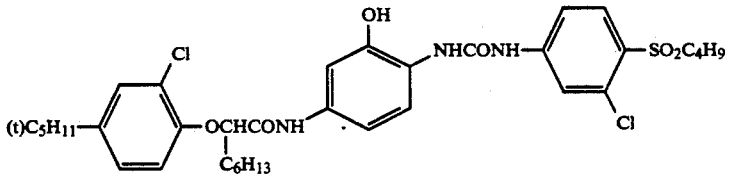
CU-9
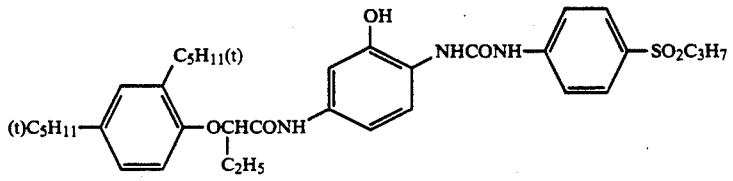
CU-10
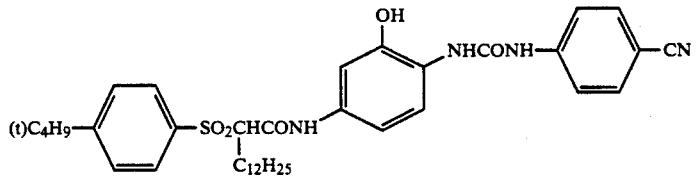
CU-11
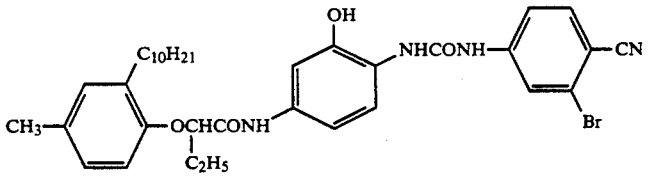
CU-12
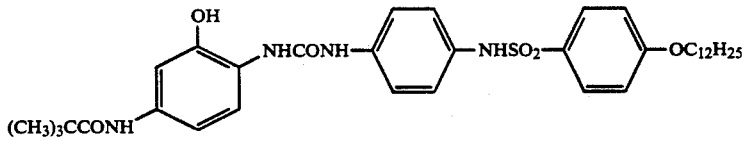
CU-13
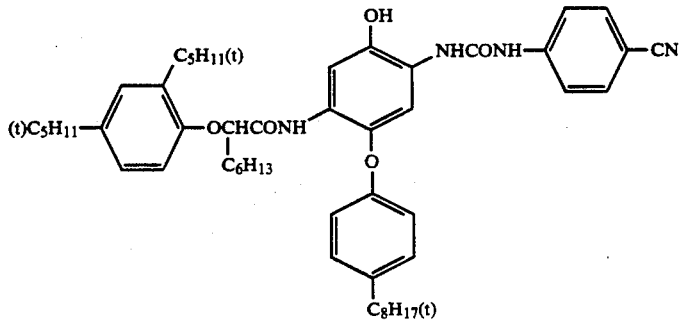

-continued
CU-14
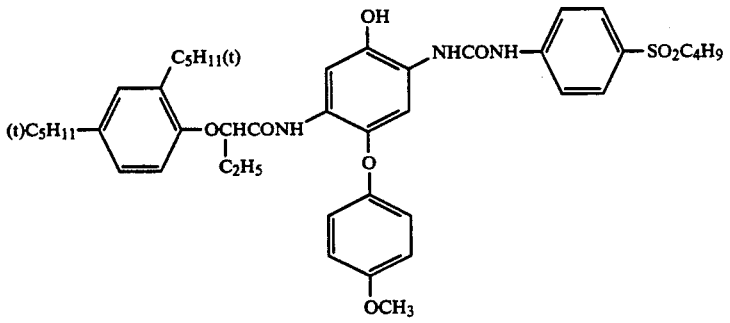
CU-15
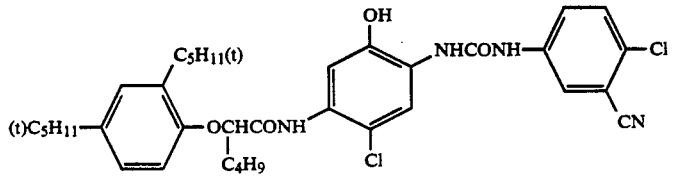
CU-16
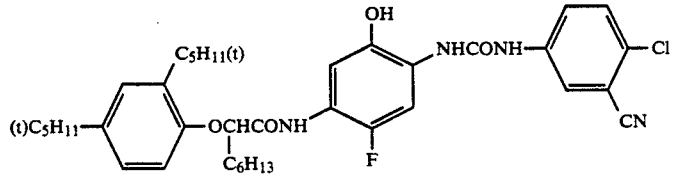
CU-17
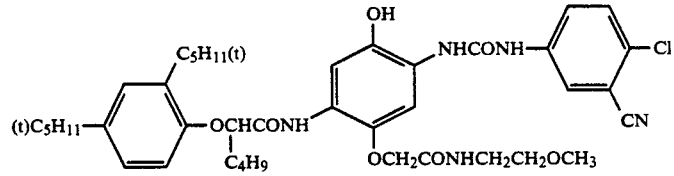
CU-18
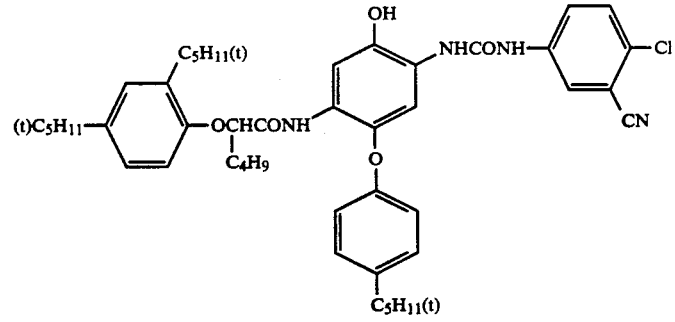
CU-19
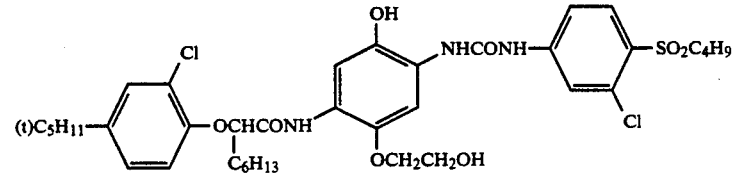

-continued
CU-20
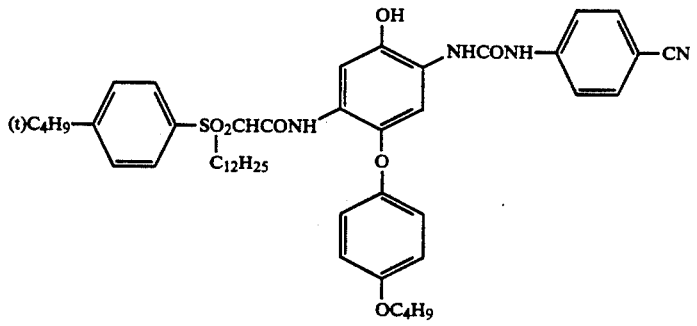
CU-21
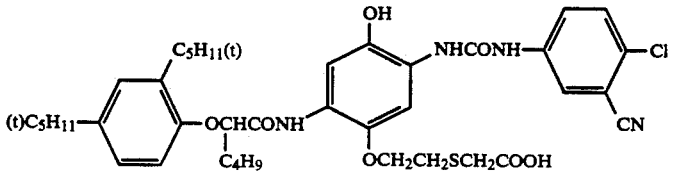
CU-22
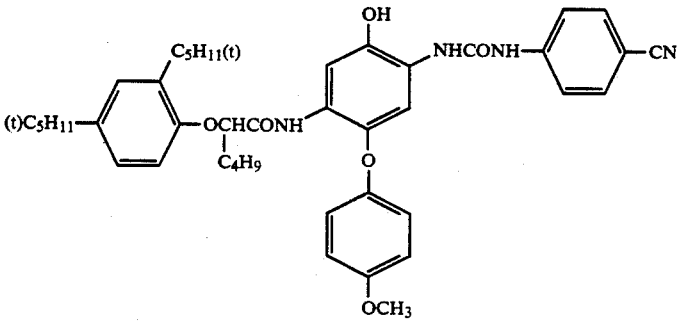
CU-23
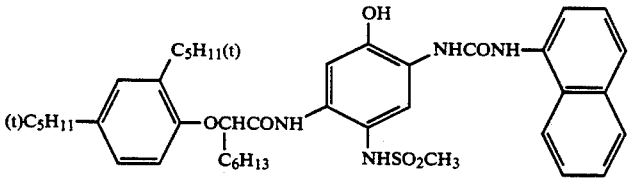
CU-24
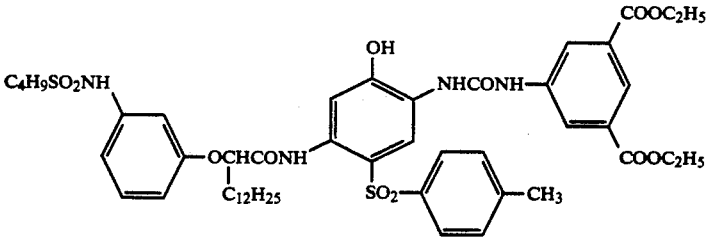
CU-25
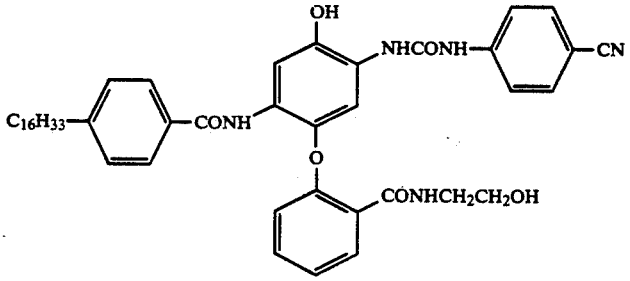

-continued
CU-26
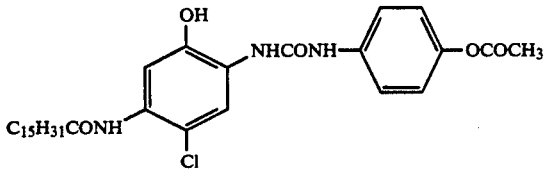
CU-27
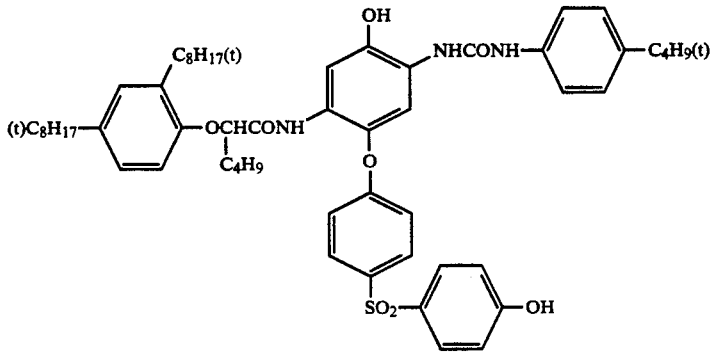
CU-28
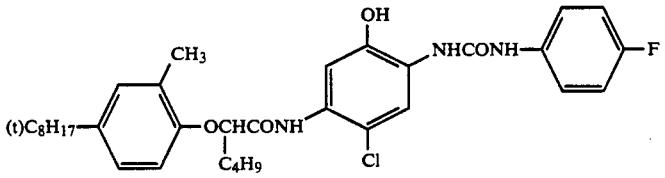
CU-29
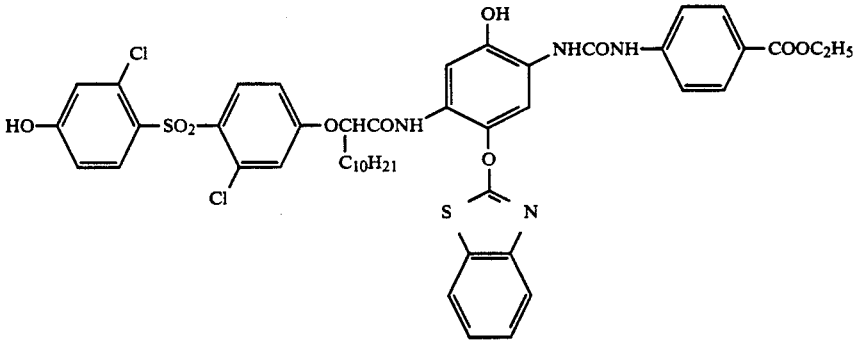
CU-30
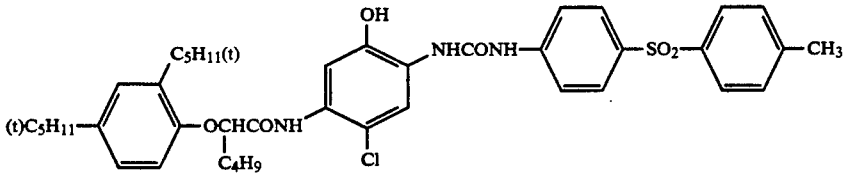
CU-31
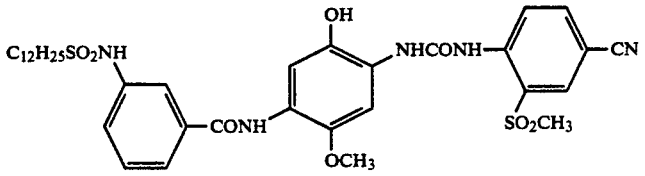

-continued
CU-32
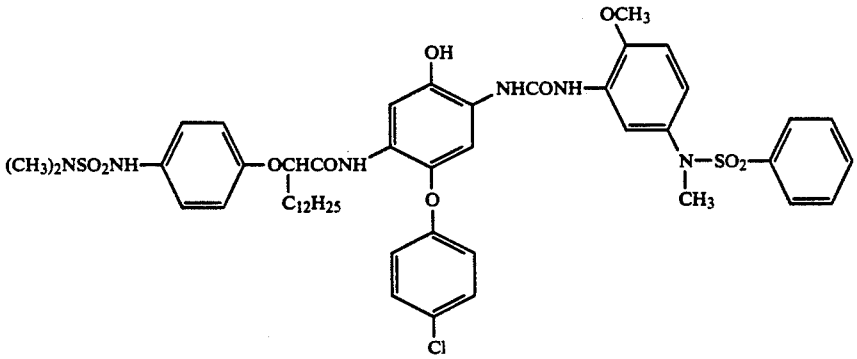
CU-33
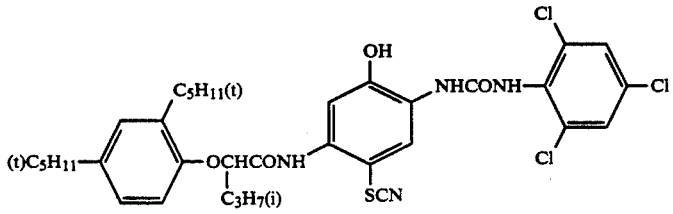
CU-34
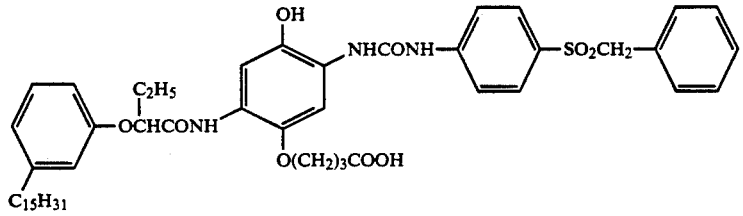
CU-35
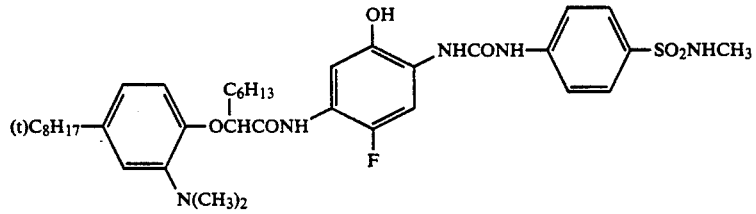
CU-36
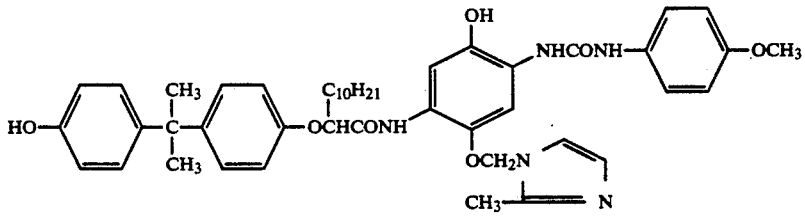
CU-37
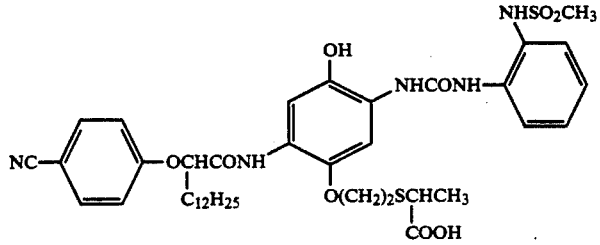

-continued
CU-38
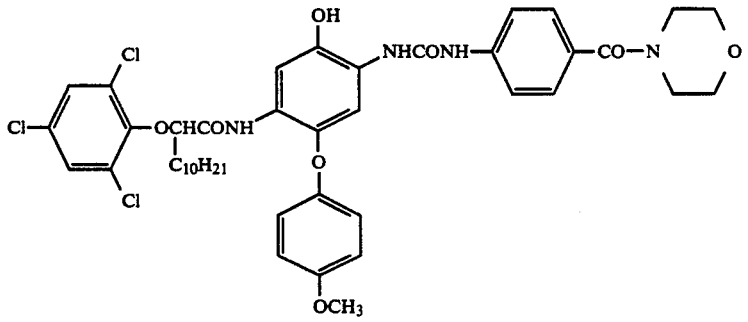
CU-39
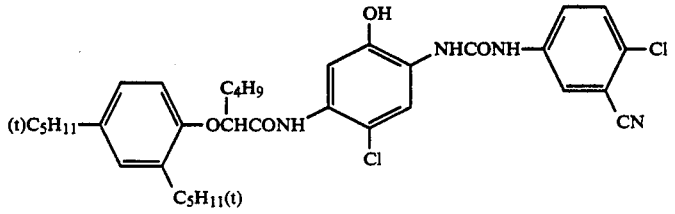
CU-40
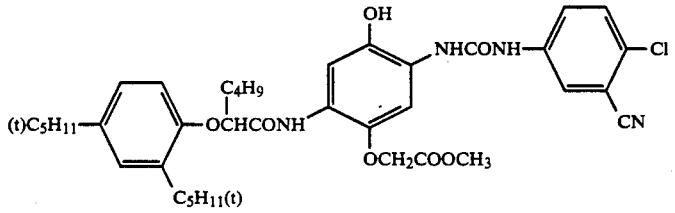
CU-41
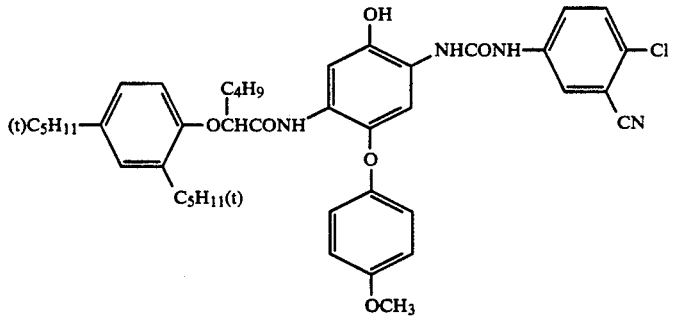
CU-42
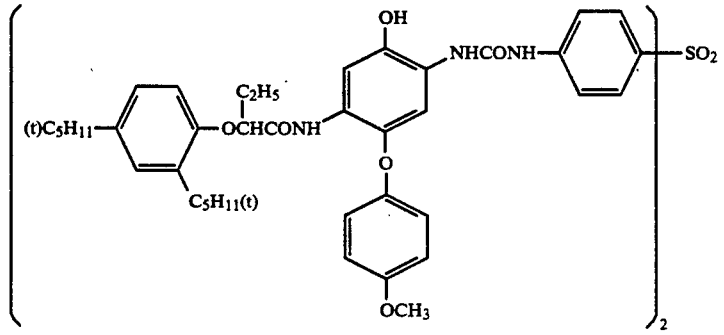

-continued
CU-43
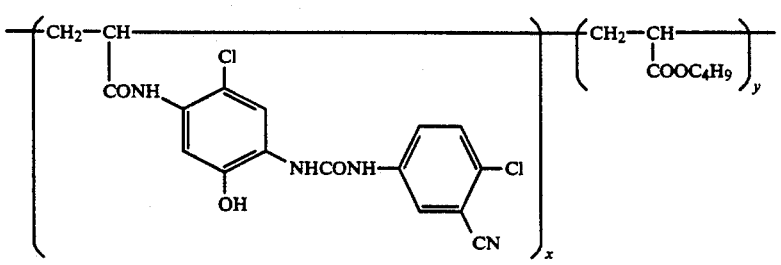
x:y = 50:50 (weight ratio)
CU-44
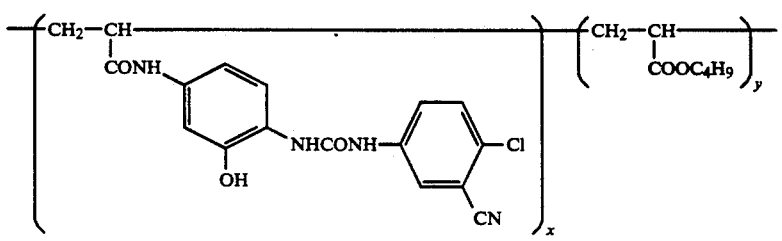
x:y = 50:50 (weight ratio)
CU-45
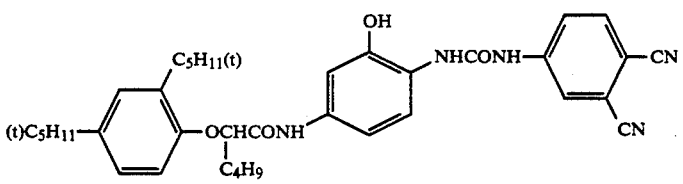
CU-46
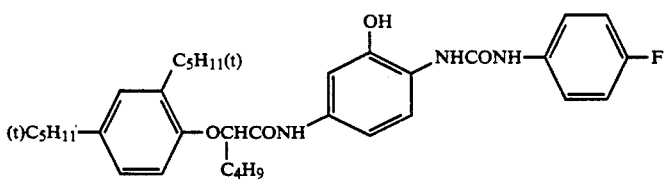
CU-47
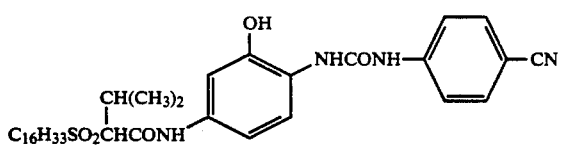
CU-48
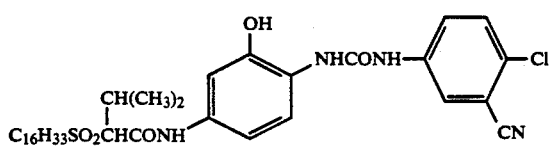
CU-49
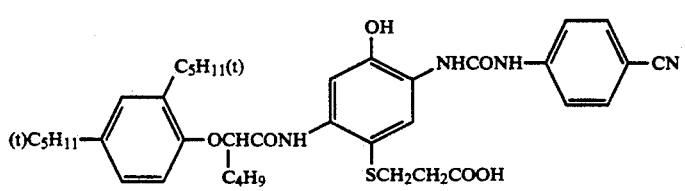

-continued

CU-50

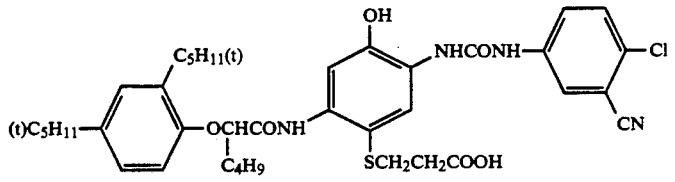

CU-51

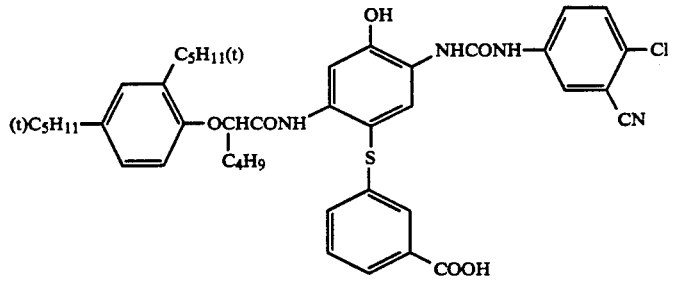

practical examples of phenol type couplers having an ureido group other than those exemplified above, for example, those described in Japanese Patent O.P.I. Publication Nos. 65134/1981, 204543/1982, 204544/1982, 204545/1982, 33249/1983, 33253/1983, 98731/1983, 118643/1983, 179838/1983, 187928/1983, 65844/1984, 179838/1983, 187928/1983, 65844/1984, 71051/1984, 86048/1984, 105644/1984, 111643/1984, 111644/1984, 131939/1984, 165058/1984, 177558/1984, 180559/1984, 198455/1984, 35731/1985, 37557/1985, 49335/1985, 49336/1985, 05533/1985, 91355/1985, 107649/1985, 107650/1985, 2757/1986, 18948/1986, 20039/1986, 42658/1986, 56348/1986, 65241/1986, 72244/1986, 72245/1986, 75350/1986, 75351/1986, 173467/1987, 33745/1988, 159848/1988, 161450/1988, 161451/1988, 172951/1989, 172952/1989, 253741/1989, 253742/1989, 253743/1989 and 254956 and RD-30,164 are cited.

When cyan couplers represented by Formula C-I and C-II are added to the light-sensitive material, various methods such as an oil-in-water emulsification dispersion method employing water-unsoluble high boiling organic solvent, an alkali dispersion method wherein cyan couplers are added in the form of alkali solution, a latex dispersion method and a solid dispersion method wherein cyan couplers are added in the form of fine solid may be used, depending on the physical properties of (e.g. solubility) of the cyan coupler.

The adding amount of coupler is normally in the range of $1.0\times10^{-3}$ to 1 mol and preferably $5.0\times10^{-3}$ mol to $8.0\times10^{-1}$ mol per mol of silver halide.

Couplers represented by Formulas C-I or C-II may be used in combination with other cyan couplers. In that case, it is preferable that the percentage of coupler represented by Formula C-I or C-II is 10 mol % or more.

Next, we will explain a heterocyclic anti-foggant used in the present invention. A heterocyclic anti-foggant is a compound having a heterocycle used for the purpose of preventing fog or stabilizing photographic property in the course of manufacturing, preserving or photographic processing light-sensitive materials.

As heterocycles, for example, an imidazole, a triazole, a tetrazole, a thiadiazole, an oxazole, a pyridine, a pyrimidine, a benzoimidazole, a benzotriazole, an indazole, a benzothiazole, a benzooxazole and an azaindene are cited.

These heterocyclic nucleus can be substituted with a normal organic group. As organic groups, for example, an alkyl group, an alyl group, a heterocyclic group, an acyl group, an alkoxy group, a carboxyl group, an alkoxycarbonyl group, an amino group, an amide group, a carbamoyl group, an ureido group, a sulfo group, a sulfonamide group, a sulfamoyl group, an alkylthio group, a mercapto group, a hydroxyl group, a nitro group and a halogen atom are cited.

Hereunder, practical examples of heterocyclic type anti-foggants preferably used in the present invention are cited. However, the present invention is not limited thereto.

Examples of Compound

1

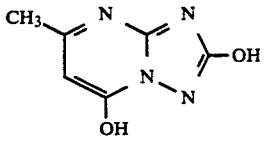

2

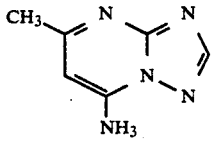

3

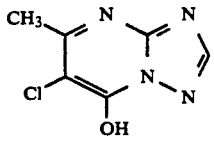

4

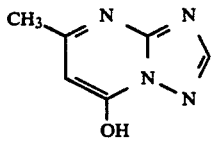

5

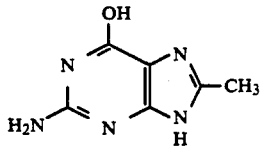

-continued
Examples of Compound
6
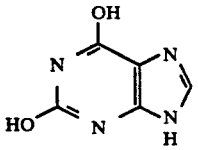
7
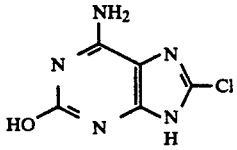
8
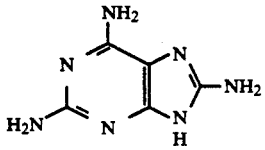
9
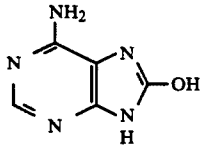
10
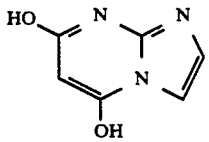
11
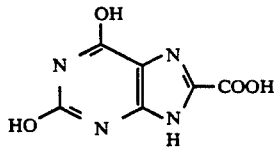
12
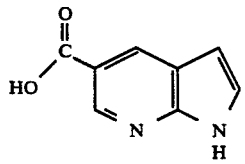
13
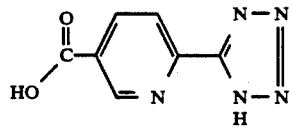
14
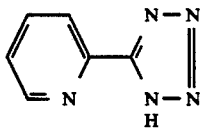
15
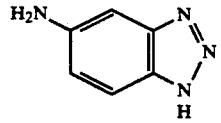
-continued
Examples of Compound
16
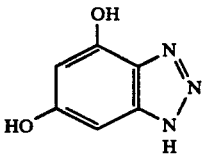
17
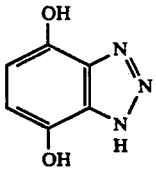
18
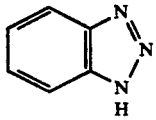
19
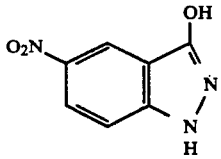
20
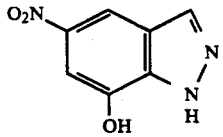
21
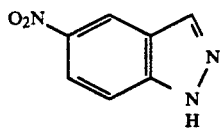
22
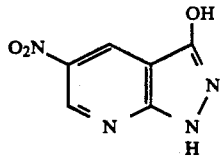
23
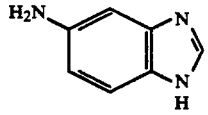
24
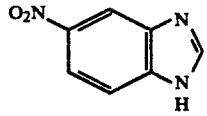
25
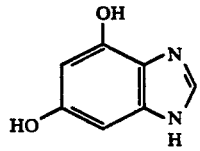

-continued
Examples of Compound
26
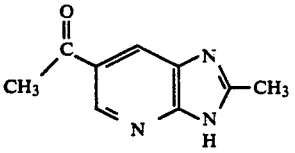
27
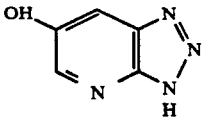
28
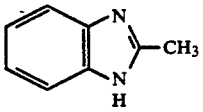
29
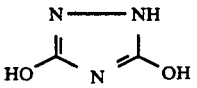
30
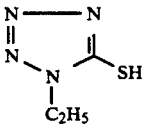
31
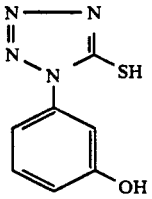
32
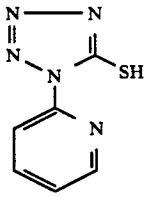
33
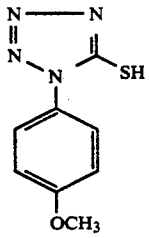
34
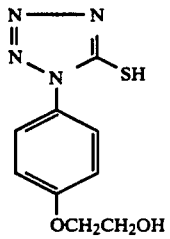
-continued
Examples of Compound
35
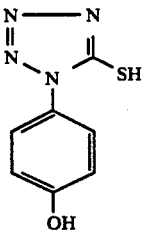
36
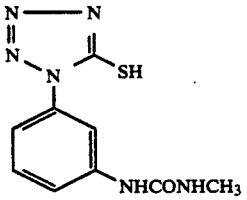
37
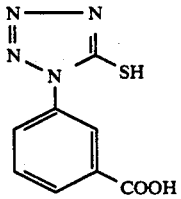
38
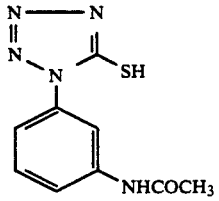
39
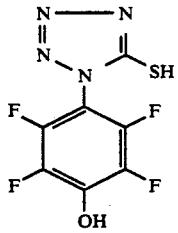
40
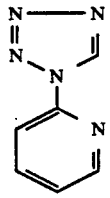
41
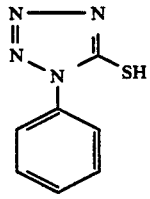

-continued
Examples of Compound
42
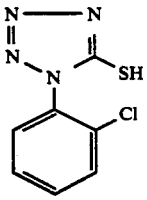
43
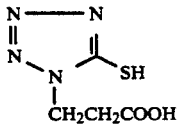
44
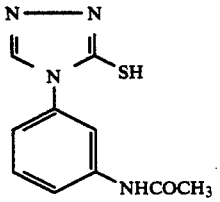
45
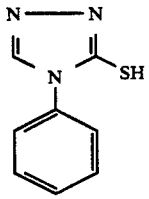
46
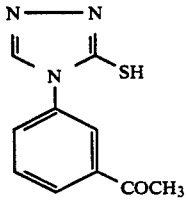
47
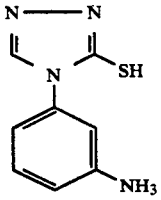
48
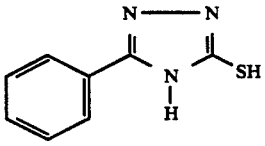
49
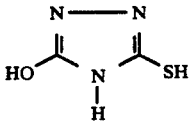
50
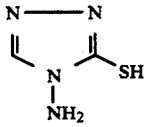
-continued
Examples of Compound
51
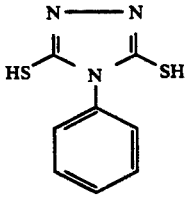
52
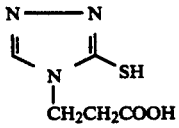
53
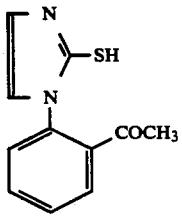
54
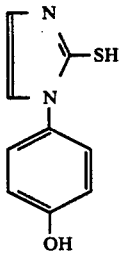
55
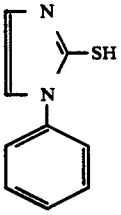
56
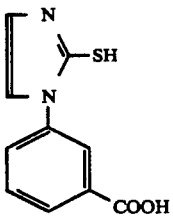
57
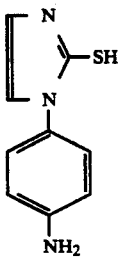

-continued
Examples of Compound
58
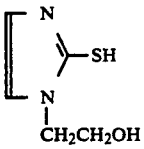
59
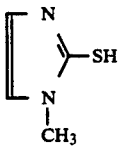
60
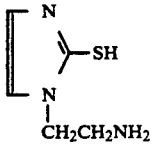
61
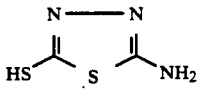
62
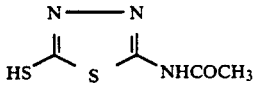
63
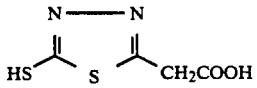
64
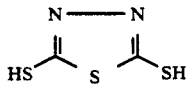
65
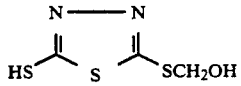
66
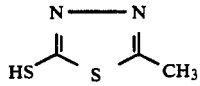
67
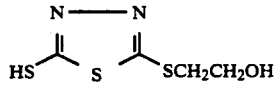
68
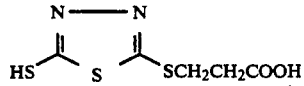
69
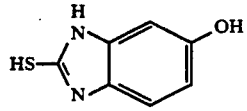
70
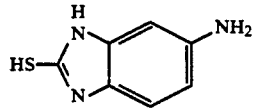
-continued
Examples of Compound
71
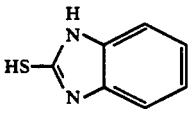
72
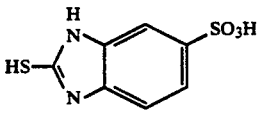
73
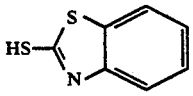
74
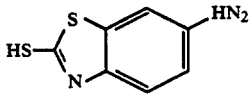
75
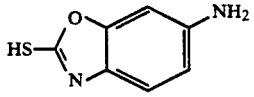
76
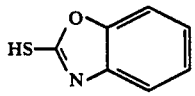
77
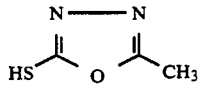
78
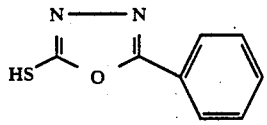
79
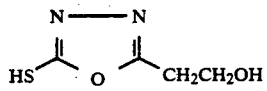
80
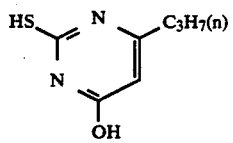
81
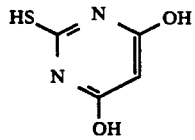
82
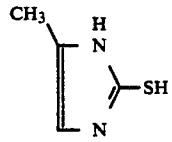

-continued

Examples of Compound

83 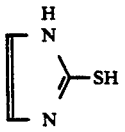

84 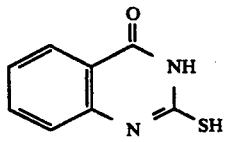

85 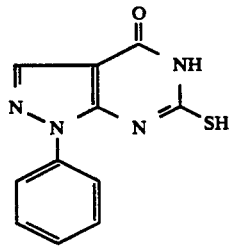

86 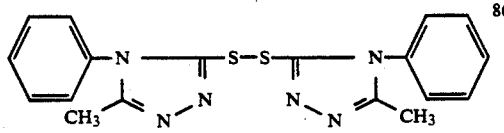

Some of the above-mentioned compounds are available on the market. However, they can be synthesized in accordance with methods described in U.S. Pat. No. 3,259,976, Japanese Patent O.P.I. Publication Nos. 14836/1982, 167023/1982, 9572/1983 and 68732/1984.

When an inhibitor in the present invention is contained in the silver halide emulsion layer of the invention, it may be added after being dissolved in water or an organic solvent capable of mixing freely with water (for example, methanol and ethanol). In addition, it may be used independently or in combination with an inhibitor in the present invention or with an anti-foggant not in the present invention.

The timing to add an inhibitor in the present invention is optional, either before the formation of silver halide grains, or in the course of forming silver halide grains, or in a period of time between the end of formation of silver halide grains and the start of chemical ripening, or in the course of chemical ripening, or at the end of chemical ripening or the time between the end of chemical ripening and the start of coating. Entire amount may be added at once, or it may be added separately on a basis of split adding.

With regard to the place to which an inhibitor is added, it may also be added directly to where a silver halide emulsion is prepared or to a silver halide emulsion coating solution. It may be added to a coating solution for the adjoining nonsensitive hydrophilic colloidal layer so that it may be contained in the silver halide emulsion layer in the present invention through diffusion in multi-layer coating.

There is no limit in adding amount. However, it is normal to be $1\times10^{-6}$ to $1\times10^{-1}$ mol and preferably $1\times10^{-5}$ to $1\times10^{-2}$ mol per mol of silver halide.

Silver halide (AgX) grains used in the present invention are grown through an acid method, a neutral method or an ammonium method that are conventional in the industry. After desalting process, they are prepared to be an AgX emulsion. The above-mentioned methods are described in publications such as *The Theory of the Photographic Process* written by Meeth published by MacMillan Co., Ltd.

When AgX grains are grown (including manufacturing seed grains), preparation methods to control pH, pAg and temperature in a reaction kettle and to insert gradually or simultaneously and mix silver ions and halide ions in accordance with the growth speed of AgX as described in Japanese Patent O.P.I. Publication No. 48521/1979 are employed. Finished emulsions provided with prescribed grain conditions are subjected to coagulation washing employing a polymer coagulation agent such as a coagulation agent with gelatin as a mother agent. AgX grains thus desalted are dispersed again in gelatin.

There is no limit in the composition of AgX grains. The ratio of composition of silver chloride, silver bromide and silver iodide is defined in accordance with the purpose. The composition of AgX may be uniform or laminated-type of core/shell composition. There is no limit in the average grain size of AgX and it may be different depending on the purpose. The preferable is 0.2 to 3.0 μm.

With regard to layer structure of red sensitive, green sensitive and blue sensitive silver halide emulsion layers in the present invention, each layer may have one layer respectively, and it may be composed of 2 layers of a high sensitive layer and a low sensitive layer. In addition, it may further be composed of 3 layers of a high sensitive layer, a medium sensitive layer and a low sensitive layer. The preferable layer composition is a 2 or more layers composition.

The sum of silver amount of the above-mentioned light- sensitive layer is 0.2 to 10 g/m$^2$, preferably 1 to 8 g/m$^2$. In addition, the total thickness of dried coating is 8 to 30 μm and preferably 10 to 25 μm under the conditions of 23° C. and 55% RH.

Silver halide emulsions used for the light-sensitive materials in the present invention can be chemically sensitized by the use of conventional methods, and they can be optically sensitized to a desired wavelength area employing a sensitizing dye.

Anti-foggants and stabilizers can be added to the silver halide emulsion. As a binder for the emulsion, it is preferable to employ gelatin.

Emulsion layers and other hydrophilic colloidal layers can be hardened. In addition, plasticizers, dispersants of water-unsoluble or refractory synthetic polymers (latex) can be contained.

A light-sensitive materials in the present invention may be any of color photographic light-sensitive materials including color negative film, color reversal film (incorporated and non-integrated), color paper, color positive film, color reversal paper, and color photographic light-sensitive materials for color diffusion transfer process and dye transfer process.

In emulsion layers of light-sensitive material for color photography, couplers are employed. In addition, colored couplers and competitive couplers that have effects of correction as well as compounds which release in coupling with oxidation product of color developer, the photographically useful fragments including development accelerators, bleaching accelerators, developers, silver halide solvents, toning agents, hardeners, foggants, anti-foggants, chemical sensitizers, spectral sensitizers and desensitizers may be used.

To the light-sensitive material, a formalin scavenger, a brightening agent, a matting agent, a lubricant, an image stabilizer, a surfactants, a color fog preventing agent, a development accelerator, a development retarder and a bleach accelerator can be added.

As a support, a paper laminated with polyethylene, a polyethylene terephthalate film, a baryta paper and a cellulose triacetate can be employed.

In order to obtain dye images employing a light-sensitive material in the present invention, conventional color photographic processing can be conducted after exposure to light.

EXAMPLES

Hereunder, we will explain practical examples of the present invention. However, the present invention is not limited thereto.

EXAMPLE 1

Hereunder, the adding amount of multi-layer color light-sensitive material represent ones per 1 $m^2$ unless otherwise stated. In addition, silver halide and colloidal silver were represented in conversion of silver. Sensitizing dyes were represented by means of mol number per mol of silver.

On a triacetylcellulose film support, each layer having the following composition was formed from the side of the support in this order to prepare a multi-layer color light-sensitive material.

| First layer; Anti-halation layer (HC) | |
|---|---|
| Black colloidal silver | 0.15 g |
| UV absorber (UV-1) | 0.20 g |
| Colored cyan coupler (CC-1) | 0.02 g |
| High boiling solvent (Oil-1) | 0.02 g |
| High boiling solvent (Oil-2) | 0.20 g |
| Gelatin | 1.6 g |
| **Second layer; Intermediate layer (IL-1)** | |
| Gelatin | 1.3 g |
| **Third layer; Low speed red sensitive emulsion layer (R-L)** | |
| Silver iodobromide emulsion (Em-1) | 0.4 g |
| Silver iodobromide emulsion (Em-2) | 0.3 g |
| Sensitizing dye (S-1) | $3.2 \times 10^{-4}$ |
| Sensitizing dye (S-2) | $3.2 \times 10^{-4}$ |
| Sensitizing dye (S-3) | $0.2 \times 10^{-4}$ |
| Cyan coupler (C-1) | 0.50 g |
| Colored cyan coupler (CC-1) | 0.07 g |
| DIR compound (D-1) | 0.006 g |
| DIR compound (D-2) | 0.01 g |
| Additive (SC-1) | 0.003 g |
| High boiling solvent (Oil-1) | 0.5 g |
| Gelatin | 1.0 g |
| **Fourth layer; High speed red sensitive emulsion layer (R-H)** | |
| Silver iodobromide emulsion (Em-3) | 0.9 g |
| Sensitizing dye (S-1) | $1.7 \times 10^{-4}$ |
| Sensitizing dye (S-2) | $1.6 \times 10^{-4}$ |
| Sensitizing dye (S-3) | $0.1 \times 10^{-4}$ |
| Cyan coupler (C-1) | 0.23 g |
| Colored cyan coupler (CC-1) | 0.03 g |
| DIR compound (D-2) | 0.02 g |
| High boiling solvent (Oil-1) | 0.25 g |
| Additive (SC-1) | 0.003 g |
| Gelatin | 1.0 g |
| **Fifth layer; Intermediate layer (IL-2)** | |
| Gelatin | 0.8 g |
| **Sixth layer; Low speed green sensitive emulsion layer (G-L)** | |
| Silver iodobromide emulsion (Em-1) | 1.0 g |
| Silver iodobromide (Em-2) | 0.2 g |
| Sensitizing dye (S-4) | $6.7 \times 10^{-4}$ |
| Sensitizing dye (S-5) | $0.8 \times 10^{-4}$ |
| Magenta coupler (M-1) | 0.5 g |
| Magenta coupler (M-2) | 0.43 g |
| Colored magenta coupler (CM-1) | 0.10 g |

-continued

| | |
|---|---|
| DIR compound (D-3) | 0.02 g |
| High boiling solvent (Oil-2) | 0.7 g |
| Additive (SC-1) | 0.003 g |
| Gelatin | 1.0 g |
| **Seventh layer; High speed green sensitive emulsion layer (G-H)** | |
| Silver iodobromide emulsion (Em-3) | 0.9 g |
| Sensitizing dye (S-6) | $1.1 \times 10^{-4}$ |
| Sensitizing dye (S-7) | $2.0 \times 10^{-4}$ |
| Sensitizing dye (S-8) | $0.3 \times 10^{-4}$ |
| Magenta coupler (M-1) | 0.03 g |
| Magenta coupler (M-2) | 0.13 g |
| Colored magenta coupler (CM-1) | 0.04 g |
| DIR compound (D-3) | 0.004 g |
| High boiling solvent (Oil-2) | 0.35 g |
| Additive (SC-1) | 0.003 g |
| Gelatin | 1.0 g |
| **Eighth layer; Intermediate layer (IL-3)** | |
| Gelatin | 1.0 g |
| **Ninth layer; Yellow filter layer (YC)** | |
| Yellow colloidal silver | 0.1 g |
| Additive (HS-1) | 0.07 g |
| Additive (HS-2) | 0.07 g |
| Additive (SC-2) | 0.12 g |
| High boiling solvent (Oil-2) | 0.15 g |
| Gelatin | 1.0 g |
| **Tenth layer; Low speed blue sensitive emulsion layer (B-L)** | |
| Silver iodobromide emulsion (Em-1) | 0.25 g |
| Silver iodobromide emulsion (Em-2) | 0.25 g |
| Sensitizing dye (S-9) | $5.8 \times 10^{-4}$ |
| Yellow coupler (Y-1) | 0.9 g |
| DIR compound (D-1) | 0.003 g |
| DIR compound (D-2) | 0.006 g |
| High boiling solvent (Oil-2) | 0.18 g |
| Additive (SC-1) | 0.004 g |
| Gelatin | 1.3 g |
| **Eleventh layer; High speed blue sensitive emulsion layer (B-H)** | |
| Silver iodobromide emulsion (Em-4) | 0.5 g |
| Sensitizing dye (S-10) | $3.0 \times 10^{-4}$ |
| Sensitizing dye (S-11) | $1.2 \times 10^{-4}$ |
| Yellow coupler (Y-1) | 0.3 g |
| High boiling solvent (Oil-2) | 0.05 g |
| Additive (SC-1) | 0.002 g |
| Gelatin | 1.1 g |
| **Twelfth layer; First protective layer (PRO-1)** | |
| Silver iodobromide (average grain size is 0.08 μm) | 0.3 g |
| UV absorber (UV-1) | 0.07 g |
| UV absorber (UV-2) | 0.10 g |
| High boiling solvent (Oil-1) | 0.07 g |
| High boiling solvent (Oil-3) | 0.07 g |
| Formalin scavenger (HS-1) | 0.2 g |
| Formalin scavenger (HS-2) | 0.1 g |
| Gelatin | 0.8 g |
| **Thirteenth layer; Second protective layer (PRO-2)** | |
| Surfactant (SU-1) | 0.004 g |
| Surfactant (SU-2) | 0.02 g |
| Alkali-soluble matting agent (average grain size 2 μm) | 0.13 g |
| Polymethylmethacrylate (average grain size 3 μm) | 0.02 g |
| Cyan dye (AI-1) | 0.005 g |
| Magenta dye (AI-2) | 0.01 g |
| Lubricant (WAX-1) | 0.04 g |
| Gelatin | 0.5 g |

In addition to the above-mentioned components, Coating assistant SU-4, Dispersion assistant SU-3, Hardener H-1 and H-2, Antiseptic DI-1, Dye AI-1 and AI-2, Anti-foggant AF-1 and AF-2 were added appropriately to each layer, if necessary.

In addition, emulsions used in the above-mentioned samples were as follows. Each of them was a mono-dispersion emulsion having high iodide content therein.

Em-1: Average silver iodide content ratio 7.5 mol %
Silver bromo iodide
Average grain size 0.55 μm
Form of grains Octahedron Em-2: Average silver iodide content ratio 2.5 mol %
Silver bromo iodide
Average grain size 0.36 μm
Form of grains Octahedron
Em-3: Average silver iodide content ratio 8.0 mol %
Silver bromo iodide
Average grain size 0.84 μm
Form of grains Octahedron
Em-4: Average silver iodide content ratio 8.5 mol %
Silver bromo iodide
Form of grains Octahedron
S-1
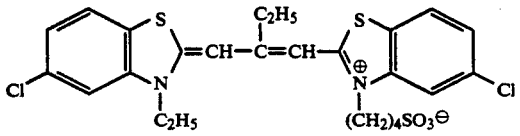
S-2
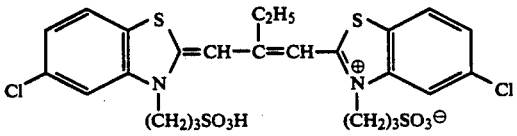
S-3
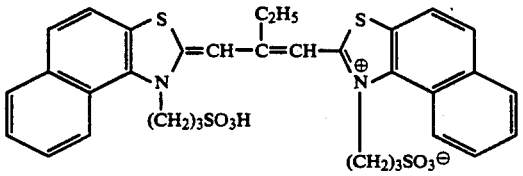
S-4
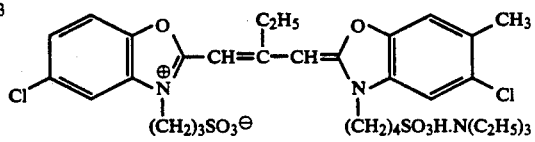
S-5
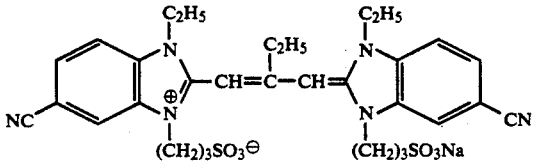
S-6
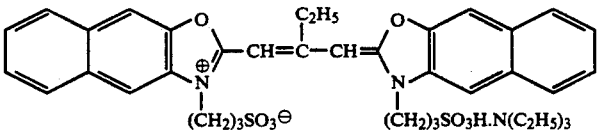
S-7
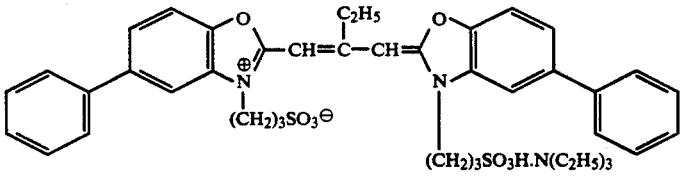
S-8
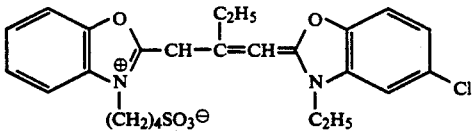
S-9
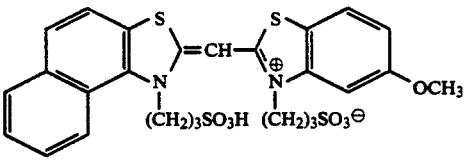
S-10
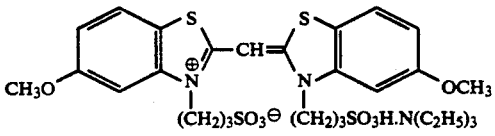
S-11
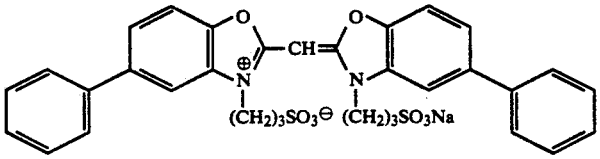

-continued
C-1
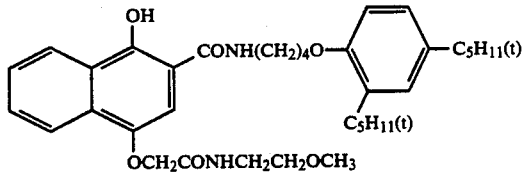
M-1
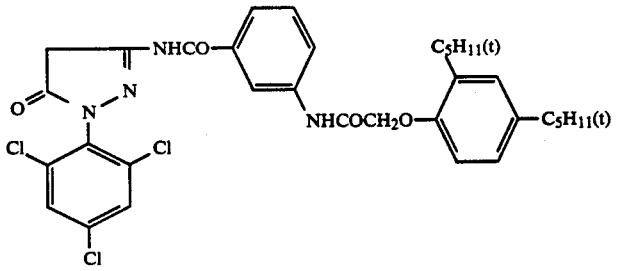
M-2
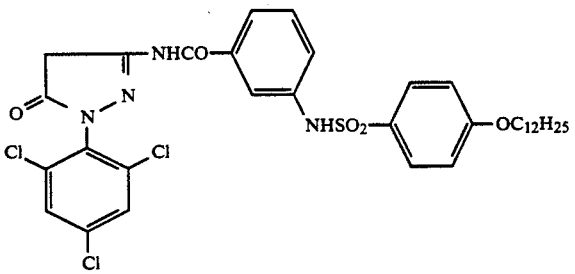
Y-1
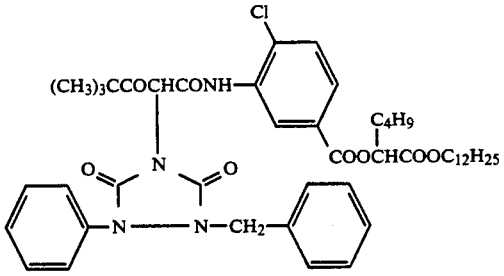
CC-1
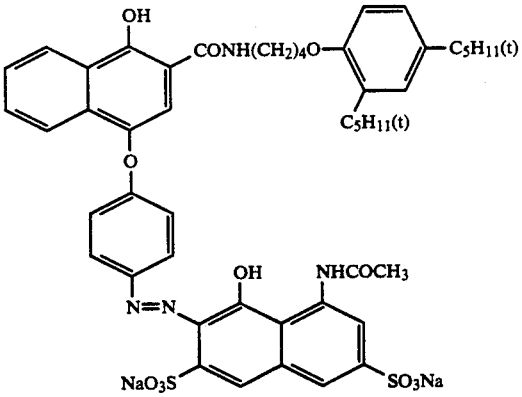
CM-1
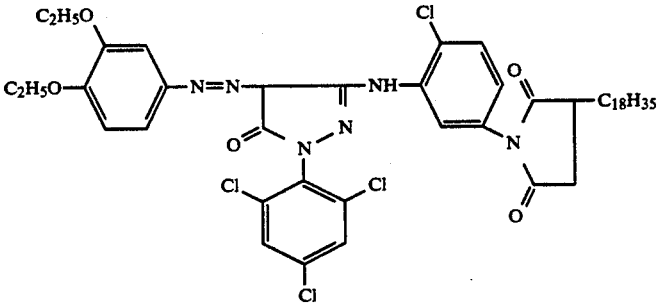

-continued
D-1
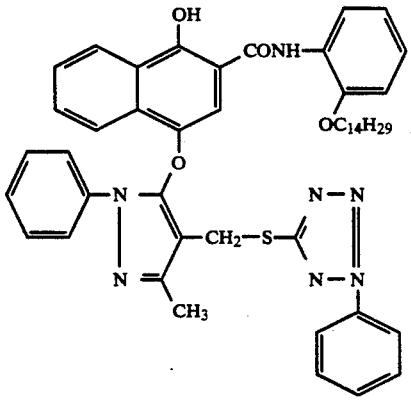
D-2
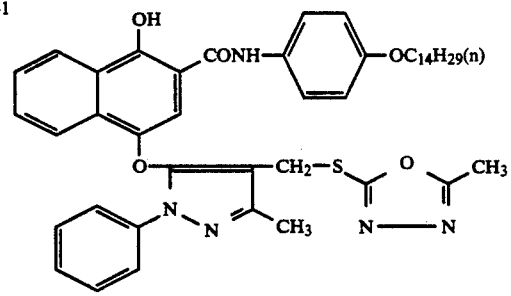
D-3
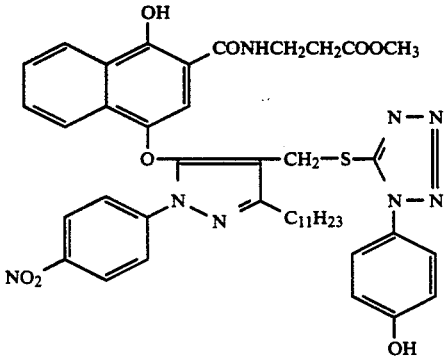
UV-1
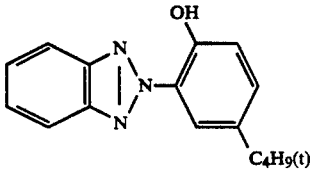
UV-2
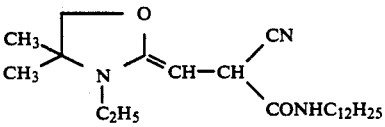
HS-1
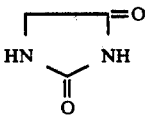
HS-2
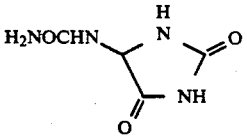
H-1
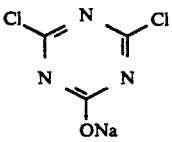
H-2
$[(CH_2{=}CHSO_2CH_2)_3CCH_2SO_2(CH_2)_2]_2N(CH_2)_2SO_3K$
SU-1
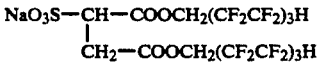
SU-2
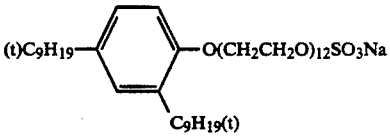
SU-3
(Alkanol XC)
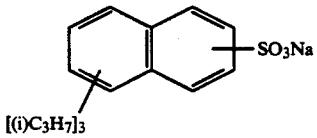
SU-4
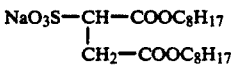
SC-1
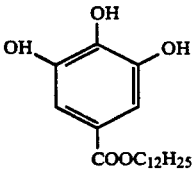

-continued

SC-2

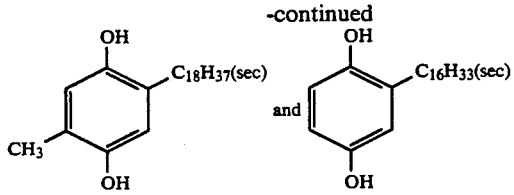

(mixed product of 2:3)

AI-1

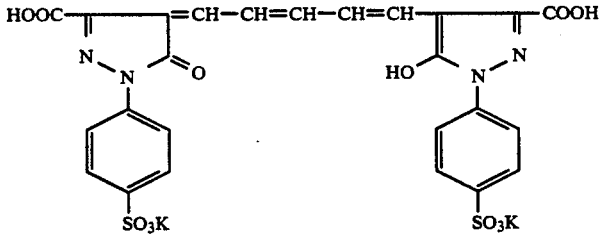

AI-2

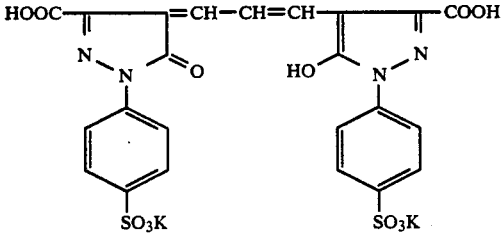

WAX-1

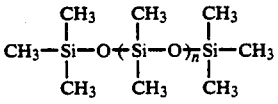

(average molecular weight: 30,000)

Oil-1

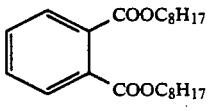

Oil-2

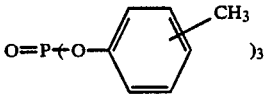

Oil-3

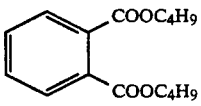

AF-1

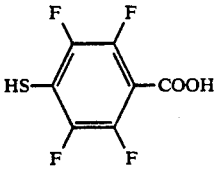

AF-2

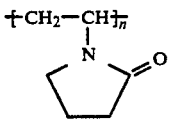

(average molecular weight: 9,000)

DI-1

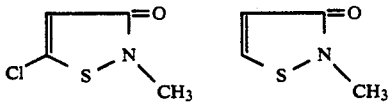

Next, we prepared Sample 2 in the same manner as in the above-mentioned Sample 1 except that Eighth layer (Intermediate layer) in Sample 1 was removed.

Samples 3 to 9 were prepared in the same manner as in the above-mentioned Sample 2 except that 0.5 milli mol/$m^2$ of the silver salt of dye in the present invention shown in Table 1 was added in place of yellow colloidal silver of Ninth layer (Yellow filter layer) in Sample 2.

Incidentally, the silver salt of dye was prepared by means of the following method and added as a dispersant.

In 1,000 ml of water, 0.1 mol of dye and 10.1 g (0.1 mol) of triethylamine were dissolved. While stirring, 200 ml of 1 mol/liter of silver nitrate aqueous solution was poured thereinto. Generated precipitation was filtrated, washed with water and dried to prepare silver salt of dye aimed.

Next, to 700 ml of 3% gelatin aqueous solution, 0.05 mol of the above-mentioned silver salt of dye and 30 ml of 6.7% solution of Surfactant Triton X-200 (produced by Rohm & Haas Co., Ltd.) were added. To the solution, 2 kg of glass beads (the diameter is 1 mm) were added and stirred for 8 hours by means of a stirred ball mill (Aquamizer QA-5, produced by Hosokawa Micron Co., Ltd.). Thus, the dispersion of silver salt of dye was obtained.

Samples 1 to 9 were subjected to white light exposure for sensitometry. Then, they were processed by means of the following processing steps. Thus, fogging in the green sensitive emulsion layer was measured.

Fogging was calculated from the increment of green light density obtained by subtracting the green light density on the unexposed portion of Sample 1 processed by the following processing steps from that on Sample 1 processed by bleaching step and thereafter without being subjected to color development in the following processing step After Samples 1 to 9 were subjected to sine wave exposure by white light, they were processed by the following processing steps for obtaining sharpness.

The sharpness thus obtained was evaluated by MTF (Modulation Transfer Function) value of dye images, and it was indicated in terms of the relative value of MTF at 30 lines/mm ( Sample 1 is defined to be 100). The results were shown in

| Processing steps (38° C.) | |
|---|---|
| Color development | 3 min. and 15 sec. |
| Bleaching | 6 min. and 30 sec. |
| Washing | 3 min. and 15 sec. |
| Fixing | 6 min. and 30 sec. |
| Washing | 3 min. and 15 sec. |
| Stabilizing | 1 min. and 30 sec. |
| Drying | |

The composition of a processing solution used in each processing step is as follows:

| | |
|---|---|
| <Color developer> | |
| 4-amino-3-methyl-N-ethyl-N-(β-hydroxyethyl) aniline sulfate | 4.75 g |
| Sodium unhydride sulfite | 4.25 g |
| Hydroxylamine sulfate | 2.0 g |
| Potassium unhydride carbonate | 37.5 g |
| Sodium bromide | 1.3 g |
| Potassium iodide | 1.0 mg |
| Trisodium nitryloacetate (monohydrate) | 2.5 g |
| Potassium hydroxide | 1.0 g |
| Add water to make | 1 l. |
| <Bleacher> | |
| Ammonium ferric ethylenediaminetetraacetate | 100 g |
| Diammonium ethylenediaminetetraacetate | 10.0 g |
| Ammonium bromide | 150 g |
| Glacial acetic acid | 10 ml |
| Add water to make 1 l, and adjust pH to 6.0 with aqueous ammonium. | |
| <Fixer> | |
| Ammonium thiosulfate | 175.0 g |
| Sodium unhydride sulfite | 8.5 g |
| Sodium metasulfite | 2.3 g |
| Add water to make 1 l, and adjust pH to 6.0 with acetic acid. | |
| <Stabilizer> | |
| Formalin (37% aqueous solution) | 1.5 ml |
| Konidax (produced by Konica Corporation) | 7.5 ml |
| Add water to make | 1 l. |

TABLE 1

| Sample | Silver salt of dye | Fogging | Sharpness | Note |
|---|---|---|---|---|
| 1 | — | 0.12 | 100 | Comparative |
| 2 | — | 0.24 | 105 | Comparative |
| 3 | I-1 | 0.13 | 104 | Invention |
| 4 | I-12 | 0.12 | 104 | Invention |
| 5 | II-3 | 0.13 | 105 | Invention |
| 6 | III-2 | 0.13 | 106 | Invention |
| 7 | IV-6 | 0.12 | 105 | Invention |
| 8 | I'-1 | 0.12 | 106 | Invention |
| 9 | II'-3 | 0.12 | 105 | Invention |

As is apparent from Table 1, though the improvement in sharpness was observed on Sample 2 having no Eighth layer (Intermediate layer), increase of fogging in the green sensitive layer was remarkable. Therefore, it is impossible to put this to practical use. On the other hand, improvement in sharpness with the increase of fogging in the green sensitive layer was observed Samples on 3 to 9 wherein silver salt of dye in the present invention was used in place of yellow colloidal silver in Ninth layer (Yellow filter layer).

EXAMPLE 2

Sample 10 was prepared in the same manner as in the above-mentioned Sample 1 except that Second layer (Intermediate layer) in Sample 1 of Example 1 was removed.

Samples 11 to 19 were prepared in the same manner as in the above-mentioned Sample 10 except that 0.75 milli mol/m$^2$ of the silver salt of dye in the present invention shown in Table 2 was added in place of black colloidal silver in First layer (Anti-halation layer) in Sample 10.

After Samples 10 to 19 were subjected to sensitometric exposure to white light, they were processed by the same processing steps as Example 1 for checking fogging of the red sensitive emulsion layer.

In addition, after Samples 10 to 19 were subjected to sine wave exposure to white light, they were processed by the same processing steps as the above-mentioned Example 1 for obtaining sharpness.

Sharpness thus obtained was evaluated by MTF (Modulation Transfer Function) value of dye images, and it was indicated in terms of the relative value of MTF at 30 lines/mm ( Sample 1 is defined to be 100). The results are shown in Table 2.

TABLE 2

| Sample | Silver salt of dye | Fogging | Sharpness | Note |
|---|---|---|---|---|
| 10 | — | 0.23 | 104 | Comparative |
| 11 | I-2 | 0.14 | 108 | Invention |
| 12 | I-15 | 0.13 | 107 | Invention |
| 13 | II-4 | 0.13 | 108 | Invention |
| 14 | IV-5 | 0.12 | 106 | Invention |
| 15 | I'-3 | 0.14 | 108 | Invention |
| 16 | II'-7 | 0.13 | 108 | Invention |
| 17 | III'-7 | 0.12 | 107 | Invention |
| 18 | VI-3 | 0.14 | 108 | Invention |
| 19 | VI-13 | 0.13 | 108 | Invention |

As is apparent from Table 2, though improvement in sharpness was observed in Sample 10 wherein Second layer (Intermediate layer) was removed, fogging in the red sensitive layer was remarkable. Therefore, it is impossible to put this to practical use. On the other hand, improvement in sharpness with no increase in fogging on the red sensitive layer was observed on Samples 11 to 19 wherein the silver salt of dye in the present invention was used in place of black colloidal silver in First layer (Anti-halation layer).

EXAMPLE 3

Sample 20 was prepared in the same manner as the above-mentioned Sample 1 except that Second layer (Intermediate layer) and Eighth layer (Intermediate layer) of Sample 1 in Example 1 were removed.

Samples 21 to 29 were prepared by replacing black colloidal silver of First layer (Anti-halation layer) in the above-mentioned Sample 20 with 0.75 milli mol/m$^2$ of silver salt of dye of the present invention shown in Table 3, by replacing yellow colloidal silver of Ninth layer (Yellow filter layer) with 0.5 milli mol/m$^2$ of silver salt of dye of the present invention shown in Table 3 and by replacing Yellow coupler (Y-1) of Tenth layer and Eleventh layer with the same mol of couplers shown in Table 3.

After Samples 20 to 29 were subjected to sensitometric exposure to white light, they were processed through the same processing steps as the above-mentioned Example 1. Thus, sensitivity and fogging of the blue sensitive emulsion layer were calculated. Sensitivities are represented with relative values for 100 that is the sensitivity of Sample 20 was 100.

In addition, after Samples 20 to 29 were subjected to sine wave exposure to white light, they were processed under the same processing step as the above-mentioned Example 1 for obtaining sharpness.

Sharpness thus obtained was evaluated by means of MTF (Modulation Transfer Function) value of dye images and represented with the relative value of MTF (Sample 1 is defined to be 100) at 30 lines/mm.

The results are shown correctively in Table 3.

TABLE 3

| Sample | Dye silver salt 1st layer | Dye silver salt 9th layer | Yellow Coupler | Sensitivity | Fogging | Sharpness | NOTE |
|---|---|---|---|---|---|---|---|
| 20 | — | — | Y-1 | 100 | 0.20 | 106 | Comparative |
| 21 | I-2 | I-1 | YB-15 | 123 | 0.12 | 108 | Invention |
| 22 | I-15 | I-12 | YB-16 | 125 | 0.11 | 109 | Invention |
| 23 | IV-5 | III-2 | YB-15 | 122 | 0.12 | 108 | Invention |
| 24 | II'-7 | I'-1 | YB-16 | 124 | 0.10 | 108 | Invention |
| 25 | I-2 | II'-3 | YB-16 | 123 | 0.11 | 107 | Invention |
| 26 | III'-7 | V-4 | YB-15 | 125 | 0.10 | 109 | Invention |
| 27 | VI-3 | I-12 | YB-23 | 122 | 0.12 | 108 | Invention |
| 28 | VI-13 | VI-17 | YB-29 | 124 | 0.11 | 109 | Invention |
| 29 | VI-29 | I-1 | YB-15 | 122 | 0.12 | 107 | Invention |

As is apparent from Table 3, Sample 20 wherein Second layer (Intermediate layer) and Eighth layer (Intermediate layer) was removed showed remarkable increase of fog on the blue sensitive layer though improvement in sharpness was observed. Therefore, it is impossible to put this to practical use. On the other hand, improvement in sharpness was observed in Samples 21 to 29 wherein the silver salt of dye of the present invention was used in place of black colloidal silver of First layer (Anti-halation layer) and yellow colloidal silver of ninth layer (Yellow filter layer) and benzoyl acetoanilido type yellow coupler of the present invention was used for the blue sensitive emulsion layer. In addition, the increase in the sensitivity of the blue sensitive layer was observed too.

EXAMPLE 4

Samples 30 to 39 were prepared by replacing black colloidal silver of First layer (Anti-halation layer) of Sample 20 in Example 1 with 0.75 milli mol/m$^2$ of silver salt of dye of the present invention shown in Table 4, by replacing yellow colloidal silver of Ninth layer (Yellow filter layer) with 0.5 milli mol/m$^2$ of the silver salt of dye shown in Table 4 and by replacing the cyan coupler (C-1) in Third layer and Fourth layer with the same mol of coupler shown in Table 4.

After Samples 20 and 30 to 39 were subjected to sensitometric exposure to white light, they were processed under the same processing step as the above-mentioned Example 1. Thus, the sensitivity and the fogging of red sensitive emulsion layer were calculated. The sensitivities are indicated with relative values for 100 that is the sensitivity of Sample 20 to be 100.

In addition, after Samples 20 and 30 to 39 were subjected to sine wave exposure to white light, they were processed under the above-mentioned processing step to calculate sharpness.

Sharpness thus obtained was evaluated by means of MTF (Modulation Transfer Function) value of dye images, and it is indicated with the relative value of MTF (when Sample 1 was defined to be 100) at 30 lines/mm. The results were shown in Table 4.

TABLE 4

| Sample | Dye silver salt 1st layer | Dye silver salt 9th layer | Yellow Coupler | Sensitivity | Fogging | Sharpness | NOTE |
|---|---|---|---|---|---|---|---|
| 20 | — | — | C-1 | 100 | 0.23 | 106 | Comparative |
| 30 | I-2 | I-1 | CU-4 | 119 | 0.12 | 109 | Invention |
| 31 | I-15 | I-12 | CU-1 | 118 | 0.11 | 110 | Invention |
| 32 | II-4 | II-3 | CU-6 | 122 | 0.13 | 110 | Invention |
| 33 | IV-5 | III-2 | CU-2 | 120 | 0.12 | 109 | Invention |
| 34 | I-2 | IV-6 | CU-13 | 119 | 0.11 | 111 | Invention |
| 35 | I'-3 | I'-1 | CU-22 | 121 | 0.13 | 110 | Invention |
| 36 | II'-7 | II'-3 | C-I-20 | 122 | 0.11 | 110 | Invention |
| 37 | III'-7 | V-4 | C-I-29 | 120 | 0.13 | 109 | Invention |
| 38 | VI-13 | VI-25 | C-I-20 | 123 | 0.12 | 110 | Invention |
| 39 | VI-16 | I-1 | C-I-20 | 123 | 0.12 | 109 | Invention |

As is apparent from Table 4, Sample 20 wherein Second layer (Intermediate layer) and Eighth layer (Intermediate layer) were removed showed remarkable increase of fogging in the blue sensitive layer though the improvement in sharpness was observed. Therefore, it cannot be put to practical use. On the other hand, improvement in sharpness was observed on Samples 30 to 39 wherein the silver salt of dye of the present invention was used in place of the black colloidal silver of First layer (Anti-halation layer) and the yellow colloidal silver of Ninth layer (Yellow filter layer) and the cyan couplers represented by C-I or C-II of the present invention were used for the red sensitive emulsion layer without an increase of the fogging of the red sensitive layer. In addition, increase of the sensitivity in the red sensitive layer was observed, too.

EXAMPLE 5

Samples 40 to 49 were prepared by adding 0.75 milli mol/m$^2$ of the silver salt of dye of the present invention shown in Table 5 in place of the black colloidal silver of First layer (Anti-halation layer) of Sample 20 in Example 3, by adding 0.5 milli mol/m$^2$ of the silver salt of dye of the present invention shown in Table 5 in place of the yellow colloidal silver of Ninth layer (Yellow filter layer) and by adding 0.1 milli mol of the inhibitor of the present invention shown in Table 5 per mol of silver halide in each silver halide emulsion layer.

After Samples 20 and 40 to 49 were subjected to sensitometric exposure to white light, they were processed by the processing steps identical to those in the above-mentioned Example 1. Thus, fogging of each sensitive emulsion layer was calculated.

In addition, by leaving Samples 20 and 40 to 49 for 3 days under the conditions of the temperature of 55° C. and the relative humidity of 80% , samples subjected to accelerated aging were prepared. After the obtained samples were subjected to sensitometric exposure to white light, they were processed through the processing steps identical to those in the above-mentioned Example 1. Thus, fogging of each light-sensitive emulsion layer was obtained.

In addition, the samples 20 and 40 to 49 were subjected to sine wave exposure to white light, they were processed through the above-mentioned processing steps. Thus, their sharpness was obtained.

Sharpness thus obtained was evaluated by MTF (Modulation Transfer Function) value of dye images and it is indicated with the relative value of MTF at 30 lines/mm (Sample 1 was defined to be 100.). The results are collectively shown in Table 5.

TABLE 5

| Sample | Dye silver salt | | | Fogging of each light-sensitive layer | | | Fogging after torture test | | | | |
|---|---|---|---|---|---|---|---|---|---|---|---|
| No. | 1st layer | 9th layer | Inhibitor | B | G | R | B | G | R | Sharpness | Note |
| 20 | — | — | — | 0.20 | 0.23 | 0.23 | 0.35 | 0.34 | 0.33 | 106 | Comparative |
| 40 | I-2 | I-1 | 36 | 0.08 | 0.09 | 0.08 | 0.12 | 0.12 | 0.14 | 109 | Invention |
| 41 | I-15 | I-12 | 38 | 0.08 | 0.08 | 0.09 | 0.13 | 0.12 | 0.15 | 110 | Invention |
| 42 | II-4 | II-3 | 53 | 0.09 | 0.09 | 0.09 | 0.14 | 0.14 | 0.15 | 110 | Invention |
| 43 | IV-5 | III-2 | 63 | 0.08 | 0.08 | 0.09 | 0.12 | 0.12 | 0.14 | 109 | Invention |
| 44 | I-2 | IV-6 | 36 | 0.10 | 0.09 | 0.09 | 0.13 | 0.14 | 0.15 | 111 | Invention |
| 45 | I'-3 | I'-1 | 36 | 0.08 | 0.09 | 0.09 | 0.12 | 0.13 | 0.14 | 110 | Invention |
| 46 | II'-7 | II'-3 | 36 | 0.08 | 0.08 | 0.08 | 0.12 | 0.13 | 0.14 | 110 | Invention |
| 47 | III'-7 | V-4 | 36 | 0.09 | 0.09 | 0.08 | 0.13 | 0.13 | 0.03 | 109 | Invention |
| 48 | VI-13 | VI-25 | 68 | 0.08 | 0.08 | 0.09 | 0.12 | 0.12 | 0.13 | 110 | Invention |
| 49 | VI-16 | I-1 | 86 | 0.09 | 0.09 | 0.09 | 0.12 | 0.13 | 0.13 | 109 | Invention |

As is apparent from Table 5, Sample 20 wherein Second layer (Intermediate layer) and Eighth layer (Intermediate layer) were removed showed remarkable increase of fogging in each light-sensitive layer and the remarkable increase of fogging after subjecting to torture test was. Therefore, it could not be put into practice. On the other hand, Samples 40 to 49 wherein the black colloidal silver of first layer (Anti-halation layer) and the yellow colloidal silver of Ninth layer (Yellow filter layer) were replaced with the silver salt of dye of the present invention and the inhibitor of the present invention was added to each light-sensitive layer showed improvement in sharpness without increasing fogging of each light-sensitive layer. In addition, increase of fogging in the sample subjected to torture test was reduced.

The object of the present invention is to provide a silver halide color photographic light-sensitive material having high sharpness, high speed, less fogging and excellent raw stock stability, and the constitution of the present invention is a silver halide color photographic light-sensitive material having a support provided thereon a blue sensitive silver halide emulsion layer, a green sensitive silver halide emulsion layer and a red sensitive silver halide emulsion layer wherein a yellow filter layer containing a silver salt of dye and/or a anti-halation layer containing silver salt of dye are provided.

What is claimed is:

1. A silver halide color photographic light-sensitive material comprising:

a support having thereon photographic component layers having a blue sensitive silver halide emulsion layer, a green sensitive silver halide emulsion layer and a red sensitive silver halide emulsion layer; wherein at least one of said photographic component layers contains a silver salt of a dye represented by the following formulae II to V;

Formula II

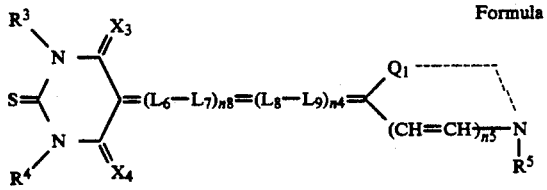

wherein $R^3$ and $R^4$ each represents a hydrogen atom, an alkyl group, an alkenyl group, an aryl group or a heterocyclic group; $X_3$ and $X_4$ each represents an oxygen atom or a sulfur atom; $L_6$ to $L_9$ represent methine groups; $n_3$ to $n_5$ represent 0 to 2 integers; $R^5$ represents an alkyl group or an alkenyl group; $Q_1$ represents a nonmetallic atom group necessary for forming 5-membered or 6-membered heterocyclic group;

Formula III

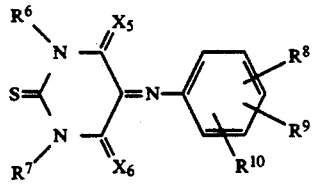

wherein $R^6$ and $R^7$ represent $R^3$ and $R^4$ in formula II; $X_5$ and $X_6$ represent $X_3$ and $X_4$ in formula II; $R^8$ to $R^{10}$ represent a hydrogen atom, an alkyl group, an alkenyl group, an aryl group, a heterocyclic group, a halogen atom, a cyano group, a sulfo group, $-COR^{11}$, $-CON(R^{11})(R^{12})$, $-N(R^{11})(R^{12})$, $-OR^{11}$, $-SOR^{11}$, $-SO_2R^{11}$, $-SO_2N(R^{11})(R^{12})$, $-N(R_{11})(COR_{12})$, $-N(R^{11})SO_2R^{12}$, $-N(R^{11})CON(R^{12})(R^{13})$, $-SR^{11}$ or $-COOR^{11}$; $R^{11}$ to $R^{13}$ represent a hydrogen atom, an alkyl group, an alkenyl group, an aryl group or a heterocyclic group, respectively;

Formula IV

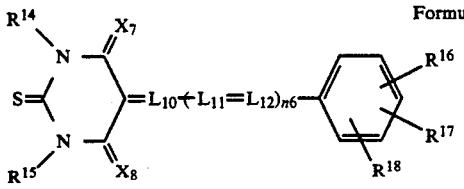

wherein $R^{14}$ and $R^{15}$ are the same as $R^3$ and $R^4$ in formula II; $X_7$ and $X_8$ are the same as $X_3$ and $X_4$ in formula II; $L_{10}$ to $L_{12}$ represent methine groups; $n_6$ represents 0 to 2 integers; $R^{16}$ to $R^{18}$ are the same as $R^8$ to $R^{10}$ in Formula III;

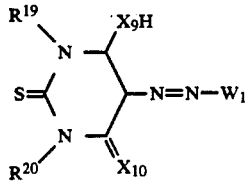

wherein $R^{19}$ and $R^{20}$ are the same as $R^3$ and $R^4$ in formula II $X_9$ and $X_{10}$ are the same as $X_3$ and $X_4$; $W_1$ represents an aryl group or a heterocyclic group.

2. The silver halide color photographic light-sensitive material of claim 1 wherein said photographic component layers further has a yellow filter layer, wherein said yellow filter layer contains the silver salt of a dye.

3. The silver halide color photographic light-sensitive material of claim 1 wherein said photographic component layers further has an anti-halation layer, wherein said anti-halation layer contains the silver salt of a dye.

4. The silver halide color photographic light-sensitive material of claim 1 wherein said blue sensitive silver halide emulsion layer contains a benzoylacetoanilido type yellow coupler.

5. The silver halide color photographic light-sensitive material of claim 4 wherein said benzoylacetoanilido type yellow coupler is represented by the following formula YB-I;

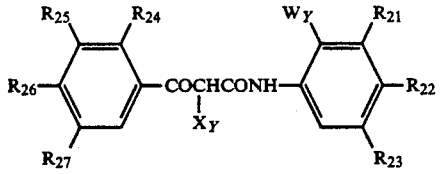

wherein $R_{21}$ to $R_{27}$ and WY represent a hydrogen atom or a substituent; $R_{21}$, $R_{22}$ and $R_{23}$ may be the same or different and each of them represents a hydrogen atom, a halogen atom, an alkyl group, an aryl group, an alkoxy group, an acylamino group, a carbamoyl group, an alkoxycarbonyl group, a sulfonamide group or a sulfamoyl group; $R_{24}$, $R_{25}$, $R_{26}$ and $R_{27}$ may be the same or different and each of them represents a hydrogen atom, an alkyl group, an alkoxy group, an aryloxy group, an acylamino group or a sulfonamide group; $W_Y$ represents a halogen atom, an alkyl group, an alkoxy group, an aryloxy group or a dialkylamino group; $X_Y$ represents a hydrogen atom, an alkoxy group, an aryloxy group, an acyloxy group, an alkylthio group, an arylthio group, a heterocyclicthio group or, a saturated or unsaturated 5-membered or 6-membered nitrogen-containing heterocyclic group.

6. The silver halide color photographic light-sensitive material of claim 5 wherein $X_y$ is represented by the following formula YB-II or YB-III;

formula YB-II

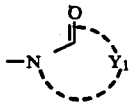

wherein $Y_1$ represents non-metalic atoms necessary forming 5 or 6- membered ring which may have a substituent;

—O—Ar Formula YB-III wherein Ar represents an aryl group; and aryl groups containing a substituent.

7. The silver halide color photographic light-sensitive material of claim 1 wherein said red sensitive silver halide emulsion layer contains a cyan coupler represented by the following formulae C-I or C-II;

Formula C-I

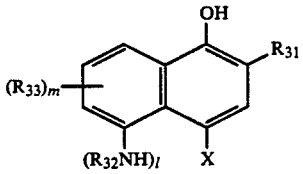

$(R_{32}—NH)_l$ wherein $R_{31}$ represents —CON($R_{34}$)($R_{35}$), —NHCOR$_{34}$, —NHCOOR$_{36}$, —NHS02R$_{36}$,—NHCON($R_{34}$)($R_{35}$), —SO$_{02}$N($R_{34}$)($R_{35}$) or NHSO$_2$N($R_{34}$)($R_{35}$); $R_{32}$ represents a hydrogen atom or a substituent; $R_{33}$ represents a substituent; X represents a hydrogen atom or a group splitting off by the reaction with an aromatic primary amine developer oxidation product; l represents 0 or 1; m represents 0 to 3 integers; $R_{34}$ and $R_{35}$ respectively represent a hydrogen atom, an aromatic group, an aliphatic group or a heterocyclic group; $R_{36}$ represents an aromatic group, an aliphatic group or a heterocyclic group; and when m is 2 or 3, each of $R_{33}$ may be the same or different, and may be linked together to form a ring; and when $R_{34}$ and $R_{35}$, $R_{33}$ and $R_{32}$ and X may form ring; when l represents 0, $R_{31}$ represents —CONHR$_{37}$ and $R_{37}$ represents an aromatic group;

formula C-II

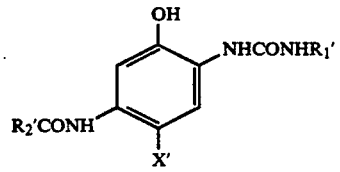

wherein X' represents a hydrogen atom or a group capable of being split off by coupling with an aromatic primary amine color developer; $R_1'$ represents an aryl group or a heterocyclic group; $R_2'$ represents an aliphatic group or an aryl group.

8. The silver halide color photographic light-sensitive material of claim 1 wherein at least one of said blue sensitive silver halide emulsion layer, said green sensitive silver halide emulsion layer and said red sensitive silver halide emulsion layer contains a heterocyclic type anti-foggant.

9. The silver halide color photographic light-sensitive material of claim 8 wherein said heterocyclic type anti-foggant is an imidazole, a triazole, a tetrazole, a thiadiazole, an oxazole, a pyridine, a pyrimidine, a benzoimidazole, a benzotriazole, an indazole, a benzothiazole, a benzooxazole or azainden.

10. The silver halide color photographic material of claim 2 wherein said yellow filter layer contains 0.05 to 2.0 $g/m^2$ of said silver salt of a dye.

11. The silver halide color photographic material of claim 10 wherein said yellow filter layer contains 0.1 to 1.0 $g/m^2$ of said silver salt of a dye.

12. The silver halide color photographic material of claim 3 wherein said anti-halation layer contains 0.05 to 2.0 $g/m^2$ of said silver salt of a dye.

13. The silver halide color photographic material of claim 13 wherein said anti-halation layer contains 0.1 to 1.0 $g/m^2$ of said silver salt of a dye.

* * * * *

UNITED STATES PATENT AND TRADEMARK OFFICE

CERTIFICATE OF CORRECTION

PATENT NO. : 5,290,669

DATED : March 1, 1994

INVENTOR(S) : Shigeto HIRABAYASHI, et al.

It is certified that error appears in the above-indentified patent and that said Letters Patent is hereby corrected as shown below:

Claim 1, col. 119, line 26, insert --;-- after "II".

Claim 5, col. 119, line 54, "WY" should read --$W_y$--.

Claim 6, col. 120, line 13, "non-metalic" should read --non-metallic--.

Claim 7, col. 120, line 36, "NHSO2$R_{36}$," should read --$NHSO_2R_{36}$,--;

Claim 7, col. 120, line 49, "form ring" should read --form a ring--.

Signed and Sealed this

Eleventh Day of October, 1994

Bruce Lehman

*Attest:*

BRUCE LEHMAN

*Attesting Officer*

*Commissioner of Patents and Trademarks*